United States Patent [19]

Shiba et al.

[11] Patent Number: 5,053,322

[45] Date of Patent: Oct. 1, 1991

[54] METHOD FOR PROCESSING SILVER HALIDE COLOR PHOTOGRAPHIC MATERIALS HAVING A REFLECTIVE SUPPORT

[75] Inventors: Keisuke Shiba; Akira Abe, both of Kanagawa, Japan

[73] Assignee: Fuji Photo Film Co., Ltd., Kanagawa, Japan

[21] Appl. No.: 427,560

[22] Filed: Oct. 27, 1989

[30] Foreign Application Priority Data

Oct. 27, 1988 [JP] Japan ..... 63-271613
Jun. 28, 1989 [JP] Japan ..... 1-165652

[51] Int. Cl.[5] ..... G03C 7/30; G03C 7/16; G03C 1/76; G03C 7/26

[52] U.S. Cl. ..... 430/464; 430/467; 430/489; 430/485; 430/490; 430/491; 430/524; 430/525; 430/526; 430/535; 430/950

[58] Field of Search ..... 430/434, 464, 467, 524, 430/525, 526, 535, 950, 490, 491, 484, 485

[56] References Cited

U.S. PATENT DOCUMENTS

| | | | |
|---|---|---|---|
| 1,906,199 | 4/1933 | Rado | 430/525 |
| 2,694,639 | 11/1954 | Nadeau et al. | 430/525 |
| 3,925,282 | 12/1975 | Davis et al. | 525/190 |
| 4,851,327 | 7/1989 | Fuchizawa et al. | 430/524 |
| 4,894,321 | 1/1990 | Ogawa et al. | 430/524 |
| 4,908,295 | 3/1990 | Fuchizawa et al. | 430/272 |

FOREIGN PATENT DOCUMENTS

| | | | |
|---|---|---|---|
| 0253390 | 1/1988 | European Pat. Off. . | |
| 210346 | 9/1986 | Japan | 430/525 |
| 24247 | 2/1988 | Japan | 430/525 |
| 24252 | 2/1988 | Japan | 430/526 |

*Primary Examiner*—Charles L. Bowers, Jr.
*Assistant Examiner*—Patrick A. Doody
*Attorney, Agent, or Firm*—Sughrue, Mion, Zinn, Macpeak & Seas

[57] ABSTRACT

A method for processing a silver halide color photographic material is disclosed, comprising a support having a thin film of metal or metal oxide on a substrate; said thin film having mirror surface reflection properties or secondary diffuse reflection properties and having a surfaced reflectance of at least 0.5; said photographic material having thereon, in order outwardly from the support, an adhesive layer and at least one light-sensitive silver halide emulsion layer, by the steps which comprise developing the silver halide color photographic material with a developing bath containing a color developing agent and at least one compound represented by formulae (I), (II), (III) or (IV):

(I)

wherein M each represents hydrogen, an alkali metal or an ammonium group; and $R_1$ represents a lower alkyl group;

(II)

wherein $R_2R_3$ and $R_4$ each represents —COOM, —$PO_3M_2$ or a hydroxyl group, wherein M represents hydrogen, an alkali metal atom or an ammonium group, provided that at most one group represented by $R_2$, $R_3$ and $R_4$ represents a hydroxyl group; and n is an integer of 1 to 3;

(III)

wherein $R_5$, $R_6$, $R_7$ and $R_8$ each represents —COOM, —$PO_3M_2$ or a hydroxyl group, wherein M represents hydrogen, an alkali metal atom or an ammonium group, provided that at most two of $R_5$, $R_6$, $R_7$ and $R_8$ represent a hydroxyl group; m is an integer of 1 to 4; and p is 1 or 2;

(Abstract continue on next page.)

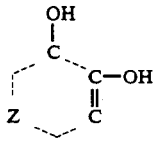
(IV)
wherein Z represents an atomic group necessary for forming a substituted or unsubstituted aromatic nucleus.
9 Claims, 5 Drawing Sheets

SEPARATION FILTER SPECTRAL TRANSMITTANCE a ANGULAR DISTRIBUTION OBTAINED FROM SAMPLE 120
b ANGULAR DISTRIBUTION OBTAINED FROM SAMPLE 128

METHOD FOR PROCESSING SILVER HALIDE COLOR PHOTOGRAPHIC MATERIALS HAVING A REFLECTIVE SUPPORT

FIELD OF THE INVENTION

The present invention concerns a method for processing silver halide color photographic materials in which a reflective support which has a thin film of metal or metal oxide which provides mirror reflection properties or "secondary" diffuse reflection properties (referred to below as a high luster metal support) is used.

More precisely, the present invention concerns a method of processing as described above for providing pictures which have excellent photographic characteristics and film peeling properties, that are obtained rapidly in a stable manner.

BACKGROUND OF THE INVENTION

In the past, black-and-white printing papers and color printing papers have been obtained by coating silver halide emulsion layers and protective layers on a reflective supports (for example, on baryta papers or resin coated papers) which have been made by mixing white pigments obtained by powdering transparent inorganic materials having a high refractive index with a sizing agent in a white base paper or by dispersing such pigments in a plastic film.

Photographic photosensitive materials in which simple mixed layers of microcapsules containing silver halide emulsions which have different optical wavelengths are coated onto aluminum supports having a mirror surface, i.e., a metallic luster, have been described in the specification of JP-A-49-33783 (the term "JP-A" as used herein refers to a "published unexamined Japanese patent application"). Examples of color printing papers in which supports which have metal foils which have non-directional matt glazed surfaces with resin layers over the top are used have been disclosed in the specification of JP-A-62-21147.

Generally, the reflection on the surfaces of substances are usually roughly classified into a mirror reflection and diffuse reflection. Further, the diffuse reflection can be classified into the primary diffuse reflection property and the secondary diffuse reflection property. The mirror reflection is the reflection on a smooth surface in accordance with the regular reflection law. The diffuse reflection is observed on the surfaces of papers, coatings, woods and walls, wherein incident light reflects not only regularly but also irregularly on the surface.

The secondary diffuse reflection property is observed on all the surfaces having minute slant boundaries such as the surface of a ground glass or abraded metal surface. The term "secondary diffuse reflection property" herein indicates a reflection occurring on a smooth mirror surface but on which very small unevennesses are provided to form boundaries thereon. The diffuse reflected light can be deemed as a collection of regularly reflected lights on the respective very small reflection surfaces. This is why the secondary diffuse reflection property is called "reflection property on small mirror planes" as defined in chapter 18, section 1 in *Shikisai Kagaku Handbook*, 5th Ed., edited by Japanese Color Society and published by Tokyo University Publishing Co. in 1985.

The primary diffuse reflection property is generally distinguished from the secondary diffuse reflection by the difference of the surface diffuse reflectance on the mirror surface of the substances. Generally, the reflectance of the substances having the primary diffuse reflection property is lower than that of the substances having the secondary diffuse reflection. The term "primary diffuse reflection" means that when a light-transmitting solid is finely pulverized and irradiated with a light, the incident light is diffused by the total reflection or the reflection on a part of the surface.

Furthermore, supports which have mirror surface reflection properties or secondary diffuse reflection properties, as defined, for example, in chapter 18, section 1 in *Shikisai Kagaku Handbook* (Japanese Color Society, 5th Edition, 1985, published by Tokyo University Publishing Co.) have been described, for example, in JP-A-61-210346, JP-A-63-118154, JP-A-63-24247, JP-A-63-24251, JP-A-63-24252, JP-A-63-24253, JP-A-63-24255 and JP-A-63-70844. However, in supports which have a resin layer over a metal surface of this type, the edge adhesion with overlying silver halide photosensitive layers or intermediate layers is poor. On the other hand, if the metal which forms the reflective surface is a metal such as aluminum which is less noble than silver, the metal may be dissolved out during processing and reduce the activity of the processing baths, and problems can arise with the occurrence of fogging and spotting.

With color photosensitive materials in which high luster metal supports are used, during processing, the processing solutions permeate from cut surfaces or from the edges and the film is liable to peel away, especially where the part which forms the surface of the support is a metal such as aluminum or an alloy thereof. Such film peeling cannot be prevented satisfactorily by providing a thermoplastic resin layer between the metal surface and the emulsion layers. Furthermore, such impregnating processing solutions are difficult to wash out satisfactorily prior to the completion of processing and staining is liable to develop with aging. Furthermore, strong coloration and tarring are liable to occur (edge staining).

Printed photographs made on color photosensitive materials which have a photosensitive layer in which a high luster metal support is used and which, in particular, have a photosensitive layer containing fine particles dispersed within it, with an oil or polymer as a dispersing agent, provide images which have especially good sharpness and saturation, etc., and so these defects (i.e., strong coloration, tarring, etc.) are particularly noticeable.

Furthermore, processing variations, such as fogging and softening of gradation, are increased when these color photosensitive materials are subjected to continuous color processing together with color papers in which ordinary (with primary diffuse reflection properties) reflective supports are used.

Various means are required for solving these problems, which arise on color development processing when special supports according to the present invention are used.

SUMMARY OF THE INVENTION

An object of the present invention is to provide a method of processing silver halide color photosensitive materials in which high luster metal supports are used which provides sharp images with a highly saturated color reproduction without edge staining, film peeling or increased staining.

A second object of the present invention is to provide a method of processing with little processing fluctuation so that color development processing can be commonly carried out together with color photosensitive materials using ordinary reflective supports.

The present inventors have studied various factors involved in the development processing of color photosensitive materials in which high luster metal supports are used, and it has now been discovered that these and other objects of the present invention can be realized by a method for processing a silver halide color photographic material comprising a support having a thin film of metal or metal oxide on a substrate; said thin film having mirror surface reflection properties or secondary diffuse reflection properties, and having a surface reflectance of at least 0.5; said photographic material having thereon, in order outwardly from the support, an adhesive layer and at least one light-sensitive silver halide emulsion layer, by the steps which comprise developing the silver halide color photographic material with a developing bath containing a color developing agent and at least one compound represented by formulae (I), (II), (III) or (IV):

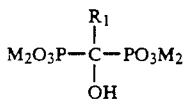

(I)

wherein M each represents hydrogen, an alkali metal or an ammonium group; and $R_1$ represents a lower alkyl group;

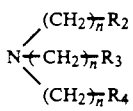

(II)

wherein $R_2$, $R_3$ and $R_4$ each represents —COOM, —$PO_3M_2$ or a hydroxyl group, wherein M represents hydrogen, an alkali metal or an ammonium group, provided that at most one group represented by $R_2$, $R_3$ and $R_4$ represents a hydroxyl group; and n is an integer of 1 to 3;

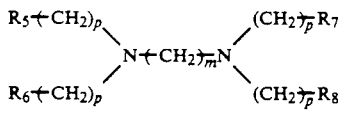

(III)

wherein $R_5$, $R_6$, $R_7$ and $R_8$ each represents —COOM, —$PO_3M_2$ or a hydroxyl group, wherein M represents hydrogen, an alkali metal atom or an ammonium group, provided that at most two of $R_5$, $R_6$, $R_7$ and $R_8$ represent a hydroxyl group; m is an integer of 1 to 4; and p is 1 or 2;

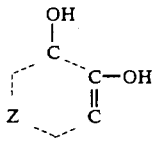

(IV)

wherein Z represents an atomic group necessary for forming a substituted or unsubstituted aromatic nucleus.

DETAILED DESCRIPTION OF THE INVENTION

Figure 1:
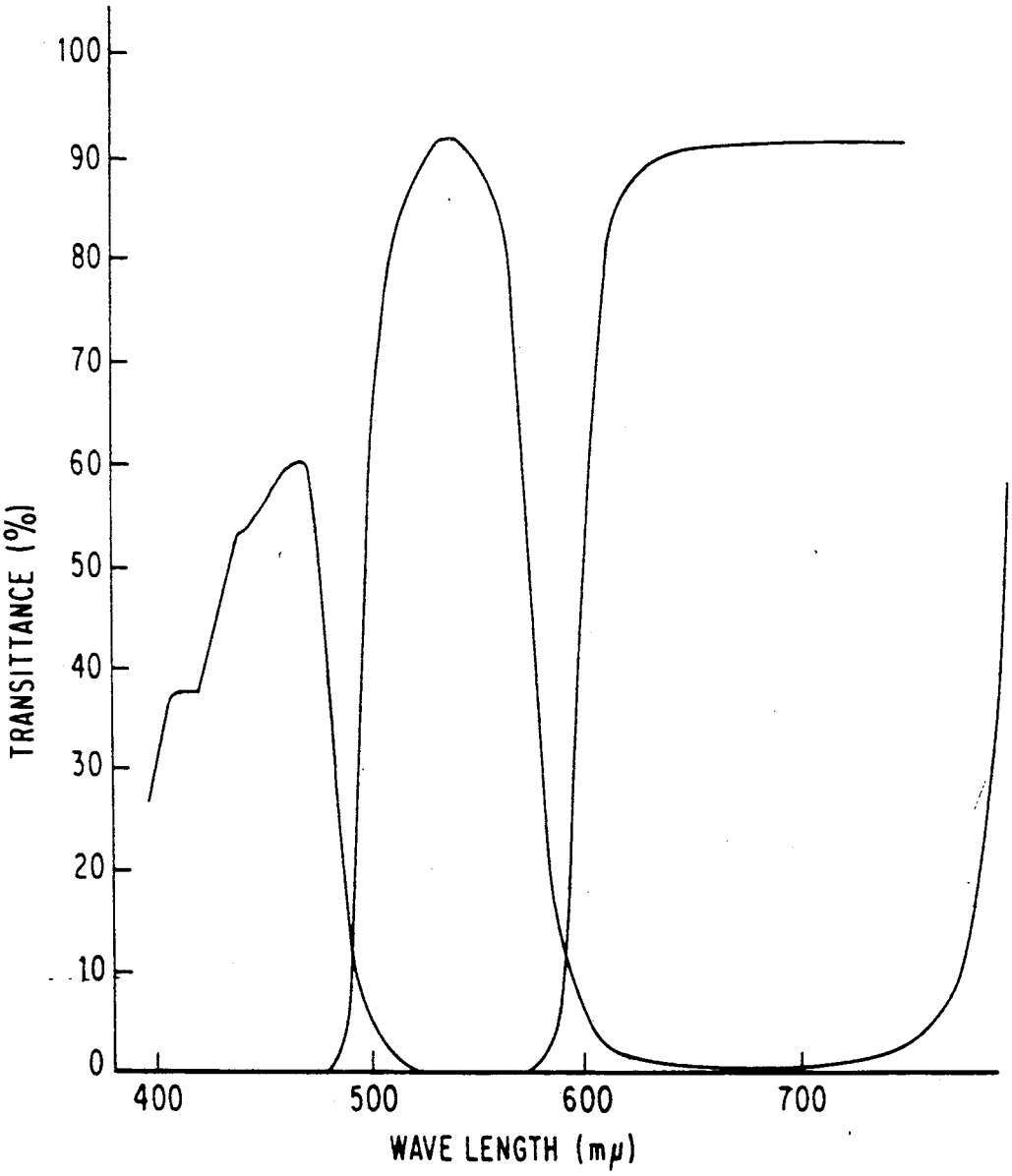
FIG. 1 shows the spectral transmission curves of the red, green and blue filters used for making tricolor separation exposures.

The present invention is now described in greater detail.

High Luster Metal Supports

The term "mirror surface reflection properties" as used herein signifies reflection properties which provide specular reflection, and in the present invention the surface reflectance is at least 0.5. The term "secondary diffuse reflection properties" as used herein signifies that the surface is a mirror surface but has gently slight roughness or is finely divided to provide diffuse reflection properties by decentralization of the angle in which the surface is facing. The surface reflectance is measured by a gonio-reflective meter. The preferred surface reflectance in the present invention is from 0.7 to 1.0. Thus, secondary diffuse reflection properties can be said to be due to a collection of small mirror surface reflections as described in the *Color Chemistry* (Japanese Color Society). More precisely, the surface should provide strong diffused reflected light at a viewing angle (i.e., visual angle) of generally from 0° to 45° (and preferably at a viewing angle of from 10° to 30°). The roughness of a surface which has secondary diffuse reflection properties should have a frequency of from 0.1 to 2,000 protrusions/mm for roughnesses of above 0.1 μm, and three dimensional surface roughness (SRa) as described in the explanation of a Kosaka Laboratories (Co.) model SE3AK device with respect to the mid-plane of from 0.1 to 1.2 μm is preferred. Particularly preferred SRa is 0.3 to 1.0 μm.

If the frequency of the protrusions of a surface which has secondary diffuse reflection properties is less than 0.1 protrusions/mm, the properties approach mirror surface reflection properties. On the other hand, the intensity of the diffuse reflected light at viewing angles of from 10° to 30° is reduced if the frequency exceeds 2,000 protrusions/mm. Frequencies of between 0.1 protrusions/mm and 2,000 protrusions/mm, and especially frequencies of between 50 protrusions/mm and 600 protrusions/mm, provide surfaces which have a high luster and high quality within the preferred viewing angle. The frequency and surface roughness with respect to the mid-plane can be observed and measured by cutting a cross section of the support, providing a specimen and using an electron microscope, or the state of the surface can be monitored using a three dimensional roughness measuring device such as a Kosaka Laboratories (Co.) model SE3AK device. (The measurement is carried out in the wavelength range from 2 to 250 μm.)

The high luster metal surfaces of the present invention preferably have a spectral reflectance of at least 0.5 in the wavelength range from 420 to 700 nm, and a spectral reflectance of from 0.6 to 1.00 is especially preferred. The spectral reflectance is determined as follows:

Monochromatic light of 550 nm is irradiated at an angle of 7° from normal line of a sample. A regular reflection fraction is eliminated by providing a trap located at a circumferential angle of 10° from center of incident light and fraction ranging within a circumferential angle of 90° from normal line other than the fraction eliminated by the trap are integrated by an integrating sphere. The spectral reflectance is shown by percentage on the basis of incident light. The spectral reflectance can be measured using a Color Analyzer 307 model spectrophotometer made by Hitachi Seisakujo, for example. The material used for the surface part of the support may comprise silver, aluminum, magnesium or alloys thereof, as described, for example, in F. Benford et al., *J. Opt. Soc. Amer.*, Vol. 32, pages 174–184 (1942). Furthermore, the metal oxides may be mixed with these metals or metal oxides can be used for the whole material. Metals and alloys or oxides thereof which have a surface reflectance of at least 0.5 can be used for the supports of the present invention. The use of aluminum and alloys or oxides thereof is especially preferred. A surface of these metals and their alloys or oxides (referred to collectively hereinafter as metals) can be established in the form of a metal plate or in the form of a thin metal film on some other substrate.

The metal surface of a support of the present invention is preferably covered with a thin metal oxide having a thickness of generally from about 100 Å to about 0.5 μm and preferably from 100 Å to 200 Å.

Metal plating can be accomplished by carrying out a metal rolling process with the metal. Moreover, foils of the metals can also be obtained by rolling to a thickness of about 1 to 100 μm, for example. Supports of the present invention can be obtained by laminating such thin metal films on a substrate. Anchor layers can also be established between a substrate and the thin metal film. Furthermore, thin films comprising a single layer or two or more layers can be established by applying the metal materials to a substrate, to a surface modified substrate, or to a surface modified anchor layer, by means of known methods such as vacuum vapor deposition methods, sputtering methods, ion plating methods, electrodeposition methods and electroless plating methods. The use of the vacuum vapor deposition method is preferred. The thickness of the thin metal film is generally from 300 Å to 20 μm, preferably from 500 Å to 1 μm, and most preferably from 1,000 Å to 0.5 μm.

A surface which has secondary diffuse reflection properties can be obtained by establishing a metal foil which has been roughened beforehand on a substrate or anchor layer, or a thin metal foil can be applied to the surface of a substrate or anchor layer which has been roughened beforehand. Details of such processes have been disclosed, for example, in the specifications of JP-A-61-210346, JP-A-63-118154, JP-A-63-24247, JP-A-63-24251 and JP-A-63-24255, and Japanese Patent Application Nos. 63-126 and 63-7545.

The preferred surfaces which have secondary diffuse reflection properties have a diffuse spectral reflectance in the wavelength range from 420 to 700 nm of at least 0.5, preferably of from 0.6 to 1.0, and most preferably of from 0.7 to 1.0. This diffuse spectral reflectance is the reflectance obtained by trapping the specular reflected light and collecting and measuring the other reflected light using a sphere of integration.

The roughness of a surface which provides the preferred secondary surface diffuse reflection properties not only widens the viewing angle within which strong diffuse reflected light is obtained but is also useful for improving adhesion with an adhesive layer and providing an improvement with respect to the film peeling which may occur during processing.

If the diffuse spectral reflectance is less than 0.5, the diffuse reflected light in the preferred viewing angle is less than that of color printing paper supports, such as resin coated papers, which are generally used, and the benefits of these supports are lost.

The preferred structure of a support of the present invention comprises, for example, a substrate, an anchor layer, a thin metal film and a subbing layer. The anchor layer provides adhesion between the substrate and the thin metal film, and diffuse reflection properties, for example.

The subbing layer may be established over an adhesive layer and it has an antihalation effect.

Examples of structural sequences for supports in accordance with the present invention are indicated below, but the present invention is not to be construed as being limited to these examples.

(1) Thin metal film/anchor layer/substrate
(2) Thin metal film/substrate (1)/anchor layer (containing an adhesive)/substrate (2)
(3) Thin metal film/anchor layer/substrate/antistatic layer
(4) Thin metal film/substrate (1) (with a matted surface)/anchor layer/substrate (2)/antistatic layer
(5) Thin metal film/substrate (acting as an anchor layer with a matted surface, a matting agent or an adhesive being included in the surface structure of the substrate)/antistatic layer
(6) Subbing layer (having a thickness of preferably 0.01 to 1.0 μm, more preferably 0.05 to 0.5 μm)/thin metal film/anchor layer/substrate/antistatic layer Among these, Nos. (3), (4), (5) and (6,) are preferred, and No. (5) is particularly preferred.

The layers other than the thin metal film are now described in greater detail.

Substrate

The substrate (preferably having a thickness of 5 to 200 μm) used in the present invention can be selected from known materials which can be used as supports. Examples of such materials include plastic films such as polyester films, for example, poly(ethylene terephthalate) and poly(butylene terephthalate) films; cellulose triacetate films; polyolefin films, for example, polystyrene films, polypropylene films and polyethylene films; and nylon films. Pigments can be used as fillers in, or coated on, these substrates in order to matt the surface, or the surface may be matted by means of a mechanical process. Examples of pigments which can be used as fillers include silica, titanium dioxide, barium sulfate, calcium sulfate, barium carbonate, calcium carbonate, lithopone, alumina white, zinc oxide, antimony trioxide and titanium phosphate. These pigments may be used individually or conjointly. The particle size of these pigments is preferably from 0.5 to 8 μm. Furthermore, filling at a rate of from 1 to 10 wt % is preferred. Metal soaps such as zinc stearate or aluminum stearate, or other surfactants can be used as dispersing agents in order to disperse these pigments in the resin.

The pigments indicated above can also be used in those cases where matting is achieved by pigment coating. Water-soluble, water-dispersible and nonaqueous systems can all be used as binders. Appropriate selections can be made and used on the basis of the Overall Technology Center Publication entitled *The Latest Binder Technology Handbook.* Gelatin, poly(vinyl alcohol) and casein, for example, can be used as water-soluble binders. The use of a hardening agent is desirable in these cases. Butadiene copolymer latexes, vinyl acetate resin emulsions, acrylic emulsions and polyolefin based emulsions can be used as aqueous dispersions. Moreover, polyester systems, vinyl acetate systems, thermoplastic elastomer systems, polyurethane systems, melamine systems, urea systems, alkyd systems, acrylic systems and phenol systems can be used as nonaqueous binders.

Sanding by subjecting a substrate to a jet flow of fine particles of a abrasive agent can be used for matting by means of a mechanical process.

A plastic film on which a thin metal film has been established can be used as it is as a support, or it may be attached to a plastic film, paper, RC paper, synthetic paper or metal plate, or to a polymer or copolymer sheet such as a sheet of polycarbonate, polystyrene, polyacrylate, polymethacrylate or PET, for example, which has excellent dimensional stability.

The method of attachment in the present invention can be selected appropriately from among the known lamination methods, such as those described, for example, in the Manufacturing Technology Research Association publication entitled *New Lamination Processes Handbook,* but use of a dry lamination method is preferred.

Anchor Coating Layers (i.e., anchor layers)

An anchor coating layer can be established between the substrate and the thin metal film in the present invention.

Anchor coating agents which can be used in anchor coating layers are preferably terpolymers of vinylidene chloride, vinyl chloride and maleic anhydride, but they may include copolymer components other than the three components indicated above. For example, use can be made of four component copolymers obtained by the copolymerization of vinylidene chloride, vinyl chloride, maleic anhydride and vinyl acetate.

In this case, the amount of vinyl acetate used among the copolymer components is preferably not more than 20% and particularly preferably from 20 to 25% (wt % of monomer).

The copolymers of vinylidene chloride, vinyl chloride and maleic anhydride used in the present invention preferably contain (a) from 5 to 70 wt % of vinylidene chloride, (b) from 20 to 80 wt % of vinyl chloride and (c) from 0.1 to 5 wt % of maleic anhydride.

The products become less hydrophobic if the vinylidene chloride content is less than 5 wt %, the film strength of the wet anchor coating layer is reduced, and this is undesirable. Furthermore, the solubility in organic solvents decreases if the vinyl chloride content is less than 20 wt % and this is undesirable.

Furthermore, the polyurethane/urea resin cited as adhesive layers as described hereinafter may be admixed with these materials. The proportions of vinylidene chloride/vinyl chloride/maleic anhydride copolymer and polyurethane/urea resin is preferably within the range from 100:0 to 40:60. The adhesion of the anchor coating layer with the plastic film is inadequate if the proportion of polyurethane/urea resin included is greater than 60 wt %. Preferably, the anchor coating layer is a very thin and uniform, and is coated at a thickness of generally from 0.01 μm to 5 μm, preferably from 0.01 to 1.0 μm and more preferably from 0.05 to 0.5 μm, on the surface of a plastic film. Adhesion failure of the metal reflecting layer occurs if the thickness is less than 0.01 μm, and the provision of a layer of thickness greater than 5 μm is disadvantageous in respect of cost, and the matting effect is reduced in those cases where the surface of the plastic film has been matted. Furthermore, inorganic or organic pigments having an average particle size of from 0.2 μm to 5 μm can be used as matting agents in the anchor coating layers.

The anchor coating layer can be formed using the coating methods described in JP-A-51-114120, JP-A-54-94025 and JP-A-49-11118. In practical terms, the coated films can be formed, for example, using dip coating methods, air knife coating methods, curtain coating methods, roller coating methods, doctor coating methods, wire bar coating methods, slide coating methods, gravure coating methods and reverse coating methods.

Antistatic Layers

The supports of the present invention preferably have antistatic layers established on the opposite side to the metal surface. The surface electrical resistance of this surface is preferably less than $10^{10}$ Ω. The formation of static marks due to large electrostatic charges and discharges is liable to occur during the manufacture and finishing of the photosensitive material if the electrical resistance is not less than $10^{10}$ Ω, and there is a risk with respect to the sensitivity being affected in this way while it is being handed. This danger is especially pronounced in those cases where a paper or plastic film having an insulating film is used for the substrate. A dispersion of fine particles of at least one type of crystalline electrically conductive metal oxide selected from among ZnO, $TiO_2$, $SnO_2$, $Al_2O_3$, $In_2O_3$, $SiO_2$, MgO, BaO and $MoO_3$, or of a composite of these oxides, in a binder may be used for an antistatic layer.

Crystalline metal oxide particles are preferred for the electrically conductive particles, but the inclusion of oxygen defects or a small amount of a different type of atom which forms a donor in the metal oxide which is being used is especially desirable for increasing the electrical conductivity in general, and the use of atoms which do not produce fogging in the silver halide emulsion layer is especially desirable in the latter case. Examples of metal oxides include ZnO, $TiO_2$, $SnO_2$, $Al_2O_3$, $In_2O_3$, $SiO_2$, MgO, BaO and $MoO_3$, and composite oxides thereof, and the use of ZnO, $TiO_2$ and $SnO_2$ is preferred. Examples of the other types of atom which can be added effectively to the metal oxides include Al and In, for example, in the case of ZnO; Sb, Nb and halogen atoms, for example, in the case of $SnO_2$; and Nb and Ta, for example, in the case of $TiO_2$. These different atoms are preferably added at a rate of from 0.01 mol % to 30 mol %, and most preferably at a rate of from 0.1 mol % to 10 mol %, with respect to the metal oxide.

The particle size of the particles used is preferably not more than 10 μm, and when the particle size is not more than 2 μm the stability after dispersion is better and the dispersion can be used easily. Furthermore, transparency can be achieved if electrically conductive particles having a size of not more than 0.5 μm are used to minimize light scattering as far as possible, and this is very desirable.

Water-soluble, water-dispersible and nonaqueous based binders can be used for the dispersion of the above-mentioned metal oxides. Gelatin, PVA and casein, for example, can be used as water-soluble binders. The use of a hardening agent is desirable in these cases. Butadiene copolymer latexes, vinyl acetate resin emulsions, acrylic emulsions and polyolefin based emulsions can be used as aqueous dispersion. Moreover, polyester systems, vinyl acetate systems, thermoplastic elastomer systems, polyurethane systems, melamine systems, urea systems, alkyd systems, acrylic systems and phenol systems can be used as nonaqueous binders. Furthermore, known electrically conductive polymers can be used for part or all of the binder. Such compounds include, for example, poly(vinylbenzenesulfonates), poly(vinylbenzyl trimethyl ammonium chloride), the quaternary salt polymers disclosed, for example, in U.S. Pat. Nos. 4,108,802, 4,118,231, 4,126,467 and 4,137,217, and the crosslinked type polymer latexes disclosed, for example, in U.S. Pat. No. 4,070,189 and West German Patent Application (OLS) No. 2,830,767. The amount of electrically conductive particles used is such as to provide a surface electrical resistance value of less than $10^{10}\ \Omega$. The amount used varies according to the type of electrically conductive particles, but in general an amount within the range of from 0.05 to 20 g/m$^2$ is used.

A higher volume fraction of electrically conductive particles in the layer is desirable for making more effective use of the electrically conductive particles and reducing the surface electrical resistance, but the inclusion of a minimum of about 5% of binder is desirable for ensuring that the layer has adequate strength, and the inclusion of a volume fraction of from 5% to 95% of electrically conductive particles is preferred.

However, the above-mentioned range clearly differs according to the type and form of substrate which is being used and the method of coating.

Layers containing colloidal alumina can also be used to reduce the surface electrical resistance value, as well as the methods described above in which electrically conductive particles are used.

The colloidal alumina which can be used in the present invention is fibrous alumina (hydrate) having average particle size of from 10 mμ×100 mμ, with the pH value maintained at from 2.5 to 4.0 (in a 10% aqueous solution of $Al_2O_3$) using an inorganic or an organic acid.

The colloidal alumina can be diluted with water or with an organic solvent which is miscible with water to prepare a coating solution. The concentration of colloidal silica in the coating solution is determined in consideration of the electrical resistance value required and the liquid viscosity, which is matched with the method of coating which is to be used.

The addition of various resins, dyes, matting agents, such as silica, and other materials to the abovedescribed coating solution can be made for purposes other than lowering the surface electrical resistance, e.g., for improving the friction coefficient, writability or color, within the scope of the present invention.

The coating methods described for the anchor coating layers can be used for coating these coating solutions.

Before coating, the substrate is preferably subjected to a treatment, such as a corona discharge treatment, glow discharge treatment, chromic acid treatment, flame treatment, hot air treatment, ozone treatment or an ultraviolet treatment, for example, from the point of view of the coating properties and adhesion properties.

Adhesive Layers

The supports of the present invention may have the silver halide emulsion layers coated on an adhesive layer on the mirror surface reflecting layer or on the thin metal film layer which exhibits secondary diffuse reflection properties.

Water resistant resins can be used in the adhesive layer. The water resistant resin is a resin of which the water content is not more than 0.5 wt %. A resin attaching the subbing layer and photosensitive layer which is coated thereon, such as an ionomer resin as disclosed in JP-A-63-118154, a styrene/butadiene based resin as disclosed in JP-A-63-253354, a silane coupling agent as disclosed in JP-A-63-253353, a vinylidene chloride copolymer as disclosed in Japanese Patent Application No. 62-291486, a mixture of a vinylidene chloride copolymer and a polyurethane/urea resin as disclosed in Japanese Patent Application No. 63-84667 or 63-176327, or a system in which epoxy group containing silanes, isocyanate group containing silanes or amino silanes are included in a silane coupling agent, is preferably used in the adhesive layer of the present invention. Particularly, in the present invention, the adhesive layer containing at least a copolymer of vinylidene chloride, vinyl chloride and maleic acid anhydride is preferred.

Mixtures of vinylidene chloride copolymers and polyurethane/urea resin are especially preferred.

The vinylidene chloride copolymers in the present invention are preferably copolymers containing (a) from 5 to 80 wt % of vinylidene chloride, (b) from 20 to 80 wt % of vinyl chloride, (c) from 5 to 20 wt % of vinyl acetate and (d) from 0.1 to 5 wt % of maleic anhydride.

The material becomes less hydrophobic when the vinylidene chloride content is less than 5 wt % and the wet film strength of the top coating layer becomes poor and this is undesirable. Furthermore, the solubility in organic solvents decreases if the vinyl chloride content is less than 20 wt % or more than 80 wt % and this is undesirable.

Blocking of the reverse side of the support is liable to occur if the vinyl acetate content is greater than 20 wt % and this is undesirable. Furthermore, there is little coloration of the adhesive layer due to the color developing bath if the vinyl acetate content is less than 5 wt % and this is undesirable.

The adhesion with silver halide emulsion layers is adversely affected and the film strength decreases if the maleic anhydride content is less than 0.1 wt % and this is undesirable.

The polyurethane/urea resins of the present invention are polymers which have a high urethane bond

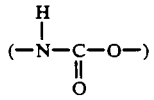

and urea bond

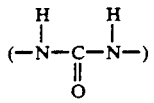

content, and they are obtained by reacting polyisocyanates or prepolymers thereof with polyhydroxy compounds or polar liquids which form a continuous phase.

Examples of polyisocyanates or polyisocyanate prepolymers which can be used in the present invention include diisocyanates such as m-phenylenediisocyanate, p-phenylenediisocyanate, 2,6-tolylenediisocyanate, 2,4-tolylenediisocyanate, naphthalene-1,4-diisocyanate, diphenylmethane-4,4'-diisocyanate, 3,3'-dimethoxy-4,4'-biphenyldiisocyanate, 3,3'-dimethyldiphenylmethane-4,4'-diisocyanate, xylylene-1,4-diisocyanate, xylylene-1,3-diisocyanate, 4,4'-diphenylpropanediisocyanate, trimethylenediisocyanate, hexamethylenediisocyanate, propylene-1,2-diisocyanate, butylene-1,2-diisocyanate, ethylidenediisocyanate, cyclohexylene-1,2-diisocyanate and cyclohexylene-1,4-diisocyanate; triisocyanates such as 4,4',4''-triphenylmethanetriisocyanate, toluene-2,4,6-triisocyanate and polymethylenepolyphenylisocyanate; tetraisocyanate monomers such as 4,4-dimethyldiphenylmethane-2,2',5,5'-tetraisocyanate, and compounds in which these polyisocyanates have undergone addition reaction with polyamines, polycarboxylic acids, polythiols, polyhydroxy compounds or epoxy compounds and in which there are at least two residual isocyanate groups in each molecule.

Examples of polyhydroxy compounds include aliphatic or aromatic polyhydric alcohols, hydroxypolyesters, hydroxypolyalkylene ethers, and alkylene oxide adducts of polyamines. For example, catechol, resorcinol, hydroquinone, 1,2-hydroxy-4-methylbenzene, 1,3-dihydroxy-5-methylbenzene, 3,4-dihydroxy-1-methylbenzene, 3,5-dihydroxy-1-methylbenzene, 2,4-dihydroxyethylbenzene, 1,3-naphthalenediol, 1,5-naphthalenediol, 2,7-naphthalenediol, 2,3-naphthalenediol, o,o'-biphenol, p,p'-biphenol, 1,1'-bi-2-naphthol, bisphenol A, 2,2'-bis(4-hydroxyphenyl)butane, 2,2'-bis(4-hydroxyphenyl)-isopentane, 1,1'-bis(4-hydroxyphenyl)-cyclopentane, 1,1,-bis(4-hydroxyphenyl)cyclohexane, 2,2'-bis(4-hydroxy-3-methylphenyl)propane, bis(2-hydroxyphenyl)methane, xylylenediol, ethylene glycol, 1,3-propylene glycol, 1,4-butylene glycol, 1,5-pentanediol, 1,6-heptanediol, 1,7-heptanediol, 1,8-octanediol, 1,1,1-trimethylolpropane, hexanetriol, pentaerythritol, glycerine, sorbitol, and aromatic or aliphatic polyhydric alcohols, can be used for this purpose.

The hydroxypolyesters which can be used are obtained, for example, from polycarboxylic acids and polyalcohols. Polycarboxylic acids which can be used for forming hydroxypolyesters include, for example, malonic acid, succinic acid, glutaric acid, adipic acid, pimelic acid, maleic acid, isophthalic acid, terephthalic acid and gluconic acid. The polyalcohols described above can be used for the polyalcohols in this case.

The hydroxypolyalkylene ethers are, for example, condensation products of alkylene oxides and polyalcohols. Alkylene oxides, such as butylene oxide or amylene oxide, and polyalcohols such as those described above, can be used to form the hydroxypolyalkylene ethers.

The polyamine alkylene oxide adducts are compounds in which at least one of the amino hydrogen atoms of a polyamine has been substituted with an alkylene oxide. Aromatic polyamines such as o-phenylenediamine, p-phenylenediamine and diaminonaphthalene, and aliphatic polyamines, such as ethylenediamine, 1,3-propylenediamine, diethylenetriamine and 1,6-hexamethylenediamine can be used to form the alkylene oxide adducts of polyamines. Various materials, such as ethylene oxide, propylene oxide and butylene oxide, for example, can be used for the alkylene oxide adducts.

Polar liquids which form a continuous phase are typified by water, but equivalent materials, such as ethylene glycol, glycerine, butyl alcohol and octyl alcohol, for example, can also be used.

The proportions of vinylidene chloride/vinyl chloride/vinyl acetate/maleic anhydride copolymer and polyurethane/urea resin are generally within the range, in terms of weight, of from 95/5 to 40/60, and preferably within the range, in terms of weight, of from 90/10 to 50/50. Adhesion to the metal reflecting surface is inadequate if the proportion of polyurethane/urea resin is less than 5 wt %, while adhesion between the adhesive layer and the silver halide emulsion layer is inadequate if the polyurethane/urea resin content is greater than 60 wt %.

After coating and drying the adhesive layer, the execution of a pretreatment, such as a corona discharge treatment, a glow discharge treatment or a flame treatment, for example, is effective for ensuring good adhesion with a silver halide emulsion. Furthermore, a gelatin subbing layer may be established before coating the silver halide emulsion.

The adhesive layer of the present invention is preferably coated uniformly and very thinly in contact with the metal reflecting layer with a thickness of from 0.1 μm to 10 μm and particularly from 0.1 to 3 μm. Adhesion failure arises at the metal reflecting layer if the thickness of the adhesive layer is less than 0.1 μm, and there is a cost disadvantage if the adhesive layer is thicker than 10 μm, and reproduction is poorer in terms of hue and gradation, for example.

Furthermore, ketones such as methyl ethyl ketone and acetone; chlorinated products such as tolyclean; esters such as ethyl acetate and butyl acetate; and aromatic organic solvents such as tolyol, for example, can all be used as diluting solvents for the materials which are used in the adhesive layers of the present invention, but the use of ethyl acetate is particularly preferred.

Furthermore, the adhesive layers of the present invention are very different from the anchor coating layers in that they are established between the thin metal film and the silver halide emulsion layer. The adhesive layers can be coated using the methods described above in connection with the anchor coating layer.

The adhesive layers of the present invention may have a multilayer structure. Such a multilayer structure contains a plurality of water resistant resin layers. Furthermore, they may also incorporate layers which adhere readily to emulsion layers and layers which attach the thin metal films to these layers. For example, they may have a structure of a subbing layer, a PET film layer and a layer which attaches the thin metal film to the PET film.

Color Development Processing Method

In the present invention, the color developing baths contain compounds selected from compounds represented by formulae (I) to (IV), in order to allow the color photosensitive materials of the present invention to be color developed and processed along with color photosensitive materials containing ordinary supports, without the occurrence of increased edge staining or film peeling, spotting or staining.

Color Developing Baths

The compounds represented by formulae (I) to (IV) are now described in greater detail.

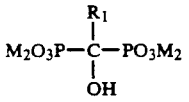

(I)

wherein the groups represented by M may be the same or different, each represents hydrogen, an alkali metal or an ammonium group, and they are preferably hydrogen or sodium atoms; $R_1$ represents a lower alkyl group (preferably having 1 to 4 carbon atoms), and preferably a methyl group or an ethyl group.

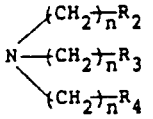

(II)

wherein n is an integer of 1 to 3; and $R_2$, $R_3$ and $R_4$, which may be the same or different, each represents a —COOM group, a $—PO_3M_2$ group or a hydroxyl group, where M represents hydrogen, an alkali metal or ammonium, provided that at most one of the groups represented by $R_2$, $R_3$ and $R_4$ represents a hydroxyl group, M preferably represents hydrogen or a sodium atom.

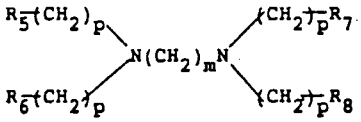

(III)

wherein $R_5$, $R_6$, $R_7$ and $R_8$, which may be the same or different, each represents a —COOM group, a $—PO_3M_2$ group or a hydroxyl group; m is an integer of 1 to 4; and p is 1 or 2; M represents hydrogen, an alkali metal atom or an ammonium group, and preferably hydrogen or a sodium atom; provided that at most two of the groups represented by $R_5$, $R_6$, $R_7$ and $R_8$ represents a hydroxyl group.

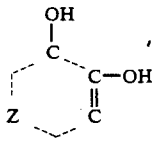

(IV)

wherein Z represents an atomic group necessary for forming an aromatic nucleus.

The aromatic polyhydroxy compounds represented by formula (IV) are preferably compounds which have at least two hydroxyl groups at ortho positions to one another on the aromatic ring. Furthermore, the preferred polyhydroxy compounds are compounds which have at least two hydroxyl groups at ortho positions to one another on the aromatic ring and have no unsaturation other than that of the ring. Compounds in which the aromatic ring is a benzene ring or a naphthalene ring are included among the wide range of aromatic polyhydroxy compounds of the present invention.

The aromatic polyhydroxy compounds represented by formula (IV) may be substituted with other groups or atoms, for example, sulfo groups, carboxyl groups and halogen atoms, in addition to the hydroxyl groups.

Specific examples of compounds represented by formulae (I) to (IV) are indicated below, but the present invention is not to be construed as being limited to these examples.

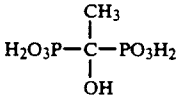

(I-1)

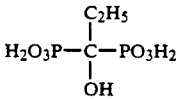

(I-2)

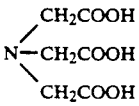

(II-1)

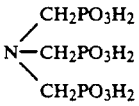

(II-2)

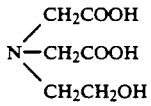

(II-3)

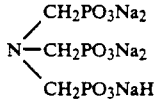

(II-4)

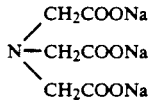

(II-5)

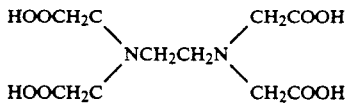

(III-1)

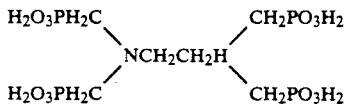

(III-2)

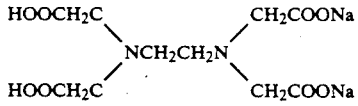

(III-3)

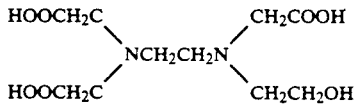

(III-4)

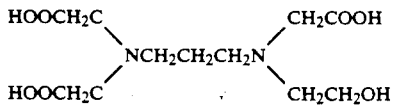

(III-5)

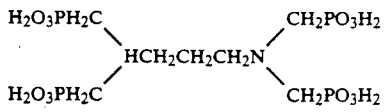

(III-6)

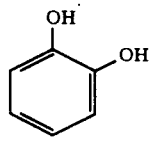

(IV-1)

-continued (IV-2)

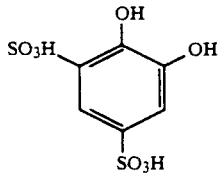

(IV-3)

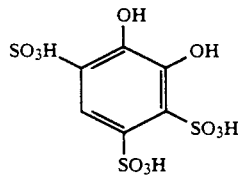

(IV-4)

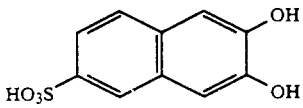

(IV-5)

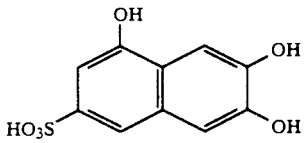

The compounds represented by formulae (I), (II) or (III) of the present invention are added to the color developing bath at a rate within the range from 0.001 to 0.1 mol/liter, preferably at a rate within the range from 0.002 to 0.05 mol/liter, and most preferably at a rate within the range from 0.005 to 0.02 mol/liter.

The compounds represented by formula (IV) of the present invention are added to the color developing bath at a rate within the range from 0.00005 to 0.1 mol/liter, and preferably at a rate within the range from 0.0002 to 0.004 mol/liter.

The above-mentioned compounds are effective when used individually, but it is preferred to use two or more types conjointly. The effect of such combined use is especially pronounced when at least one compound represented by formula (I) is used conjointly with at least one compound represented by formulae (II) to (IV). The particularly preferred combined use is a compound represented by formula (I) and a compound represented by formulae (II) or (III).

In the present invention, the above-described compounds have the effect of masking calcium and magnesium in the water, but it is preferred that the calcium and magnesium levels should be as low as possible. In practical terms, it is desirable that the color developing baths should be prepared using water which has been subjected to a deionizing treatment with an ion exchange resin, for example.

The known primary aromatic amine color developing agents are included in the color developing baths which are used in the present invention. The use of p-phenylenediamine derivatives is preferred, and typical examples are indicated below, but the present invention is not to be construed as being limited to these examples.

D- 1: N,N-Diethyl-p-phenylenediamine
D- 2: 2-Amino-5-diethylaminotoluene
D- 3: 2-Amino-5-(N-ethyl-N-laurylamino)toluene
D- 4: 4-[N-Ethyl-N-(β-hydroxyethyl)amino]aniline
D- 5: 2-Methyl-4-[N-ethyl-N-(β-hydroxyethyl-)amino]aniline
D- 6: 4-Amino-3-methyl-N-ethyl-N-[β-(methanesulfonamido) ethyl]aniline
D- 7: N-(2-Amino-5-diethylaminophenylethyl)methanesulfonamide
D- 8: N,N-Diethyl-p-phenylenediamine
D- 9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline The use of 4-amino-3-methyl-N-ethyl-N-[β-(methanesulfonamido) ethyl]aniline (Compound D-6) among the above p-phenylenediamine derivatives is preferred.

Furthermore, these p-phenylenediamine derivatives may take the form of salts, such as sulfates, hydrochlorides, sulfites or p-toluenesulfonates, for example. The primary aromatic amine developing agents are used preferably in a concentration of from about 0.1 g to about 20 g, and more preferably of from about 0.5 g to about 10 g, per liter of developing bath.

The metal used in the supports of color photosensitive materials of the present invention is liable to be dissolved out from the edges during color developing processing, and the use of a color developing bath which suppresses any change in sensitivity and gradation during continuous processing, which reduces the coloration of the color developing bath and which prevents the occurrence of edge staining and staining is desirable. The use of compounds represented by formulae (V) and (VI), either individually or in combination, as preservatives is preferred for this purpose.

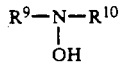

(V)

wherein $R^9$ and $R^{10}$, which may be the same or different, each represents hydrogen, an alkyl group, an alkenyl group or an aryl group.

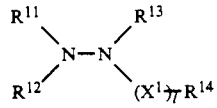

(VI)

wherein $R^{11}$, $R^{12}$ and $R^{13}$, which may be the same or different, each individually represents hydrogen, an alkyl group, an aryl group or a heterocyclic group; $R^{14}$ represents hydrogen, a hydroxyl group, a hydrazino group, an alkyl group, an aryl group, a heterocyclic group, an alkoxy group, an aryloxy group, a carbamoyl group or an amino group; $X^1$ represents a divalent group and l is 0 or 1. However, when l is 0, $R^{14}$ represents an alkyl group, an aryl group or a heterocyclic group. $R^{13}$ and $R^{14}$ may be joined together to form a heterocyclic ring.

The compounds represented by formula (V) are described in greater detail below.

In formula (V), $R^9$ and $R^{10}$ each individually represents hydrogen, an unsubstituted or substituted alkyl group, an unsubstituted or substituted alkenyl group or an unsubstituted or substituted aryl group.

$R^9$ and $R^{10}$ are preferably alkyl groups or alkenyl groups, and it is preferred that at least one has a substituent group. Furthermore, $R^9$ and $R^{10}$ may be joined together and form, together with the nitrogen atom, a heterocyclic ring.

The alkyl groups and alkenyl groups may be linear chain, branched chain or cyclic groups, and the substituents of these groups include halogen atoms (for example, F, Cl, Br), aryl groups (for example, phenyl, p-chlorophenyl), alkoxy groups (for example, methoxy, ethoxy, methoxyethoxy), aryloxy groups (for example, phenoxy), sulfonyl groups (for example, methanesulfonyl, p-toluenesulfonyl), sulfonamide groups (for example, methanesulfonamide, benzenesulfonamide), sulfamoyl groups (for example, diethylsulfamoyl, unsubstituted sulfamoyl), carbamoyl groups (for example, unsubstituted carbamoyl, diethylcarbamoyl), amide groups (for example, acetamide, benzamide), ureido groups (for example, methylureido, phenylureido), alkoxycarbonylamino groups (for example, methoxycarbonylamino), aryloxycarbonylamino groups (for example, phenoxycarbonylamino), alkoxycarbonyl groups (for example, methoxycarbonyl), aryloxycarbonyl groups (for example, phenoxycarbonyl), cyano groups, hydroxyl groups, carboxyl groups, sulfo groups, nitro groups, amino groups (for example, unsubstituted amino, diethylamino), alkylthio groups (for example, methylthio), arylthio groups (for example, phenylthio), and heterocyclic groups (for example, morpholyl, pyridyl). $R^9$ and $R^{10}$ may be the same or different, and the substituent groups of $R^9$ and $R^{10}$ may also be the same or different.

Furthermore, the number of carbon atoms in $R^9$ and $R^{10}$ is preferably from 1 to 10, and most preferably from 1 to 5. Nitrogen-containing heterocyclic rings which can be formed when $R^9$ and $R^{10}$ are joined together include, for example, piperidyl, pyrrolidinyl, N-alkylpiperazyl, morpholinyl, indolinyl and benzotriazolyl groups.

The preferred substituent groups for $R^9$ and $R^{10}$ are hydroxyl groups, alkoxy groups, sulfonyl groups, amide groups, carboxyl groups, cyano groups, sulfo groups, nitro groups and amino groups.

Specific examples of compounds represented by formula (V) which can be used in the present invention are indicated below, but the scope of the present invention is not to be construed as being limited to these compounds.

$NH_2OH$ (V-1)

$CH_3CH_2-N(OH)-CH_2CH_3$ (V-2)

$CH_3-N(OH)-C_2H_4OC_2H_5$ (V-3)

$(n)C_4H_9-N(OH)-C_2H_4OCH_3$ (V-4)

$CH_3OC_2H_4-N(OH)-C_2H_4OCH_3$ (V-5)

$C_2H_5OC_2H_4-N(OH)-C_2H_4OC_2H_5$ (V-6)

-continued $CH_3OC_2H_4OC_2H_4-N(OH)-C_2H_4OC_2H_4OCH_3$ (V-7)

$C_2H_5OC_2H_4-N(OH)-C_2H_5$ (V-8)

$C_2H_5OC_2H_4-N(OH)-CH_2-CH=CH_2$ (V-9)

$CH_3-N(OH)-C_2H_4N(CH_3)_2$ (V-10)

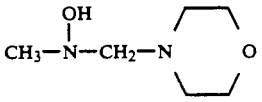
(V-11)

$CH_3-N(OH)-C_2H_4CONH_2$ (V-12)

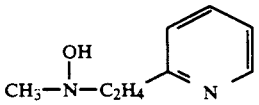
(V-13)

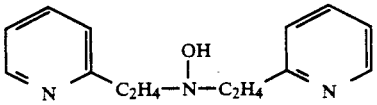
(V-14)

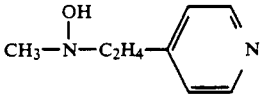
(V-15)

$CH_3-N(OH)-C_2H_4SO_2C_2H_5$ (V-16)

$C_2H_5SO_2C_2H_4-N(OH)-C_2H_4SO_2C_2H_5$ (V-17)

$[CH_3-N(OH)-C_2H_4]_2SO_2$ (V-18)

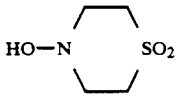
(V-19)

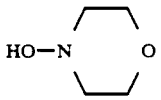
(V-20)

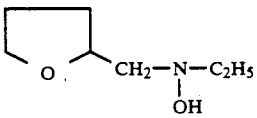
(V-21)

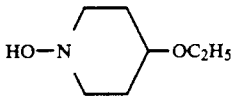
(V-22)

-continued

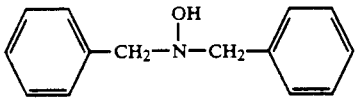
(V-23)

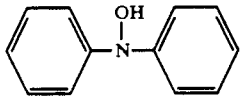
(V-24)

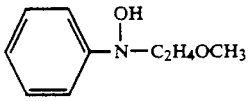
(V-25)

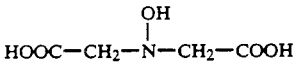
(V-26)

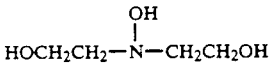
(V-27)

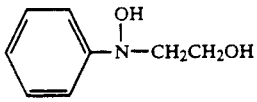
(V-28)

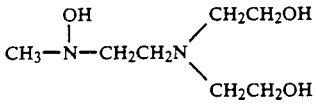
(V-29)

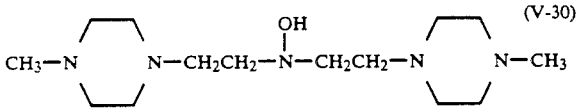
(V-30)

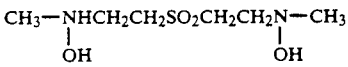
(V-31)

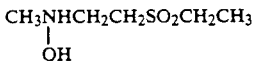
(V-32)

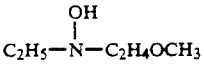
(V-33)

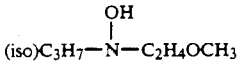
(V-34)

Compounds represented by formula (V) can be prepared using the known methods disclosed in U.S. Pat. Nos. 3,661,996, 3,362,961 and 3,293,034, JP-B-42-2794, and U.S. Pat. Nos. 3,491,151, 3,655,764, 3,467,711, 3,455,916, 3,287,125 and 3,287,124 (the term "JP-B" as used herein refers to an "examined Japanese patent publication").

These compounds may take the form of salts of various acids, such as hydrochloric acid, sulfuric acid, nitric acid, phosphoric acid, oxalic acid and acetic acid, for example.

The amounts of the compounds represented by formula (V) added to the color developing bath are from 0.5 to 50 mmol, preferably from 1 to 25 mmol, and most preferably from 1 to 10 mmol, per liter of color developing bath.

The compounds represented by formula (VI) which can be used in the present invention, hydrazine analogues including hydrazines and hydrazides, are described in detail below.

$R^{11}$, $R^{12}$ and $R^{13}$ each independently represents hydrogen, a substituted or unsubstituted alkyl group (which preferably has from 1 to 20 carbon atoms, for example, methyl, ethyl, sulfopropyl, carboxybutyl, hydroxyethyl, cyclohexyl, benzyl, phenethyl), a substituted or unsubstituted aryl group (which preferably has from 6 to 20 carbon atoms, for example, phenyl, 2,5-dimethoxyphenyl, 4-hydroxyphenyl, 2-carboxyphenyl), or a substituted or unsubstituted heterocyclic group (which preferably has from 1 to 20 carbon atoms, and which preferably has a 5- or 6-membered ring with at least one oxygen, nitrogen or sulfur atom as a hetero atom, for example, pyridine-4-yl, N-acetylpiperidine-4-yl).

$R^{14}$ represents hydrogen, a hydroxyl group, a substituted or unsubstituted hydrazino group (for example, hydrazino, methylhydrazino, phenylhydrazino), a substituted or unsubstituted alkyl group (which preferably has from 1 to 20 carbon atoms, for example, methyl, ethyl, sulfopropyl, carboxybutyl, hydroxyethyl, cyclohexyl, benzyl, tert-butyl, n-octyl), a substituted or unsubstituted aryl group (which preferably has from 6 to 20 carbon atoms, for example, phenyl, 2,5-dimethoxyphenyl, 4-hydroxyphenyl, 2-carboxyphenyl, 2-carboxyphenyl, 4-sulfophenyl), a substituted or unsubstituted heterocyclic group (which preferably has from 1 to 20 carbon atoms, and which preferably has a 5- or 6-membered ring with at least one oxygen atom, nitrogen atom or sulfur atom as a hetero atom, for example, pyridine-4-yl, imidazolyl), a substituted or unsubstituted alkoxy group (which preferably has from 1 to 20 carbon atoms, for example, methoxy, ethoxy, methoxyethoxy, benzyloxy, cyclohexyloxy, octyloxy), a substituted or unsubstituted aryloxy group (which preferably has from 6 to 20 carbon atoms, for example, phenoxy, p-methoxyphenoxy, p-carboxyphenyl, p-sulfophenoxy), a substituted or unsubstituted carbamoyl group (which preferably has from 1 to 20 carbon atoms, for example, unsubstituted carbamoyl, N,N-diethylcarbamoyl, phenylcarbamoyl), or a substituted or unsubstituted amino group (which preferably has from 0 to 20 carbon atoms, for example, amino, hydroxyamino, methylamino, hexylamino, methoxyethylamino, carboxyethylamino, sulfoethylamino, N-phenylamino, p-sulfophenylamino).

$R^{11}$, $R^{12}$, $R^{13}$ and $R^{14}$ may be further substituted, preferably with halogen atoms (for example, chlorine, bromine), hydroxyl groups, carboxyl groups, sulfo groups, amino groups, alkoxy groups, amide groups, sulfonamide groups, carbamoyl groups, sulfamoyl groups, alkyl groups, aryl groups, aryloxy groups, alkylthio groups, arylthio groups, nitro groups, cyano groups, sulfonyl groups and sulfinyl groups, for example, and these may be further substituted.

$X^1$ is preferably a divalent organic group, and includes, for example, a —CO— group, an $—SO_2—$ group and a

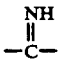

group. Moreover, l represents 0 or 1, but when l is 0, $R^{14}$ represents a group selected from substituted or unsubstituted alkyl groups, aryl groups and heterocyclic groups. $R^{11}$, $R^{12}$ and $R^{14}$ may be joined together to form a heterocyclic ring. In those cases where l is 0, it is preferred that at least one of $R^{11}$ and $R^{14}$ should be a substituted or unsubstituted alkyl group. Those cases in which $R^{11}$, $R^{12}$, $R^{13}$ and $R^{14}$ are hydrogen or substituted or unsubstituted alkyl groups are especially preferred (but $R^{11}$, $R^{12}$, $R^{13}$ and $R^{14}$ cannot all be hydrogen). Those cases in which $R^{11}$, $R^{12}$ and $R^{13}$ are hydrogen and $R^{14}$ is a substituted or unsubstituted alkyl group, those cases in which $R^{11}$ and $R^{13}$ are hydrogen and $R^{12}$ and $R^{14}$ are substituted or unsubstituted alkyl groups, and those cases in which and $R^{11}$ and $R^{12}$ are hydrogen and $R^{13}$ and $R^{14}$ are substituted or unsubstituted alkyl groups (where $R^{13}$ and $R^{14}$ may be joined to form a heterocyclic ring) are the most preferred.

In those cases where l is 1, $X^1$ is preferably a —CO— group, $R^{14}$ is preferably a substituted or unsubstituted amino group and $R^{11}$ to $R^{13}$ are preferably substituted or unsubstituted alkyl groups.

Those compounds in which l is 0 are preferred.

Alkyl groups which have from 1 to 10 carbon atoms are preferred for the alkyl groups represented by $R^{11}$ to $R^{14}$, and alkyl groups which have from 1 to 7 carbon atoms are the most preferred. Furthermore, hydroxyl groups, carboxyl groups, sulfonic acid groups and phosphonic acid groups are the preferred substituents for the alkyl groups. In those cases where there are two or more substituent groups, these may be the same or different.

The compounds represented by formula (VI) may also take the form of dimers, trimers or polymers which are linked via $R^{11}$, $R^{12}$, $R^{13}$ or $R^{14}$.

Specific examples of compounds represented by formula (VI) are indicated below, but the present invention is not to be construed as being limited to these examples.

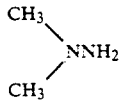
(VI-1)

$CH_3NHNHCH_3$ (VI-2)

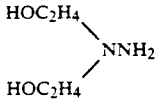
(VI-3)

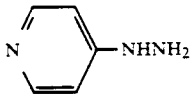
(VI-4)

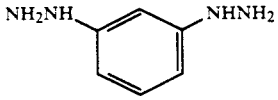
(VI-5)

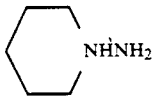
(VI-6)

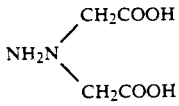
(VI-7)

$HOOCCH_2NHNHCH_2COOH$ (VI-8)

$NH_2NH(CH_2)_3NHNH_2$ (VI-9)

$NH_2NHCH_2CH_2OH$ (VI-10)

-continued

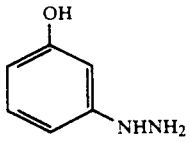
(VI-11)

$NH_2NH—(CH_2)_3—SO_3H$ (VI-12)

$NH_2NH—(CH_2)_4—SO_3H$ (VI-13)

$NH_2NH—(CH_2)_3—COOH$ (VI-14)

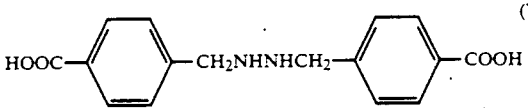
(VI-15)

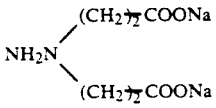
(VI-16)

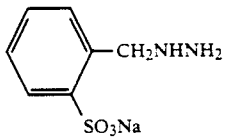
(VI-17)

$NaOOCCH(CH_3)NHNHCH(CH_3)COONa$ (VI-18)

$NH_2NHCH_2CH_2COONa$ (VI-19)

$NH_2NHCH_2COONa$ (VI-20)

$H_2NNHCH_2CH_2SO_3Na$ (VI-21)

$H_2NNHCH(C_4H_9(n))COOH$ (VI-22)

$H_2NNHCH(C_6H_{13}(n))COOH$ (VI-23)

$H_2NN(CH(C_4H_9(n))COOH)_2$ (VI-24)

$H_2NN(CH_2CH_2SO_3Na)_2$ (VI-25)

$H_2NN(CH_2CH_2CH_2SO_3Na)_2$ (VI-26)

$H_2NN(CH(C_2H_5)COOH)_2$ (VI-27)

$H_2NNHCH(CH_3)COOH$ (VI-28)

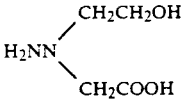
(VI-29)

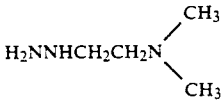
(VI-30)

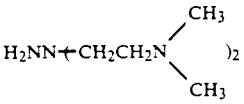
(VI-31)

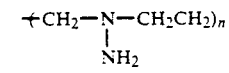
(VI-32)

-continued

Average molecular weight: about 4,000

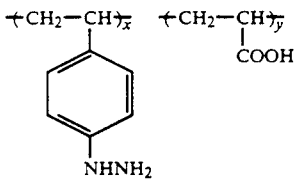

(VI-33)

x/y = 60/40

Average molecular weight: about 20,000

$NH_2NHCONH_2$ (VI-34)

$NH_2NHC(=NH)NH_2$ (VI-35)

$NH_2NHCONHNH_2$ (VI-36)

$NH_2NHSO_3H$ (VI-37)

$NH_2NHSO_2NHNH_2$ (VI-38)

$CH_3NHNHSO_2NHNHCH_3$ (VI-39)

$NH_2NHCONH-(CH_2)_3-NHCONHNH_2$ (VI-40)

(VI-41)

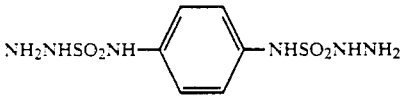

$NH_2NHCOCONHNH_2$ (VI-42)

(VI-43)

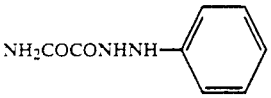

(VI-44)

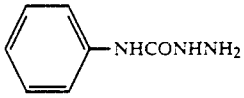

(VI-45)

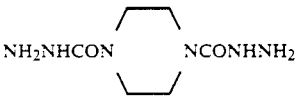

$NH_2COCONHNH_2$ (VI-46)

(VI-47)

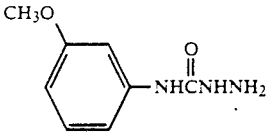

(VI-48)

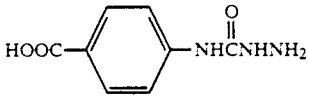

(VI-49)

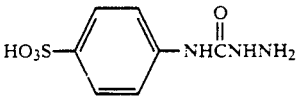

(VI-50)

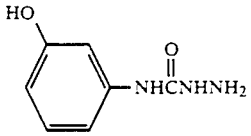

-continued (VI-51)

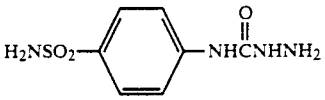

(VI-52)

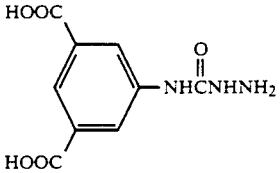

(VI-53)

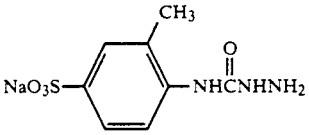

(VI-54)

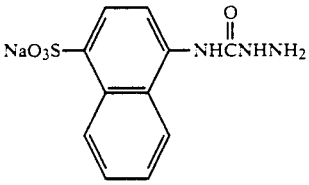

(VI-55)

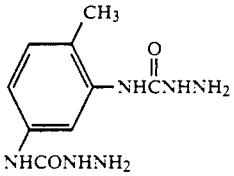

(VI-56)

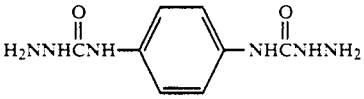

(VI-57)

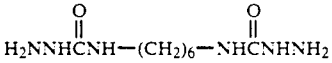

(VI-58)

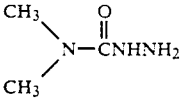

(VI-59)

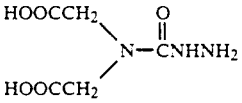

(VI-60)

$NaO_3SCH_2CH_2NHC(=O)NHNH_2$ (VI-61)

$HOOCCH_2CH_2NHC(=O)NHNH_2$ (VI-62)

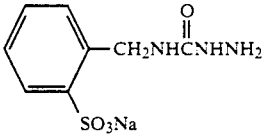

$NH_2NHCOOC_2H_5$ (VI-63)

$NH_2NHCOCH_3$ (VI-64)

-continued (VI-65)

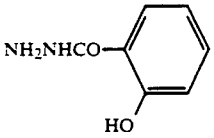

(VI-66)

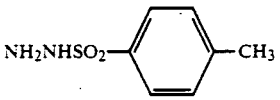

$NH_2NHCH_2PO_3H_2$ (VI-67)

(VI-68)

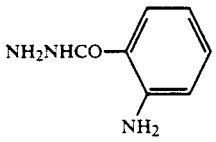

(VI-69)

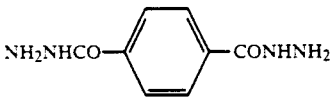

(VI-70)

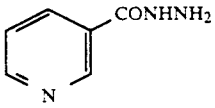

(VI-71)

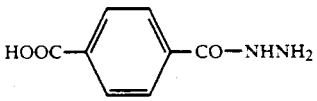

(VI-72)

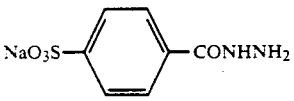

$(CH_3)_3CCONHNH_2$ (VI-73)

$(CH_3)_3CC(=O)NHNH_2$ (VI-74)

(VI-75)

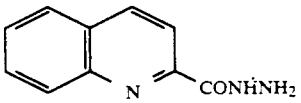

(VI-76)

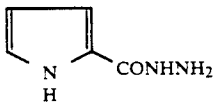

(VI-77)

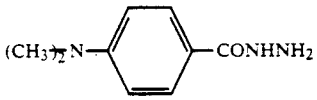

(VI-78)

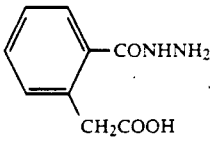

-continued (VI-79)

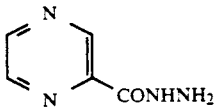

$HOCH_2CH_2SO_2NHNH_2$ (VI-80)

$NaO_3SCH_2CH_2CONHNH_2$ (VI-81)

$H_2NCONHCH_2CH_2SO_2NHNH_2$ (VI-82)

(VI-83)

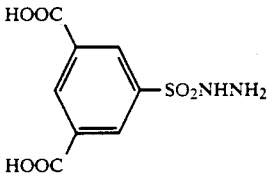

(VI-84)

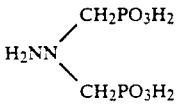

$H_2NNHCH_2CH_2PO_3H_2$ (VI-85)

(VI-86)

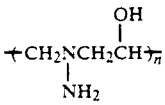

Average molecular weight: about 3,000

The compounds disclosed in European Patent 254280A, on pages 12 to 22 of the specification of Japanese Patent Application No. 61-171682, and pages 9 to 19 of the specification of Japanese Patent Application No. 61-173468 are also specific examples of compounds of formula (VI) in addition to those indicated above.

The use of Compounds (VI-7), (VI-12), (VI-22), (VI-25), (VI-28), (VI-44), (VI-49), (VI-58) and (VI-60) is especially preferred.

Many of the compounds represented by formula (VI) are available as commercial products, and they can also be prepared by the general methods of preparation described, for example, in *Organic Syntheses*, Vol. 2, pp. 208–213; *J. Am. Chem. Soc.*, 36, 1747 (1914); *Yukagaku*, 24, 31 (1975); *J. Org. Chem.*, 25, 44 (1960), *Yakugaku Zasshi*, 91 1127 (1971), *Organic Syntheses*, Coll. Vol. 1, p. 450, *Shinjikken Kagaku Koza*, Vol. 14, III, pp. 1621 to 1628 (Maruzen); *Beil.*, 2, 559; *Beil.*, 3, 117; E. B. Mohr et al., *Inorgan. Syn.*, 4, 32 (1953); F. J. Wilson and E. C. Pickering, *J. Chem. Soc.*, 123, 394 (1932); N. J. Leonard, J. H. Boyer, *J. Org. Chem.*, 15, 42 (1950); *Organic Syntheses*, Coll. Vol. 5, p. 1055; P. A. S. Smith, *Derivatives of Hydrazine and Other Hydro-nitrogens Having N—N Bonds*, pp. 120–124, 130–131 (Benjamin/Cummings Co., 1983); and Stanley R. Sandier, Waif Karo, *Organic Functional Group Preparations*, Vol. 1 (Second Edition, p. 457).

The rate of addition of the compounds represented by formula (VI) to the color developing bath is from 1 to 500 mmol, and preferably from 10 to 200 mmol, per liter of color developing bath.

At least one type of compound represented by formula (V) is preferably used in combination with at least one type of compound represented by formula (VI), and most preferably the amount, in mols, of the former is smaller than the amount, in mols, of the latter.

The relationship between the contents of the two compounds is such that the mol ratio of the compound of formula (VI) and the compound of formula (V) is preferably within the range from 1.1/1 to 50/1, and more preferably within the range from 2/1 to 20/1.

The reason for this is not clear, but without being bound in any way by theory, it is considered likely that the two types of compounds which have an effect on photographic characteristics (compounds represented by formula (V) and compounds represented by formula (VI)) function such that in the presence of hydroxylamines, the deterioration of hydrazines is prevented, so that there is no variation in the photographic properties caused by the deterioration of the hydrazines. In cases where the hydroxylamine content is less than the hydrazine content in particular, the deterioration of the hydroxylamines themselves is also prevented, with the result that the variation in photographic characteristics is markedly reduced.

It is considered that the two preservatives which result in changes in various photographic characteristics when used individually retain a preserving ability for the color developing bath in accordance with the total amount which is present, and that when used conjointly the preserving properties of the color developer are retained on the basis of the total content of both materials, markedly suppressing the variation in photographic characteristics.

The variation in photographic characteristics due to the aging and deterioration of the compounds represented by formulae (V) or (VI) is suppressed by the combined use of a compound represented by formula (VII) indicated below in the color developing bath which is used in the present invention, and this is also preferred in that it improves the stability of the compounds represented by formulae (V) or (VI).

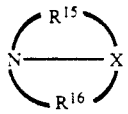

(VII)

wherein X represents a trivalent group of atoms which is required to complete the condensed rings; and $R^{15}$ and $R^{16}$, which may be the same or different, each represents an alkylene group, an arylene group, an alkynylene group or an aralkylene group.

The condensed cyclic amines represented by formula (VII) are described in greater detail below.

Those cases in which the number of carbon atoms in X in formula (VII) is not more than 20 are preferred, those cases in which the number of carbon atoms is not more than 10 are more preferred, and those cases in which the number of carbon atoms is not more than 6 are most preferred. X may also contain atoms such as nitrogen, oxygen and sulfur, for example.

Those cases in which the number of carbon atoms in $R^{15}$ and $R^{16}$ in formula (VII) is not more than 10 are preferred, those cases in which the number of carbon atoms is not more than 6 are more preferred, and those cases in which the number of carbon atoms is not more than 3 are most preferred. Those cases in which $R^{15}$ and $R^{16}$ are alkylene groups or arylene groups are preferred, and those cases in which $R^{15}$ and $R^{16}$ are alkylene groups are most preferred.

The compounds represented by formula (VII) may take the form of dimers or trimers which are linked via X.

Some specific examples of X in formula (VII) are indicated below, but the present invention is not to be construed as being limited thereto.

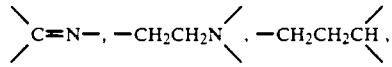

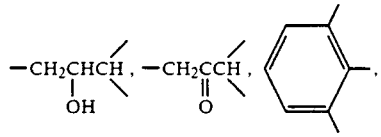

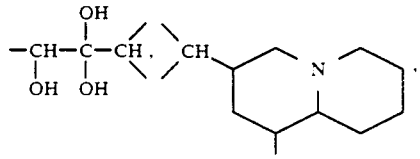

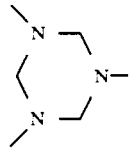

Specific examples of $R^{15}$ and $R^{16}$ in formula (VII) include methylene, ethylene, propylene, butylene, pentylene, 1,2-cyclohexylene, 1-methylethylene, 1,2-dimethylethylene, 1-carboxyethylene, 1,2-phenylene, 1,2-vinylene and 1,3-propenylene; and these groups may be further substituted with, for example, alkyl groups, halogen atoms, carboxyl groups, sulfo groups, hydroxyl groups, alkoxy groups, alkylthio groups, amino groups, amide groups, acyl groups, carbamoyl groups, sulfamoyl groups and heterocyclic groups.

Those compounds represented by formula (VII) which are represented by formulae (VII-a) and (VII-b) are especially preferred.

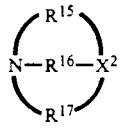

(VII-a)

wherein $X^2$ represents

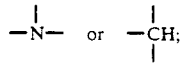

$R^{15}$ and $R^{16}$ have the same meaning as $R^{15}$ and $R^{16}$ in formula (VII); and $R^{17}$ represents a group which has the same definition as $R^{15}$ and $R^{16}$, or is a

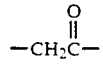

group.

The cases in which $X^2$ in formula (VII-a) is an

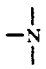

group are preferred. Those cases in which $R^{15}$, $R^{16}$ and $R^{17}$ are alkylene groups or arylene groups are preferred, and the case in which they are alkylene groups is most preferred. Those cases in which the number of carbon atoms in each of $R^{15}$, $R^{16}$ and $R^{17}$ is not more than 6 are preferred, those cases in which the number of carbon atoms is not more than 3 are more preferred and the case in which the number of carbon atoms is 2 is most preferred.

(VII-b)

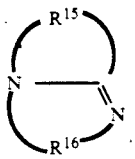

wherein $R^{15}$ and $R^{16}$ have the same definition as in formula (VII-a).

Among compounds represented by formulae (VII-a) and (VII-b), those represented by formula (VII-a) are preferred.

Specific examples of compounds represented by formula (VII) of the present invention are indicated below, but the present invention is not to be construed as being limited to these examples.

(VII-1)

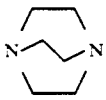

(DABCO)

(VII-2)

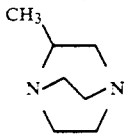

(VII-3)

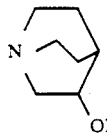

(VII-4)

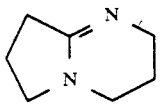

(DBN)

(VII-5)

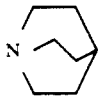

(VII-6)

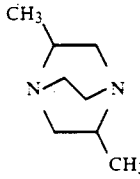

-continued (VII-7)

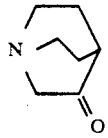

(VII-8)

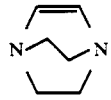

(VII-9)

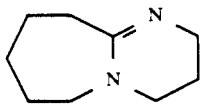

(DBU)

The compounds represented by formula (VII) of the present invention are available as commercial products.

The amount of the compounds represented by formula (VII) added is preferably within the range of from 0.01 to 100 g, and most preferably within the range of from 0.1 to 20 g, per liter of color developing bath.

Furthermore, the effect of the above-mentioned compounds represented by formula (VII) is remarkably obtained when the most preferred amount of a compound represented by formula (V) is added.

The compound represented by formula (VII) is preferably used in a molar ratio of from 3/1 to 1/5 of the compound represented by formula (VI).

Optional developing accelerators can be added as required to the color developing baths. However, the color developing baths of the present invention are preferably substantially benzyl alcohol-free from the viewpoints of pollution, bath preparation and the prevention of fogging. Here, the term "substantially benzyl alcohol-free" signifies that the benzyl alcohol content is not more than 2 ml per liter of color developing bath. The complete absence of benzyl alcohol is preferred.

Furthermore, salts of sulfurous acid, such as sodium sulfite, potassium sulfite, sodium bisulfite, potassium sulfite, sodium metabisulfite and potassium metabisulfite, can also be added, if desired, as preservatives. The amount added to the color developing bath is not more than 1.0 g/liter, preferably not more than 0.5 g/liter, and most preferably they are present in a trace amount if the preservation properties of the color developing bath is maintained. The addition of only a small amount of sulfite ion is preferred in color developing baths in which there is no benzyl alcohol.

The hydroxyacetones disclosed in U.S. Pat. No. 3,615,503 and British Patent 1,306,176, the α-aminocarbonyl compounds disclosed in JP-A-52-143020 and JP-A-53-89425, the various metals disclosed in JP-A-57-44148 and JP-A-57-53749, the various sugars disclosed in JP-A-52-102727, the various hydroxamic acids disclosed in JP-A-52-27638, the α,α'-dicarbonyl compounds disclosed in JP-A-59-160141, the salicylic acids disclosed in JP-A-59-180588, the alkanolamines disclosed in JP-A-54-3532, the poly(alkyleneimine) compounds disclosed in JP-A-56-94349, and the gluconic acid derivatives disclosed in JP-A-56-75647, for example, can also be used as preservatives.

The alkanolamines (for example, triethanolamine, diethanolamine, 1,3-bis(2-hydroxyethylmethylamino)-2-propanol and 1,3-dimorpholino-2-propanol), and condensed ring amines represented by formula (VII) (especially numbers (VII-1), (VII-2), (VII-3), (VII-5), (VII-6), (VII-7) and (VII-8) disclosed above) are most preferably used in combination with compounds of formula (V) for increasing the preservation potential and suppressing variations in photographic properties. Moreover, the use of aromatic polyhydroxy compounds and the compounds disclosed in European Patent 266797 is most preferred for the same reasons, and four or more of the preservatives indicated above can be used conjointly, if desired.

The color developing bath used in the present invention preferably has a pH within the range of from 9 to 12, and most preferably at a pH within the range of from 9 to 11.0, and other known color developing bath components are included in the color developing bath.

The use of various buffering agents is preferred for maintaining the above-mentioned pH level.

Carbonates, phosphates, borates, tetraborates, hydroxybenzoates, glycine salts, N,N-dimethylglycine salts, leucine salts, norleucine salts, guanine salts, 3,4-hydroxyphenylalanine salts, alanine salts, aminobutyric acid salts, 2-amino-2-ethyl-1,3-propanediol salts, valine salts, proline salts, trishydroxyaminomethane salts and lysine salts, for example, can be used as buffering agents. Carbonates, phosphates, tetraborates and hydroxybenzoates have excellent solubility and buffering ability in the high pH region (pH 9 or more), and when added to a color developing bath, they have no adverse effect on photographic performance (such as fogging, for example). They are also advantageous in terms of cost, and the use of these buffering agents is especially preferred.

Specific examples of these buffering agents include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the present invention is not to be construed as being limited thereto.

The amount of the buffering agent added to the color developing bath is preferably at least 0.1 mol/ liter and most preferably from 0.1 to 0.4 mol/liter.

Various chelating agents may also be used in the color developing bath within a range that does not impair the effect of the present invention, in order to suppress the precipitation of calcium and magnesium or to improve the stability of the color developing bath. The chelating agents which are used are preferably organic compounds, and examples of such compounds include the aminopolycarboxylic acids disclosed in JP-B-48-30496 and JP-B-44-30232, the organic phosphonic acids disclosed in JP-A-56-97347, JP-B-56-39359 and West German Patent 2,227,639, the phosphonocarboxylic acids disclosed, for example, in JP-A-52-102726, JP-A-53-42730, JP-A-54-121127, JP-A-55-126241 and JP-A-55-65956, and the other compounds disclosed, for example, in JP-A-58-195845, JP-A-58-203440 and JP-B-53-40900. Specific examples are indicated below, but the chelating agents are not limited by these examples.

Ethylenediamine-N,N,N',N'-tetramethylenephosphonic acid, N,N,N-trimethylenephosphonic acid, 1-hydroxyethylidene-1,1-diphosphonic acid, nitrilotriacetic acid, diethylenetriaminepentaacetic acid, ethylenediaminetetraacetic acid, triethylenetetraminehexaacetic acid, 1,3-diamino-2-propanoltetraacetic acid, transcyclohexanediaminetetraacetic acid, nitrilotripropionic acid, 1,2-diaminopropanetetraacetic acid, hydroxyethylaminodiacetic acid, glycol ether diaminetetraacetic acid, hydroxyethylenediaminetriacetic acid, ethylenediamine-o-hydroxyphenylacetic acid, 2-phosphonobutane-1,2,4-tricarboxylic acid and N,N'-bis(2-hydroxybenzyl)ethylenediamine-N,N'-diacetic acid.

Two or more of these chelating agents can be used together, if desired.

The amount of these chelating agents which is added should be sufficient to block the calcium and magnesium ions in the color developing bath. For example, the chelating agents can be included in the developing bath at concentrations of from about 0.1 to about 10 g/liter.

Optional developing accelerators can be added, if desired, to the color developing bath. For example, the thioether based compounds disclosed in JP-B-37-16088, JP-B-37-5987, JP-B-38-7826, JP-B-44-12380, JP-B-45-9019 and U.S. Pat. No. 3,813,247, the p-phenylenediamine based compounds disclosed in JP-A-52-49829 and JP-A-50-15554, the quaternary ammonium salts disclosed, for example, in JP-A-50-137726, JP-B-44-30074, JP-A-56-156826 and JP-A-52-43429, the p-aminophenols disclosed in U.S. Pat. Nos. 2,610,122 and 4,119,462, the amine based compounds disclosed, for example, in U.S. Pat. Nos. 2,494,930, 3,128,182, 4,230,796 and 3,253,919, JP-B-41-11431, and U.S. Pat. Nos. 2,482,546, 2,596,926 and 3,582,346, the poly(alkylene oxides) disclosed in JP-B-37-16088, JP-B-42-25201, U.S. Pat. No. 3,128,183, JP-B-41-11431, JP-B-42-23883, and U.S. Pat. No. 3,532,501, and 1-phenyl-3-pyrazolidones, mesoionic compounds, ionic compounds and imidazoles can be added as developing accelerators, if desired.

Optional antifoggants can be added, if desired, to the color developing baths used in the present invention. Thus, nitrogen-containing heterocyclic compounds, such as benzotriazole, 6-nitrobenzotriazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, hydroxyazaindolidine, 5-nitroindazole and mercaptotriazoles, are used as typical organic antifoggants.

The inclusion of fluorescent brighteners in the color developing baths used in the present invention is preferred. The 4,4'-diamino-2,2'-disulfostilbene based compounds are the preferred fluorescent brighteners. The amount added is from 0 to 5 g/liter and preferably from 0.1 to 4 g/liter.

Furthermore, various surfactants, such as alkylsulfonic acids, arylsulfonic acids, aliphatic carboxylic acids and aromatic carboxylic acids, for example, can also be added, if desired.

The processing temperature in a color developing bath of the present invention is within the range of from 20° C. to 50° C. and preferably within the range of from 30° C. to 40° C. The processing time is within the range of from 20 seconds to 5 minutes and preferably within the range of from 30 seconds to 2 minutes. A low replenishment rate (i.e., amount of replenisher) is preferred, and replenishment rates of generally from 20 ml to 600 ml and preferably of from 50 ml to 200 ml per square meter of photosensitive material are used.

Bleaching Baths, Bleach-Fixing Baths and Fixing Baths

The photographic emulsion layer is usually subjected to bleaching and fixing processes after color development. The bleaching and fixing processes may be carried out at the same time (in a bleach-fixing process) or they may be carried out as separate processes. Moreover, a bleach-fixing process can be carried out after a bleaching process in order to speed up processing. Moreover, a bleach-fixing process can be carried out in two connected bleach-fixing baths, a fixing process can be carried out before a bleach-fixing process or a bleaching process can be carried out after a bleach-fixing process, if desired. Compounds of multivalent metals, such as iron(III), cobalt(III), chromium(VI) and copper(II), peracids, quinones and nitro compounds, for example, can be used as bleaching agents in bleaching baths and bleach-fixing baths. Typical bleaching agents include ferricyanides; dichromates; organic complex salts of iron(III) or cobalt(III), for example, complex salts with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid, or citric acid, tartaric acid or malic acid; persulfates; bromates; permanganates; and nitrobenzenes. Among these materials, the use of the polyaminocarboxylic acid iron(III) complex salts, principally ethylenediaminetetraacetic acid iron(III) complex salts, and persulfates, is preferred for both rapid processing and the prevention of environmental pollution. Moreover, the aminopolycarboxylic acid iron(III) complex salts are especially useful in both bleaching baths and bleach-fixing baths. The pH of the bleaching baths and bleach-fixing baths in which these aminopolycarboxylic acid iron(III) salts are used is normally from 5.5 to 8, but lower pH values can be used in order to speed up processing.

Bleaching accelerators can be added, if desired, to the bleaching baths, bleach-fixing baths or bleaching or bleach-fixing prebaths. Specific examples of useful bleaching accelerators include compounds which have a mercapto group or a disulfide bond disclosed, for example, in U.S. Pat. No. 3,893,858, West German Patent 1,290,812, JP-A-53-95630, and *Research Disclosure*, No. 17129 (July, 1978); the thiazolidine derivatives disclosed in JP-A-50-140129; the thiourea derivatives disclosed in U.S. Pat. No. 3,706,561; the iodides disclosed in JP-A-58-16235; the polyoxyethylene compounds disclosed in West German Patent 2,748,430; the polyamine compounds disclosed in JP-B-45-8836; and bromide ions. Among these compounds, those which have a mercapto group or a disulfide group are preferred in view of their large accelerating effect, and the compounds disclosed in U.S. Pat. No. 3,893,858, West German Patent 1,290,812 and JP-A-53-95630 are especially preferred. Moreover, the compounds disclosed in U.S. Pat. No. 4,552,834 are also preferred. These bleaching accelerators may also be included in sensitive materials. Moreover, these bleaching accelerators are especially effective when bleach-fixing color photosensitive materials for photograph.

Thiosulfates, thiocyanates, thioether based compounds, thioureas and large amounts of iodide can be used, for example, as fixing agents in the fixing baths and bleach-fixing baths, but thiosulfates are normally used, and ammonium thiosulfate can be used in the widest range of applications. Sulfites, bisulfites, sulfinic acids or carbonyl/bisulfite addition compounds are preferred as preservatives for bleach-fixing baths.

Other conventional compounds can be added to the bleaching baths, bleach-fixing baths and fixing baths.

Water Washing, Stabilizing Baths

The photosensitive materials of the present invention are preferably subjected to a water washing process and/or stabilizing process after the desilvering process. The amount of washing water used in a washing process can be fixed within a wide range, depending on the application and the nature (for example, the materials such as couplers which have been used) of the photosensitive material, the washing water temperature, the number of water washing tanks (the number of water washing stages), the replenishment system, i.e., whether a countercurrent or cocurrent system is used, and various other conditions. The relationship between the amount of water used and the number of washing tanks in a multistage countercurrent system can be determined using the method outlined on pages 248–253 of the *Journal of the Society of Motion Picture and Television Engineers*, Vol. 64 (May, 1955).

The amount of washing water can be greatly reduced by using the multistage countercurrent system described in this article, but bacteria proliferate due to the increased residence time of the water in the tanks, and problems arise with the suspended matter which is produced becoming attached to the photosensitive material. The method in which the calcium ion and magnesium ion concentrations are reduced, as disclosed in JP-A-62-288838, is very effective as a means of overcoming this problem when processing color photosensitive materials of the present invention. Furthermore, the isothiazolone compounds and thiabendazoles disclosed in JP-A-57-8542, the chlorine based disinfectants such as chlorinated sodium isocyanurate, and benzotriazole, for example, and the disinfectants disclosed in *The Chemistry of Biocides and Fungicides* by Horiguchi, in *Killing Microorganisms, Biocidal and Fungicidal Techniques* published by the Health and Hygiene Technical Society; and in *A Dictionary or Biocides and Fungicides*, published by the Japanese Biocide and Fungicide Society, can also be used in this connection.

The pH value of the washing water when processing photosensitive materials of the present invention is generally from 4 to 9 and preferably from 5 to 8. The washing water temperature and the washing time can be set variously in accordance with the nature and application of the photosensitive material but, in general, washing conditions of from 20 seconds to 10 minutes at a temperature of from 15° C. to 45° C. and preferably of from 30 seconds to 5 minutes at a temperature of from 25° C. to 40° C., are selected. Moreover, the photosensitive materials of the present invention can be processed directly in a stabilizing bath instead of being subjected to a water washing as described above. The known methods disclosed in JP-A-57-8543, JP-A-58-14834 and JP-A-60-220345 can be used for this purpose.

Furthermore, in some cases a stabilizing process is carried out following the aforementioned water washing process, and the use of stabilizing baths which contain formalin and surfactant are an example of such a process. Chelating agents and fungicides can also be added to these stabilizing baths.

The overflow which accompanies replenishment of the above-mentioned water washing or stabilizing baths can be reused in other processes, such as the desilvering process.

Neutralizing processes and stop processes can be established between the various processes in addition to the above-mentioned color development, bleaching, bleach-fixing, fixing, water washing and stabilizing processes used in the present invention, pre-film-hardening processes and post-film-hardening processes may be established, and black and white development can be carried out prior to color development.

Photosensitive materials in which ordinary supports are used can be processed together with photosensitive materials of the present invention without adverse effect when processing in accordance with the present invention. The silver halide color photographic materials in which ordinary supports are used may be color printing papers, color reversal printing papers or direct positive printing papers, for example.

Silver Halide Photosensitive Layers and Attendant Layers

The color photosensitive materials of the present invention have silver halide emulsion layers, intermediate layers, protective layers and filter layers, for example, established on a high luster metal support.

Silver Halide Emulsions

The silver halide emulsions of the photosensitive materials used in the present invention can have halogen compositions such as silver iodobromide, silver bromide, silver chlorobromide or silver chloride.

In cases where rapid processing or low replenishment rate processing are to be carried out, the use of silver chloride emulsions or silver chlorobromide emulsions which contain at least 60 mol % of silver chloride is preferred, and emulsions in which the silver chloride content is from 80 to 100 mol % are especially preferred. Furthermore, the present invention is especially effective with silver halide color photographic materials which contain at least one emulsion layer containing substantially only silver chloride, and here the term "substantially only silver chloride" signifies that at least 95% of all the silver halide, and preferably at least 98% of all the silver halide, is silver chloride. In those cases where high photographic speed is required and it is necessary to suppress fogging during the manufacture and storage, and/or during processing, to a low level, the use of silver bromide emulsions or silver chlorobromide emulsions which contain at least 50 mol % of silver bromide is preferred, and a silver bromide content of at least 70 mol % is most preferred. Rapid processing is difficult if the silver bromide content exceeds 90 mol %, but there is no limit to the silver bromide content if techniques for accelerating development, such as the use of silver halide solvents or developing accelerators such as fogging agents and developing agents, for example, are used, and development can be speeded up to a certain extent, and this is desirable. In all cases, a high silver iodide content is undesirable, and the silver iodide content should be not more than 3 mol %. The use of silver halide solvents is especially desirable in photosensitive materials for prints, such as color printing papers.

The silver halide grains used in the present invention may be such that the interior and surface layers consist of different phases (multistructure grains), or they may have a multistructure which has a junction structure, or they may have a multiphase structure in which there is a local phase which has a different halogen composition at the grain surface, or they may be grains where the development initiation points are at the corners of the grains (CDG) or grains in which development proceeds from the vicinity of an edge (EDG). Mixtures of these types of grain can also be used.

The average grain size (the average based on the projected areas, taking the grain diameters in the case of grains which are spherical or approaching spherical, or the edge lengths in the case of cubic grains, or calculated for a sphere in the case of plane grains) of the silver halide grains used in the present invention is preferably not more than 2 μm but at least 0.1 μm, and most preferably from 1.5 μm to 0.15 μm. The grain size distribution may be narrow or wide, but the use of monodisperse silver halide emulsions in which the value (variation factor) obtained by dividing the standard deviation on the grain size distribution curve for the silver halide emulsion by the average grain size is within 20%, and preferably within 15%, is preferred. Furthermore, two or more types of monodisperse silver halide emulsion (which preferably have variation factors as described above in respect of their monodispersivity) can be mixed in the same layer or lamination coated as separate layers in emulsion layers which have essentially the same color sensitivity in order to ensure that the photosensitive materials have the desired gradation. Moreover, mixtures or laminations of combinations of two or more types of polydisperse silver halide emulsions, or of monodisperse emulsions and polydisperse emulsions can also be used.

The form of the silver halide grains used in the present invention may be a regular crystalline form, such as a cubic, octahedral, rhombododecahedral or tetradecahedral form, for example, or a crystalline form in which such regular forms are present; it may be an irregular crystalline form such as a spherical form; or it may be a composite crystalline form consisting of these crystalline forms. Furthermore, the grains may be tabular grains, and in particular emulsions in which tabular grains having a length/thickness ratio of at least 5, and preferably at least 8, account for at least 50% of the total projected area of all the grains. These various emulsions may be of the surface latent image type wherein the latent image is formed principally on the surface of the grains, or of the internal latent image type in which the latent image is formed within the grains.

The use of silver halide emulsions which contain grains of the internal latent image type and which have a multiple structure as disclosed, for example, in the specification of JP-A-63-193146 is especially preferred in the case of direct positive color photosensitive materials.

The photographic emulsions used in the present invention can be prepared, for example, using the methods disclosed in *Research Disclosure* (RD), Vol. 176, No. 17643 (sections I, II, III) (December, 1978).

The silver halide emulsions used in the present invention are normally subjected to physical ripening, chemical ripening and spectral sensitization. Additives which are used in such processes have been disclosed in *Research Disclosure*, Vol. 176, No. 17643 (December, 1978) and in *Research Disclosure*, Vol. 187, No. 18716 (November, 1979), and the locations of these disclosures are summarized in the table below.

Known photographically useful additives which can be used in the present invention are also disclosed in the two *Research Disclosures* referred to above, and the locations of these disclosures are also indicated in the table below.

| Type of Additive | RD 17643 | RD 18716 |
|---|---|---|
| 1. Chemical Sensitizers | Page 23 | Page 648, right column |
| 2. Sensitivity Increasing Agents | — | Page 648, right column |
| 3. Spectral Sensitizers | Pages 23–24 | Page 648, right column to page 649, right column |
| 4. Supersensitizers | Pages 23–24 | Page 648, right column to page 649, right column |
| 5. Fluorescent Brighteners | Page 24 | — |
| 6. Antifoggants and Stabilizers | Pages 24–25 | Page 649, right column |
| 7. Couplers | Page 25 | Page 649, right column |
| 8. Organic Solvents | Page 25 | — |
| 9. Light Absorbers and Filter Dyes | Pages 25–26 | Page 649, right column to page 650, left column |
| 10. Ultraviolet Absorbers | Pages 25–26 | Page 649, right column to page 650, left column |
| 11. Antistaining Agents | Page 25, right column | Page 650, left to right columns |
| 12. Dye Image Stabilizers | Page 25 | — |
| 13. Film Hardening Agents | Page 26 | Page 651, left column |
| 14. Binders | Page 26 | Page 651, left column |
| 15. Plasticizers and Lubricants | Page 27 | Page 650, right column |
| 16. Coating Promotors and Surfactants | Pages 26–27 | Page 650, right column |
| 17. Antistatic Agents | Page 27 | Page 650, right column |

Color Couplers

Various color couplers can be used in the present invention. Here, the term "color coupler" means a compound which undergoes a coupling reaction with the oxidant of a primary aromatic amine developing agent to form a dye. Naphthol and phenol based compounds, pyrazolone and pyrazoloazole based compounds and open chain or heterocyclic ketomethylene compounds are typical examples of useful color couplers. Specific examples of the cyan, magenta and yellow couplers which can be used in the present invention have been disclosed in the patents cited in *Research Disclosure,* 17643 (December, 1978), section VII-D, and *Research Disclosure,* 18717 (November, 1979).

The colored couplers which are incorporated into photosensitive materials are preferably nondiffusible by having ballast groups or by polymerization. 2-Equivalent color couplers which are substituted with a releasing group at the active coupling position enable the amount of silver coated to be reduced relative to that required with a 4-equivalent coupler which has hydrogen at the active coupling position. Couplers such that the color- forming dye has a suitable degree of diffusibility, non-color-forming couplers or DIR couplers which release developing inhibitors as the coupling reaction proceeds, or couplers which release developing accelerators as the coupling reaction proceeds can also be used.

The oil protected type acylacetamide based couplers are typical of the yellow couplers which can be used in the present invention. Specific examples have been disclosed, for example, in U.S. Pat. Nos. 2,407,210, 2,875,057 and 3,265,506. The use of 2-equivalent yellow couplers is preferred in the present invention, and typical examples include the oxygen atom releasing type yellow couplers disclosed, for example, in U.S. Pat. Nos. 3,408,194, 3,447,928, 3,933,501 and 4,022,620, and the nitrogen atom releasing type yellow couplers disclosed, for example, in JP-B-55-10739, U.S. Pat. Nos. 4,401,752 and 4,326,024, RD, 18053 (April, 1979), British Patent 1,425,020, and West German Patent Application (OLS) Nos. 2,219,917, 2,261,361, 2,329,587 and 2,433,812. Moreover, α-pivaloylacetanilide based couplers provide dyes which have excellent fastness, especially light fastness, and α-benzoylacetanilide based couplers provide high color densities.

Oil protected type indazolone based or cyanoacetyl based, and preferably 5-pyrazolone based and pyrazoloazole, for example, pirazolotriazole based couplers are preferred as the magenta couplers which are used in the present invention. The 5-pyrazolone based couplers are preferably couplers which have an arylamino group or an acylamino group substituted at the 3-position from the point of view of the hue of the dye which is formed and the color density, and typical examples have been disclosed, for example, in U.S. Pat. Nos. 2,311,082, 2,343,703, 2,600,788, 2,908,573, 3,062,653, 3,152,896 and 3,936,015. The nitrogen atom releasing groups disclosed in U.S. Pat. No. 4,310,619 or the arylthio groups disclosed in U.S. Pat. No. 4,351,897 are the preferred releasing groups for 2-equivalent 5-pyrazolone based couplers. Furthermore, the 5-pyrazolone based couplers which have ballast groups disclosed in European Patent 73,636 provide high color densities.

The pyrazolobenzimidazoles disclosed in U.S. Pat. No. 3,369,879, and especially the pyrazolo[5,1-c]-[1,2,4]triazoles disclosed in U.S. Pat. No. 3,725,067, the pyrazolotetrazoles disclosed in *Research Disclosure,* 24220 (June, 1984) and the pyrazolopyrazoles disclosed in *Research Disclosure,* 24230 (June, 1984) are preferred as pyrazoloazole based couplers. The imidazo[1,2-b]-pyrazoles disclosed in European Patent 119,741 are preferred in view of the slight absorbance on the yellow side and the light fastness of the colored dye, and the pyrazolo[1,5-b][1,2,4]triazoles disclosed in European Patent 119,860 are especially preferred. Furthermore, use of the pyrazolo[1,5-b][1,2,3]triazole 2-equivalent couplers is also preferred.

The oil protected type naphthol based and phenol based couplers can be used as cyan couplers in the present invention, and typical examples include the naphthol based couplers disclosed in U.S. Pat. No. 2,474,293 and, preferably, the oxygen atom releasing type 2-equivalent naphthol based couplers disclosed in U.S. Pat. Nos. 4,052,212, 4,146,396, 4,228,233 and 4,296,200. Furthermore, specific examples of phenol based couplers have been disclosed, for example, in U.S. Pat. Nos. 2,369,929, 2,801,171, 2,772,162 and 2,895,826. The use of cyan couplers which are fast to moisture and temperature is preferred in the present invention, and typical examples of such couplers include the phenol based cyan couplers which have an alkyl group including an ethyl or larger group at the meta-position of the phenol ring disclosed in U.S. Pat. No. 3,772,002, the 2,5-diacylamino substituted phenol based couplers disclosed, for example, in U.S. Pat. Nos. 2,772,162, 3,758,308, 4,126,396, 4,334,011 and 4,327,173, West German Patent Application (OLS) No. 3,329,729, and JP-A-59-166956, and the phenol based couplers which have a phenylureido group at the 2-position and an acylamino group at the 5-position disclosed, for example, in U.S. Pat. Nos. 3,446,622, 4,333,999, 4,451,559 and 4,427,767.

Graininess can be improved by the combined use of couplers of which the colored dyes have a suitable degree of diffusibility. Such dye diffusible couplers have been disclosed in U.S. Pat. No. 4,366,237 and British Patent 2,125,570 (magenta couplers), and in European Patent 96,570 and West German Patent Application (OLS) No. 3,234,533 (yellow, magenta and cyan couplers).

The dye forming couplers and the abovedescribed special couplers can take the form of dimers or larger polymers. Typical examples of polymerized dye forming couplers have been disclosed in U.S. Pat. Nos. 3,451,820 and 4,080,211. Specific examples of polymerized magenta couplers have been disclosed in British Patent 2,102,173 and U.S. Pat. No. 4,367,282.

Two or more of the various types of couplers used in the present invention can be used together in a layer of the same color sensitivity, and the same compound can be used in two or more different layers, in order to satisfy the characteristics required of the photosensitive material.

The couplers used in the present invention can be introduced into the photosensitive materials using various known methods of dispersion. Examples of high boiling point organic solvents which can be used in the oil-in-water dispersion method have been disclosed, for example, in U.S. Pat. No. 2,322,027. Furthermore, examples of the processes and effects of the latex dispersion method, and of latexes for impregnation, have been disclosed in U.S. Pat. No. 4,199,363, and West German Patent Application (OLS) Nos. 2,541,274 and 2,541,230.

The standard amount of color coupler used is within the range of from 0.001 to 1 mol per mol of photosensitive silver halide, and the preferred amount is within the range of from 0.01 to 0.5 mol per mol of photosensitive silver halide in the case of the yellow couplers, within the range of from 0.003 to 0.3 mol per mol of photosensitive silver halide in the case of the magenta couplers and within the range of from 0.002 to 0.3 mol per mol of photosensitive silver halide in the case of the cyan couplers.

The compounds disclosed in JP-A-62-215272 and Japanese Patent Application Nos. 63-7860 and 63-52938, interlayers, protective layers and filter layers, for example, can be used in the accompanying layers and in other elements.

Color developing agents may be incorporated into the photosensitive materials of the present invention in order to simplify and speed up processing. The use of various color development precursors is preferred for incorporation. For example, use can be made of the indoaniline based compounds disclosed in U.S. Pat. No. 3,342,597, the Schiff's base type compounds disclosed in U.S. Pat. No. 3,342,599 and in *Research Disclosures,* 14850 and 15159, the aldol compounds disclosed in *Research Disclosure,* 13924, the metal salt complexes disclosed in U.S. Pat. No. 3,719,492, and the urethane based compounds disclosed in JP-A-53-135628.

Various 1-phenyl-3-pyrazolidones may be incorporated in the photosensitive materials of the present invention, if desired, for accelerating color development. Typical compounds have been disclosed, for example, in JP-A-56-64339, JP-A-57-144547 and JP-A-58-115438.

The present invention is now described in greater detail with reference to specific examples, but the present invention is not to be construed as being limited to these examples. Unless otherwise indicated, all parts, percents and ratios are by weight.

EXAMPLE 1

Support Preparation

Figure 5:
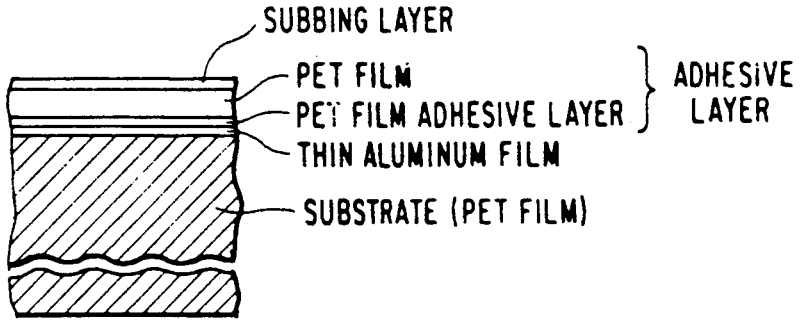
FIG. 5 shows cross sectional views of the layer structures of Supports A, B and C of the present invention.
Figure 5:
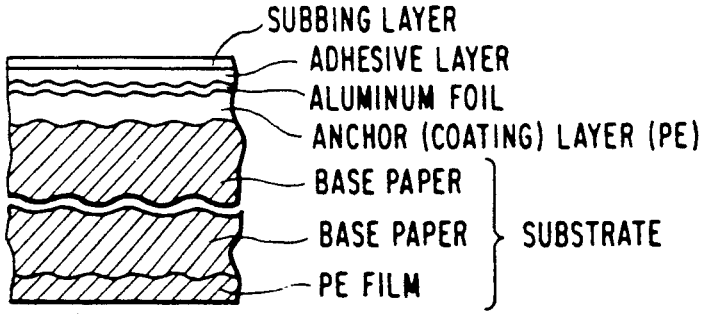
Figure 5:
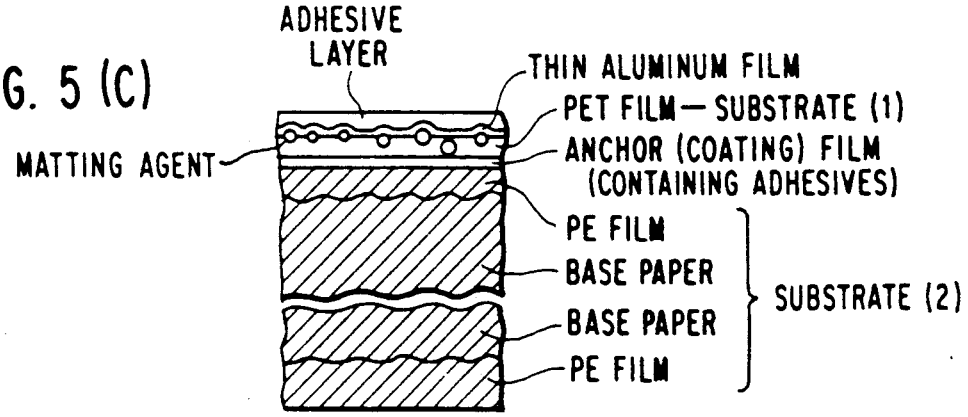

Support Sample A (FIG. 5-(A))

A smooth poly(ethylene terephthalate) film having a thickness of 100 μm was arranged in a vacuum vapor deposition device and aluminum was deposited on this substrate surface under a vacuum of $10^{-5}$ torr to form a thin film having a thickness of 1,000 Å. (The surface was smooth with mirror reflection properties.)

A poly(ethylene terephthalate) film having a thickness of 6 μm was adhered to the metal film using an isocyanate based adhesive.

Moreover, a subbing layer having a thickness of about 0.1 μm was established by coating with a gelatin solution.

Support Sample B (FIG. 5-(B))

Metallic aluminum was coarse rolled and annealed, after which two sheets were superimposed and rolled twice up and down on a central rolling roller between two upper and lower contact rolling rollers to form an aluminum foil having a thickness of about 10 μm. The frequency of the protrusions on the surface was from 100 to 200 protrusion/mm with a roughness of at least 0.1 μm.

Low density polyethylene was extruded and coated onto photographic white base paper and laminated with the above-mentioned aluminum foil. Moreover, high density polyethylene was extruded and coated onto the reverse side of the base paper to form a polyethylene layer having a thickness of about 30 μm. A thin layer of ionomer resin was established on the aluminum surface and, after carrying out a corona discharge process, the surface was coated with a gelatin solution which contained the gelatin hardening agent 1-oxy-3,5-dichloros-triazine sodium salt, and a subbing layer having a thickness of from 0.1 μm to 0.2 μm was formed in this way.

Support Samples C, D, E, F, G and H (FIG. 5-(C))

An anchor coating agent consisting of 80 wt % of a vinylidene chloride copolymer (vinylidene chloride/ vinyl chloride/vinyl acetate/maleic acid anhydride=16/70/10/4) and 20 wt % of a trimethylolpropane adduct of tolylenediisocyanate was dissolved in ethyl acetate and coated so as to provide a thickness, after drying, of 0.1 μm on a poly(ethylene terephthalate) film having a thickness of 26 μm which had been filled with 2% of silica having an average particle size of 3 μm as a plastic film, and the coated layer was oven dried for 2 minutes at 100° C. A thin aluminum film having a thickness of 800 Å was then formed on the substrate having this anchor coating layer by vacuum vapor deposition at $10^{-5}$ torr. The frequency of the protrusions on the surface was from about 40 protrusion/mm to about 100 protrusion/mm at a roughness of 0.1 μm.

The copolymers for adhesive layer formation of which the compositions are shown in Table 1 were diluted with ethyl acetate and coated in such a way as to provide coated weights after drying of 0.2 g/m$^2$ on the surface of this thin vapor deposited aluminum film, and oven dried for 2 minutes at 100° C.

Next, a wood pulp containing 20 parts LBSP (Laubholz Bleached Sulfite Pulp) and 80 parts LBKP (Laubholz Bleached Kraft Pulp) was beaten using a disc refiner to a Canadian freeness of 300 ml (in accordance with JIS P 8121) after which 1.0 part of potassium stearate, 0.5 part of anionic polyacrylamide, 1.5 parts of aluminum sulfate, 0.5 part of polyamide polyamine epichlorohydrin and 0.5 part of alkyldiketone dimer were added in terms of the absolute dry weight of the wood pulp and a paper of weight of 160 g/m$^2$ was made using a long mesh paper making machine.

The density was set to 1.0 g/cm$^2$ by machine calendering. This base paper was subjected to a corona discharge treatment, after which it was extrusion coated with low density polyethylene (melt flow index MI: 7 g/10 min, density: 0.923 g/ml) to form a polyethylene resin layer of thickness of 30 μm. Next, the other side (reverse side) of the substrate was subjected to a corona discharge treatment and extrusion coated with high density polyethylene (MI: 8 g/10 min, density: 0.950) so as to provide a polyethylene laminate on both sides.

Next, the polyurethane based two solution type adhesive of which the composition is indicated below was coated onto the reverse side (the side opposite to the vapor deposited surface) of the aforementioned aluminum vapor deposited film to provide a coating, after drying, of 3 g/m$^2$, and the film was dried for 2 minutes at 100° C.

Adhesive

| Adhesive: | |
|---|---|
| Polypond AY-651A (Sanyo Kasei Kogyo) | 100 parts |
| Polypond AY-651A (Sanyo Kasei Kogyo) | 15 parts |

This coated surface was matched with the low density polyethylene surface of the paper which had been laminated on both sides with polyethylene and thermally bonded at 80° C. under a pressure of 10 kg/cm$^2$.

TABLE 1

| | Support Sample | | | | | |
|---|---|---|---|---|---|---|
| | C | D | E | F | G | H |
| Vinylidene chloride/vinyl chloride/maleic acid anhydride copolymer (weight ratio: 55/40/0/3) | 100 | — | 80 | — | — | — |
| Vinylidene chloride/vinyl chloride/vinyl acetate/maleic acid anhydride copolymer (weight ratio: 10/70/17/3) | — | 90 | — | 80 | 80 | 80 |
| Tolylenediisocyanate/trimethylolpropane adduct | — | 10 | 20 | 20 | — | — |
| Hexamethylenediisocyanate/trimethylolpropane adduct | — | — | — | — | 20 | — |
| Xylylenediisocyanate/trimethylolpropane adduct | — | — | — | — | — | 20 |

Support Samples C-1 to C-8

Support Sample E was prepared and the antistatic solutions of which the compositions are indicated below were coated onto the high density polyethylene laminated surface.

| | |
|---|---|
| Antistatic Solution A: | |
| $SnO_2$ subjected to electrically conductive treatment (average particle size: 0.5 μm) | 4 parts |
| Vinylidene Chloride | 2.5 part |
| Water | 93.5 parts |
| (pH adjusted to 7 with NaOH) | |
| Antistatic Solution B: | |
| SnO subjected to electrically conductive treatment (average particle size: 0.7 μm) | 4 parts |
| Vinylidene chloride | 2.5 parts |
| Water | 93.5 parts |
| (pH adjusted to 7 with NaOH) | |
| Antistatic Solution C: | |
| Colloidal Alumina ("Alumina Sol 100", made by Nissan Kagaku) | 14.0 parts |
| Water | 74.0 parts |
| Methanol | 12.0 parts |
| Antistatic Solution D: | |
| Colloidal Alumina ("Alumina Sol 100", made by Nissan Kagaku) | 14.0 parts |
| Colloidal Silica "Snotex 0", made by Nissan Kagaku) | 14.0 parts |
| Methanol | 72.0 parts |

The coated weight of each antistatic agent and the measured values for the surface electrical resistance of the layers are shown in Table 2.

Surface electrical resistance was measured using the method outlined below.

Measurement of Surface Electrical Resistance

The samples were left to stand for 1 hour under conditions of 20° C., 65% RH, after which electrodes of length 100 mm were attached with a spacing of 2 mm and a DC voltage of 100 V was applied using a sample chamber (TR42), electrometer (TR8651) and high voltage power supply (TR300C) made by Takeda Riken. The current value was read off after 1 minute and the surface electrical resistance was calculated using the formula indicated below.

Surface Electrical Resistance (Ω)=[100 (V)/Measured Current (A)]×[100 (mm)/2 (mm)]

TABLE 2-1

| | Support Sample | | | | | | | | |
|---|---|---|---|---|---|---|---|---|---|
| | C-1 | C-2 | C-3 | C-4 | C-5 | C-6 | C-7 | C-8 | C |
| Antistatic Solution | A | A | B | B | C | C | D | D | — |
| Coated Amount of Antistatic Solution ($mg/m^2$) | 150 | 300 | 200 | 350 | 60 | 100 | 60 | 100 | — |
| Surface Electrical Resistance (Ω) | $5 \times 10^9$ | $1 \times 10^8$ | $5 \times 10^9$ | $4 \times 10^8$ | $5 \times 10^9$ | $5 \times 10^8$ | $4 \times 10^9$ | $8 \times 10^8$ | $1.1 \times 10^{15}$ |

The spectral reflectances of Supports A to H and C-1 to C-8 were measured using a model 307 color analyzer made by Hitachi Seisakusho and the results obtained are shown in Table 2—2. (The reflected light was measured using a sphere of integration without using a trap for the regular reflected light from the incident light.)

TABLE 2-2

| Support | 420 nm* | 550 nm | 700 nm |
|---|---|---|---|
| A | 0.78 | 0.80 | 0.75 |
| B | 0.79 | 0.77 | 0.95 |
| C to H | 0.82 | 0.82 | 0.77 |
| C-1 to C-8 | 0.82 | 0.82 | 0.77 |

*Largely dependent on the spectral transmittance of the adhesive layer and the subbing layer.

The diffuse spectral reflectance excluding the regular reflections with a 10° trap corresponding to the viewing angle of the regular reflected light with incident light at 7° to the normal to the sample was measured in the same way and the results obtained are shown in Table 2–3.

TABLE 2-3

| Support | 402 nm | 550 nm | 700 nm |
|---|---|---|---|
| A | 0.05 or less | 0.05 or less | 0.05 or less |
| B | 0.77 | 0.75 | 0.73 |
| C to H | 0.79 | 0.78 | 0.74 |
| C-1 to C-8 | 0.79 | 0.78 | 0.74 |

It is clearly seen from the results shown in Tables 2—2 and 2–3 that Support Sample A had a surface which exhibited mirror reflection properties while the other samples had surfaces which exhibited diffuse reflection properties. These spectral reflectances were measured using supports on which an adhesive layer and a subbing layer had been established. The spectral reflectance of the reflective thin metal film surface is higher, especially in the short wavelength region below 440 nm and in the ultraviolet wavelength region below 420 nm, and the effect of the spectral transmittance of the material used for the adhesive layer and the subbing layer had a pronounced effect. The spectral reflectance of the thin metal film surface was also measured directly for the spectral reflectance according to the present invention.

The results are indicated below.

Spectral Reflectances of the Thin Aluminum Film Surfaces (with no adhesive layer or subbing layer)

| Support Sample Used | Spectral Reflectance 420 nm | 550 nm | 700 nm |
|---|---|---|---|
| A | 0.82 | 0.84 | 0.82 |
| B | 0.80 | 0.79 | 0.77 |
| C | 0.84 | 0.85 | 0.82 |

Preparation of Multilayer Color Printing Paper Samples

Multilayer Color Printing Paper Sample 1 of which the layer structure is indicated below was prepared on a resin coated paper support which was laminated on both sides with polyethylene. Furthermore, Multilayer Color Printing Paper Samples 2 to 17 were prepared using the supports indicated in Table 3.

The coating solutions were prepared in the way indicated below.

Preparation of the First Layer Coating Solution

Ethyl acetate (27.2 ml), 4.1 g of the solvent (Solv-3) and 4.1 g of the solvent (Solv-6) were added to 19.1 g of the yellow coupler (ExY), 4.4 g of the color image stabilizer (Cpd-1) and 1.8 g of the color image stabilizer (Cpd-7) to form a solution which was then emulsified and dispersed in 185 ml of a 10% aqueous gelatin solution which contained 8 ml of 10% sodium dodecylbenzenesulfonate. On the other hand, a silver chlorobromide emulsion (a ⅞ mixture (mol ratio of Ag) of a cubic emulsion having silver bromide content: 80.0 mol %, average grain size: 0.85 μm and variation coefficient: 0.08, and a cubic emulsion of silver bromide content: 80.0 mol %, average grain size: 0.62 μm, variation coefficient: 0.07) was prepared by sulfur sensitization followed by the addition of $5.0 \times 10^{-4}$ mol per mol of silver of the blue sensitizing dye indicated below. This emulsion was then mixed with the abovedescribed emulsified dispersion and the first layer coating solution was prepared to provide the composition indicated below. The coating solutions for the second to the seventh layers were prepared using the same procedure as used to prepare the first layer coating solution. Moreover, 1-oxy-3,5-dichloro-s-triazine sodium salt was used as a gelatin hardening agent in each layer.

The spectral sensitizing dyes used in each layer were as indicated below.

Blue-Sensitive Emulsion Layer

-continued

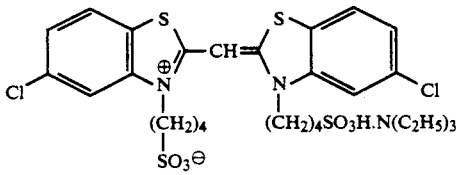

(5.0 × $10^{-4}$ mol per mol of silver halide)

Green-Sensitive Emulsion Layer

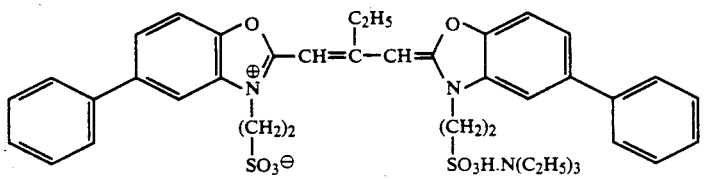

(4.0 × $10^{-4}$ mol per mol of silver halide)
and

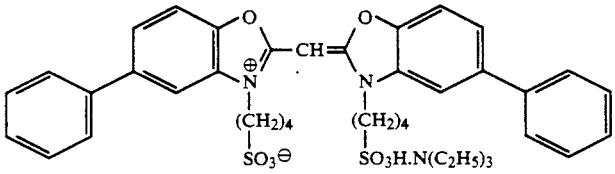

(7.0 × $10^{-5}$ mol per mol of silver halide)

Red-Sensitive Emulsion Layer

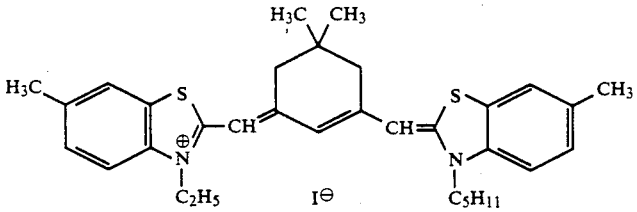

(0.9 × $10^{-4}$ mol per mol of silver halide)

The compound indicated below was added to the red-sensitive emulsion layer at a rate of $2.6\times10^{-3}$ mol per mol of silver halide.

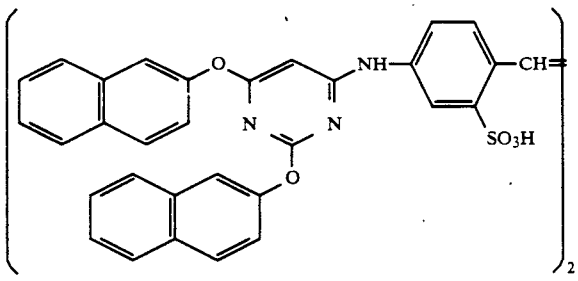

Furthermore, 1-(5-methylureidophenyl)-5-mercaptotetrazole was added at rates, per mol of silver halide, of $4.0\times10^{-6}$ mol, $3.0\times10^{-5}$ mol and $1.0\times10^{-5}$ mol, respectively, and 2-methyl-5-tert-octylhydroquinone was added at rates, per mol of silver halide, of $8\times10^{-3}$ mol, $2\times10^{-2}$ mol and $2\times10^{-2}$ mol, respectively, to the blue-sensitive, green-sensitive and red-sensitive emulsion layers.

Furthermore, 4-hydroxy-6-methyl-1,3,3a,7-tetraazaindene was added at rates, per mol of silver halide, of $1.2\times10^{-2}$ mol and $1.1\times10^{-2}$ mol, respectively, to the blue-sensitive and green-sensitive emulsion layers.

The dyes indicated below were added to the emulsion layers for antiirradiation purposes.

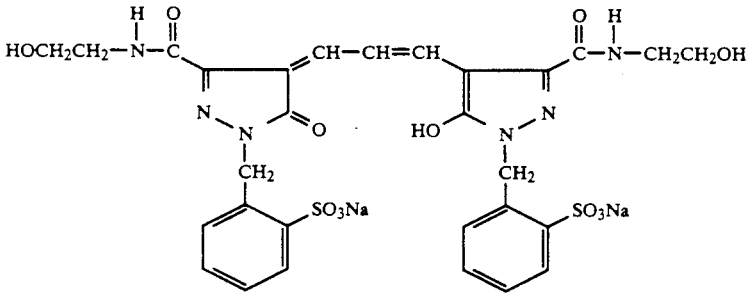

5.3 mg/m² and

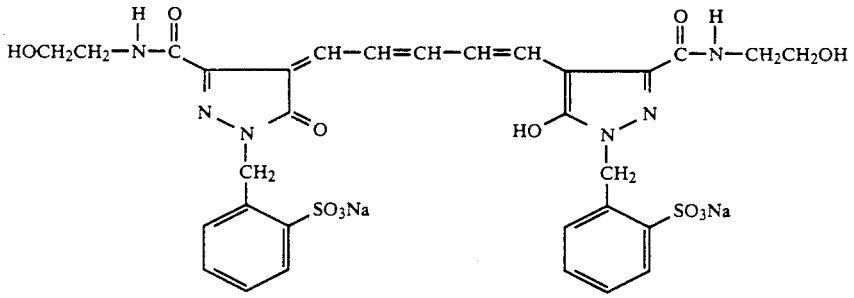

14.0 mg/m²

Layer Structure

The composition of each layer is indicated below. The numerical values indicate the coated weights (g/m²). The coated weights of silver halide emulsions are indicated as coated weights calculated as silver.

Support

Polyethylene laminated paper or the supports shown in Table 3 (a white pigment ($TiO_2$) and a bluish dye (ultramarine) were included in the polyethylene of the first layer side).

| | |
|---|---|
| First Layer: Blue-Sensitive Layer | |
| The Above Silver Chlorobromide Emulsion (AgBr content: 80 mol %) | 0.26 |
| Gelatin | 1.83 |
| Yellow Coupler (ExY) | 0.83 |
| Color Image Stabilizer (Cpd-1) | 0.19 |
| Color Image Stabilizer (Cpd-7) | 0.08 |
| Solvent (Solv-3) | 0.18 |
| Solvent (Solv-6) | 0.18 |
| Second Layer: Anti-Color-Mixing Layer | |
| Gelatin | 0.99 |
| Anti-Color-Mixing Agent (Cpd-6) | 0.08 |
| Solvent (Solv-1) | 0.16 |
| Solvent (Solv-4) | 0.08 |
| Third Layer: Green-Sensitive Layer | |
| Silver Chlorobromide Emulsion (cubic emulsion of AgBr content: 90 mol %, average grain size: 0.47 μm, variation coefficient: 0.12, and cubic emulsion of AgBr content: 90 mol %, average grain size: 0.36 μm, variation coefficient: 0.09, mixed in the proportions (as silver) of 1/1) | 0.16 |

-continued

| | |
|---|---|
| Gelatin | 1.79 |
| Magenta Coupler (ExM) | 0.32 |
| Color Image Stabilizer (Cpd-3) | 0.20 |
| Color Image Stabilizer (Cpd-8) | 0.03 |
| Color Image Stabilizer (Cpd-4) | 0.01 |
| Color Image Stabilizer (Cpd-9) | 0.04 |
| Solvent (Solv-2) | 0.65 |
| Fourth Layer: Ultraviolet Absorbing Layer | |
| Gelatin | 1.58 |
| Ultraviolet Absorber (UV-1) | 0.47 |
| Anti-Color-Mixing Agent (Cpd-5) | 0.05 |
| Solvent (Solv-5) | 0.24 |
| Fifth Layer: Red-Sensitive Layer | |
| Silver Chlorobromide Emulsion (cubic emulsion of AgBr content: 70 mol %, average grain size: 0.49 μm, variation coefficient: 0.08, and cubic emulsion of AgBr content: 70 mol %, average grain size: 0.34 μm, variation coefficient: 0.10, mixed in the proportions (as silver) of ½) | 0.23 |
| Gelatin | 1.34 |
| Cyan Coupler (ExC) | 0.30 |
| Color Image Stabilizer (Cpd-6) | 0.17 |
| Color Image Stabilizer (Cpd-7) | 0.40 |
| Solvent (Solv-6) | 0.20 |
| Sixth Layer: Ultraviolet Absorbing Layer | |
| Gelatin | 0.53 |
| Ultraviolet Absorber (UV-1) | 0.16 |
| Anti-Color-Mixing Agent (Cpd-5) | 0.02 |
| Solvent (Solv-5) | 0.08 |
| Seventh Layer: Protective Layer | |
| Gelatin | 1.33 |
| Acrylic Modified Poly(vinyl Alcohol) Copolymer (modification: 17%) | 0.17 |
| Liquid Paraffin | 0.03 |

(Cpd-1) Color Image Stabilizer

-continued
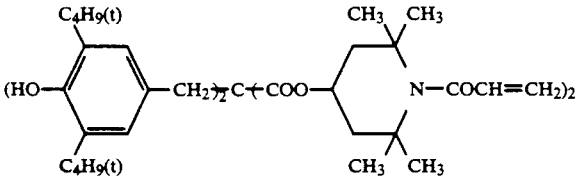
(Cpd-3) Color Image Stabilizer
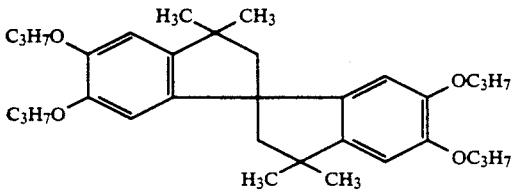
(Cpd-4) Color Image Stabilizer
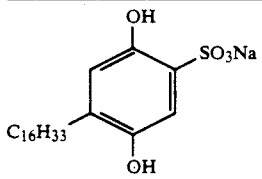
(Cpd-5) Anti-Color-Mixing Agent
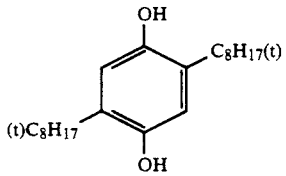
(Cpd-6) Color Image Stabilizer
2/4/4 (by weight) mixture of:
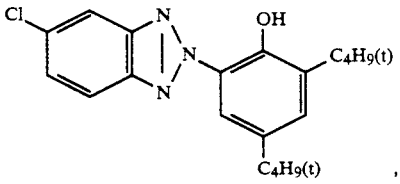
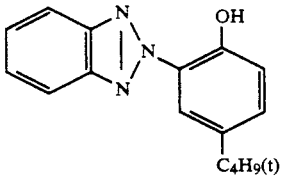
and
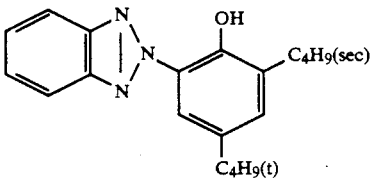
(Cpd-7) Color Image Stabilizer
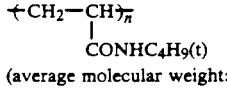
(average molecular weight: 80,000)
(Cpd-8) Color Image Stabilizer -continued
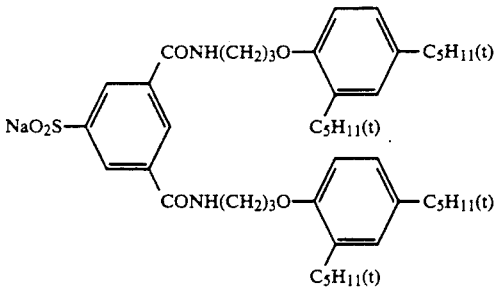
(Cpd-9) Color Image Stabilizer
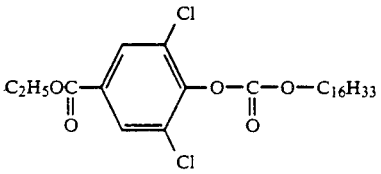
(UV-1) Ultraviolet Absorber
4/2/4 (by weight) mixture of:
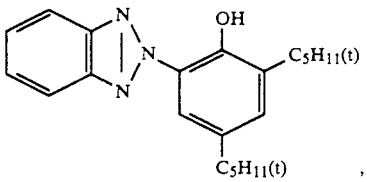
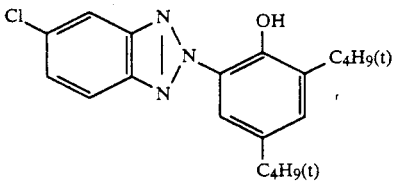
and
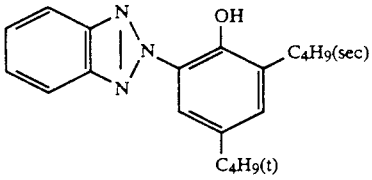
(Solv-1) Solvent
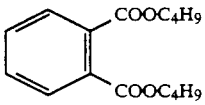
(Solv-2) Solvent
2/1 (by volume) mixture of:
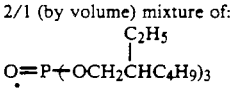
and
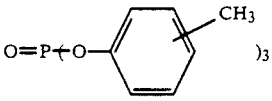
(Solv-3) Solvent
$O{=}P{+}O{-}C_9H_{19}(iso))_3$ -continued
(Solv-4) Solvent
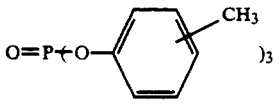
(Solv-5) Solvent
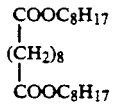
(Solv-6) Solvent
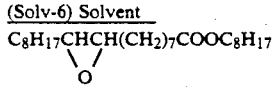
(ExY) Yellow Coupler
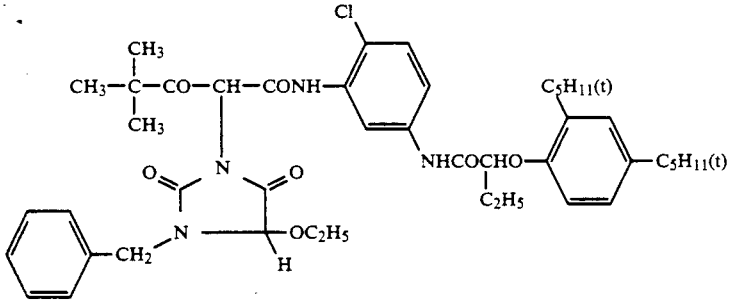
(ExM) Magenta Coupler
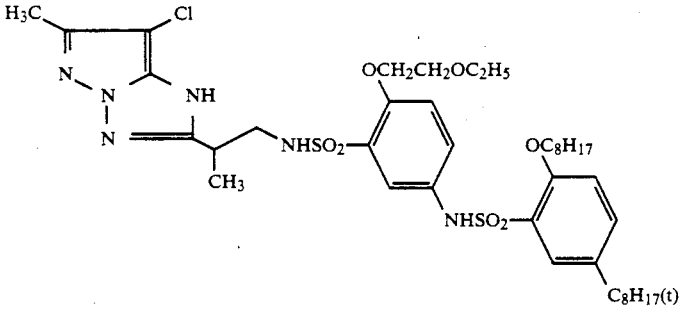
(ExC) Cyan Coupler
1/1 (mol ratio) mixture of:
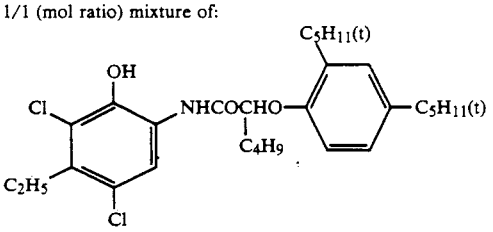
and
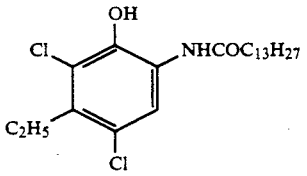
TABLE 3
| Multilayer Color Printing Paper Sample | Support Used | Remarks |
|---|---|---|
| 1 | Resin coated paper | Comparison |
TABLE 3-continued
| Multilayer Color Printing Paper Sample | Support Used | Remarks |
|---|---|---|
| 2 | A | Invention |

TABLE 3-continued

| Multilayer Color Printing Paper Sample | Support Used | Remarks |
|---|---|---|
| 3 | B | " |
| 4 | C | " |
| 5 | D | " |
| 6 | D | " |
| 7 | F | " |
| 8 | G | " |
| 9 | H | " |
| 10 | C-1 | Invention (antistatic layer attached) |
| 11 | C-2 | Invention (antistatic layer attached) |
| 12 | C-3 | Invention (antistatic layer attached) |
| 13 | C-4 | Invention (antistatic layer attached) |
| 14 | C-5 | Invention (antistatic layer attached) |
| 15 | C-6 | Invention (antistatic layer attached) |
| 16 | C-7 | Invention (antistatic layer attached) |
| 17 | C-8 | Invention (antistatic layer attached) |

CTF (Contrast Transfer Function) Measurement

Color Printing Paper Samples 1 to 9 were cut up and contact exposures of square wave charts with different frequencies were made through red, green and blue tricolor separation filters which had the spectral transmissions shown in FIG. 1. The samples were then color developed and processed in accordance with the processing operations indicated below using a color developing bath (IV in Table 4). The resolving powers were obtained by measuring the densities of the images so obtained (aperture 2 μm×100 μm (width)).

The results obtained are shown in Table 5.

Figure 2:
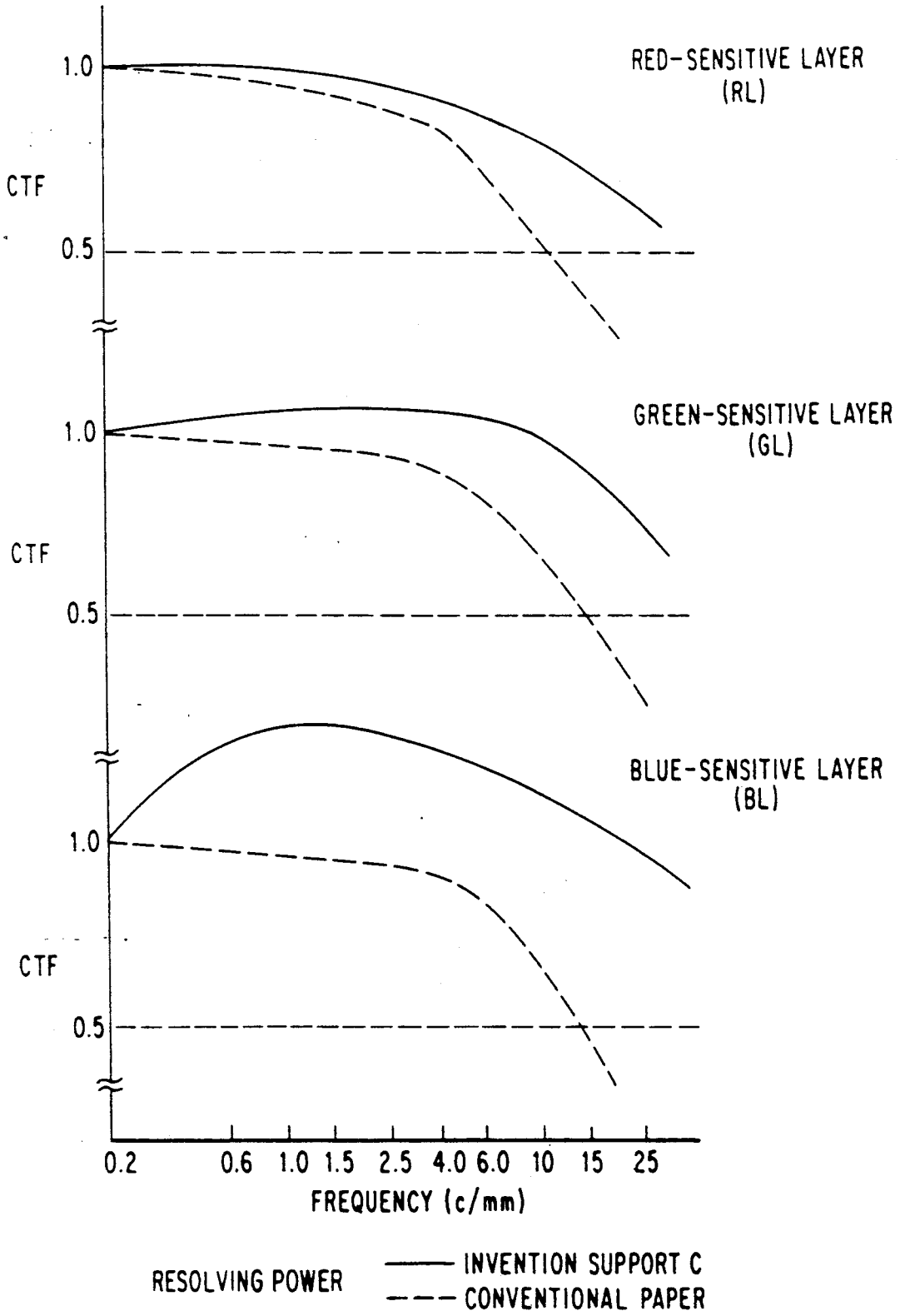
FIG. 2 shows CTF curves.

The results obtained with Color Printing Paper Samples 1 and 4 in particular are shown in FIG. 2. The CTF curves (solid lines) obtained with Color Printing Paper Sample 4 (in which Support C of the present invention was used) indicated a very much higher image sharpness than those (dotted lines) obtained with Color Printing Paper Sample 1 (comparative sample). Similar results were obtained with Samples 2, 3 and 5 to 9.

Observation of the Saturation of the Color Image

Tricolor separation exposures were made in the same way as described above, and the red, green and blue images obtained on color development were observed visually at an angle of 20° to 30° while illuminating the surface with a white light source at an angle of some 80° to 90° above the surface. Sample 4 of the present invention provided a bright images which had a very high degree of color saturation when compared to the images obtained with Color Printing Paper Sample 1 (comparative sample).

Edge Staining Test

Color Printing Paper Samples 1 to 9 were cut into strips of width 117 mm and formed into roll-like samples. These were exposed with the image from a Fujicolor HR-400 color negative film. An optical wedge exposure was also carried out using the above tricolor separation filters.

After exposure, the materials were processed continuously (in a running test) until the color developing bath had been replenished to twice the tank capacity, using a Fujicolor Paper Processor model PP600. The processed samples were obtained by processing Sample 1 independently and by processing with equal quantities of Sample 1 in the case of each of Samples 2 to 9. The processing operation and the processing bath formulations are outlined below.

| Processing | Temperature (°C.) | Time | Replenishment Rate* (ml) | Tank Capacity (liter) |
|---|---|---|---|---|
| Color Development | 38 | 1 min 40 sec | 290 | 17 |
| Bleach-Fixing | 33 | 60 sec | 150 | 9 |
| Rinsing (1) | 30–34 | 20 sec | — | 4 |
| Rinsing (2) | 30–34 | 20 sec | — | 4 |
| Rinsing (3) | 30–34 | 20 sec | 664 | 4 |
| Drying | 70–80 | 50 sec | | |

*Per square meter of photosensitive materials.
Rinsing carried out with a three tank countercurrent from (3) to (1).

The composition of each processing bath was as follows:

| | Tank Solution | Replenisher |
|---|---|---|
| Color Developing Bath (Baths I to VII): | | |
| Water | 800 ml | 800 ml |
| Chelating Agent A | See Table 4 | See Table 4 |
| Chelating Agent B | See Table 4 | See Table 4 |
| Chelating Agent C | See Table 4 | See Table 4 |
| Benzyl Alcohol | 16 ml | 22 ml |
| Diethylene Glycol | 10 ml | 10 ml |
| Sodium Sulfite | 2.0 g | 2.5 g |
| Potassium Bromide | 0.5 g | — |
| Potassium Carbonate | 30 g | 30 g |
| N-Ethyl-N-(β-methanesulfonamidoethyl)-3-methyl-4-aminoaniline Sulfate | 5.5 g | 7.5 g |
| Hydroxylamine Sulfate | 2.0 g | 2.5 g |
| Fluorescent Brightener (Whitex 4B, made by Sumitomo Chemicals) | 1.5 g | 2.0 g |
| Water to make | 1,000 ml | 1,000 ml |
| pH (25° C.) | 10.20 | 10.60 |
| Bleach-Fixing Bath: | | |
| Water | 400 ml | 400 ml |
| Ammonium Thiosulfate (700 g/liter) | 200 ml | 300 ml |
| Sodium Sulfite | 20 g | 40 g |
| Ethylenediaminetetraacetic Acid Fe(III) Ammonium Salt | 60 g | 120 g |
| Ethylenediaminetetraacetic Acid Disodium Salt | 5 g | 10 g |
| Water to make | 1,000 ml | 1,000 ml |
| pH (25° C.) | 6.70 | 6.30 |
| Rinsing Bath: | | |
| Ion exchanged water (calcium and magnesium content: 3 ppm or less) | | |

TABLE 4

| Color Developing Bath No. | Chelating Agent A (mol) | Chelating Agent B (mol) | Chelating Agent C (mol) |
|---|---|---|---|
| I | Diethylenetriamine- | — | — |

TABLE 4-continued

| Color Developing Bath No. | Chelating Agent A (mol) | Chelating Agent B (mol) | Chelating Agent C (mol) |
|---|---|---|---|
| | pentaacetic Acid (0.018) | | |
| II | Triethylenetetramine-hexaacetic Acid (0.018) | — | — |
| III | Diethylenetriamine-pentaacetic Acid (0.002) | I-1 (0.008) | I-2 (0.008) |
| IV | Diethylenetriamine-pentaacetic Acid (0.002) | I-1 (0.008) | III-2 (0.008) |
| V | III-1 (0.009) | IV-3 (0.009) | — |
| VI | II-3 (0.009) | IV-2 (0.009) | — |
| VII | III-2 (0.009) | IV-2 (0.009) | — |

Each of the samples obtained by continuous processing up to the point at which the color developing bath had been replenished to twice the tank capacity were cut to provide prints measuring 117 mm×82.5 mm. Ten prints were taken together to simplify evaluation, and the extent of the staining of the edges which had been in contact with the developing bath was evaluated in each case.

The results obtained are shown in Table 5, where A signifies an excellent result with no staining at all, B signifies that staining was hardly observed, C signifies that staining was slightly observed but at a tolerable level, and D signifies that staining occurred.

TABLE 5

| Multilayer Color Printing Paper Sample (support used) | Resolving Power-Lines/mm at CTF of 0.5 | | | Edge Staining Color Developing Bath Used | | | | | | |
|---|---|---|---|---|---|---|---|---|---|---|
| | Cyan | Magenta | Yellow | I | II | III | IV | V | VI | VII |
| 1 (resin coated paper) | 10 | 14 | 13 | B | B | B | B | B | B | B |
| 2 (A) | 25< | 30< | 30< | C | C | B | B | B | B | B |
| 1 (resin coated paper) | — | — | — | B | B | B | B | B | B | B |
| 3 (B) | 25< | 25< | 30< | C | C | B | B | C | B | C |
| 1 (resin coated paper) | — | — | — | B | C | B | B | B | B | B |
| 4 (C) | " | " | " | C | C | B | B | B | B | B |
| 1 (resin coated paper) | — | — | — | B | B | B | B | B | B | B |
| 5 (D) | " | " | " | " | " | " | " | " | " | " |
| 1 (resin coated paper) | | | | | | | | | | |
| 6 (E) | " | " | " | " | " | " | " | " | " | " |
| 1 (resin coated paper) | | | | | | | | | | |
| 7 (F) | " | " | " | " | " | " | " | " | " | " |
| 1 (resin coated paper) | | | | | | | | | | |
| 8 (G) | " | " | " | " | " | " | " | " | " | " |
| 1 (resin coated paper) | | | | | | | | | | |
| 9 (H) | " | " | " | " | " | " | " | " | " | " |
| 1 (resin coated paper) | | | | | | | | | | |
| 10–17 (C-1 to C-8, see Table 3) | " | " | " | " | " | " | " | " | " | " |
| 1 (resin coated paper) | | | | | | | | | | |

| Multilayer Color Printing Paper Sample (support used) | Processing Variation ($\Delta D_G$) | | | | | | | No. of Sheets with Static Marks |
|---|---|---|---|---|---|---|---|---|
| | I | II | III | IV | V | VI | VII | |
| 1 (resin coated paper) | −0.03 | −0.02 | ±0 | ±0 | −0.02 | ±0 | −0.02 | 1 |
| 2 (A) | +0.05 | +0.03 | +0.01 | +0.01 | +0.03 | +0.01 | +0.02 | 2 |
| 1 (resin coated paper) | −0.05 | −0.03 | ±0 | ±0 | −0.01 | ±0 | −0.01 | 0 |
| 3 (B) | +0.06 | +0.05 | +0.01 | +0.01 | +0.02 | +0.02 | +0.03 | 3 |
| 1 (resin coated paper) | −0.06 | −0.06 | ±0 | ±0 | −0.02 | −0.01 | −0.02 | 1 |
| 4 (C) | +0.05 | +0.06 | +0.01 | ±0 | +0.01 | +0.01 | +0.02 | 3 |
| 1 (resin coated paper) | −0.04 | −0.04 | ±0 | ±0 | −0.01 | ±0 | −0.01 | 0 |
| 5 (D) | " | +0.04 | " | " | +0.02 | " | +0.01 | 2 |
| 1 (resin coated paper) | | −0.04 | | | −0.01 | | −0.01 | 0 |
| 6 (E) | " | " | " | " | " | " | " | 3 |
| 1 (resin coated paper) | | | | | | | | 0 |
| 7 (F) | " | " | " | " | " | " | " | 2 |
| 1 (resin coated paper) | | | | | | | | 0 |
| 8 (G) | " | " | " | " | " | " | " | 2 |
| 1 (resin coated paper) | | | | | | | | 0 |
| 9 (H) | " | " | " | " | " | " | " | 3 |
| 1 (resin coated paper) | | | | | | | | 0 |
| 10–17 (C-1 to C-8, see Table 3) | +0.05 | +0.04 | " | " | " | " | " | 0 |
| 1 (resin coated paper) | | | | | | | | 0 |

"—" indicates that the results were obtained with simultaneous development.

Processing Variation Test

Variation in gradation (a hardening of contrast) and desilvering failure were liable to occur when color printing paper samples with high luster metal supports of the present invention were processed continuously using normal color development processing, for example, using Color Developing Bath I. The green density difference ($\Delta D_G$) obtained after continuous processing at an exposure for the green layer which gave a green density of 1.50 at the start of color development was used as a measure of processing variation. The results obtained are shown in Table 5 (the range or results in the test was about ±0.02).

When Color Printing Paper Samples 2 to 9 in which high luster metal supports were used in accordance with the present invention were processed in the Color Developing Baths III to VII, and especially in the Color Developing Baths III, IV and VI, of the present invention, there was little processing variation and the results were equal to or better than those obtained when the conventional Color Paper Sample 1 was color developed using the Color Developing Bath I.

Furthermore, when the developing baths II, IV and VI were used the processing variation did not become larger even when Sample 1 was processed together with Samples 2 to 9 of the present invention.

Static Mark Formation Test

Color printing paper samples which had been cut to a size of 117 mm×82.5 mm were equilibrated for 2 hours in a dark room under conditions of 25° C., 10% RH and then a rubber sheet was placed over the photosensitive material and the reverse side was rubbed 30 times with a poly(vinyl chloride) roller in the dark under the same conditions as above, after which the photosensitive material was peeled away from the rubber sheet at a constant rate and at a constant angle. The samples were then color developed and processed using Color Developing Baths I and III. The number of samples which displayed static marks from a total of ten samples was obtained.

No static marks were observed at all with Color Printing Paper Samples 10 to 17.

EXAMPLE 2

Edge staining tests and processing variation tests were carried out with Color Printing Paper Samples 3 and 4 in Example 1 using the processing operations and color developing baths indicated below.

After imagewise exposure, continuous processing (a running test) was carried out using a Fujicolor Paper Processor model PPRP115 with the processing operations indicated below until the color developing tank had been replenished to the extent of twice the tank capacity.

| Processing | Temperature (°C.) | Time | Replenishment Rate* (ml) | Tank Capacity (liter) |
|---|---|---|---|---|
| Color Development | 37 | 3 min 30 sec | 200 | 60 |
| Bleach-Fixing | 33 | 1 min 30 sec | 55 | 40 |
| Water Washing (1) | 24–34 | 1 min | — | 20 |
| Water Washing (2) | 24–34 | 1 min | — | 20 |
| Water Washing (3) | 24–34 | 1 min | 10,000 | 20 |
| Drying | 70–80 | 1 min | | |

*Per square meter of photosensitive materials.
Water Washing carried out with a three tank cascade from (3) to (1).

The composition of each processing bath was as follows:

| | Tank Solution | Replenisher |
|---|---|---|
| Color Developing Bath (Baths VIII to XV): | | |
| Water | 800 ml | 800 ml |
| Chelating Agent A | See Table 6 | See Table 6 |
| Chelating Agent B | See Table 6 | See Table 6 |
| Benzyl Alcohol | 15 ml | 23 ml |
| Diethylene Glycol | 10 ml | 10 ml |
| Sodium Sulfite | 2.0 g | 3.0 g |
| Potassium Bromide | 1.2 g | — |
| Potassium Carbonate | 30 g | 25 g |
| N-Ethyl-N-(β-methanesulfonamidoethyl)-3-methyl-4-aminoaniline Sulfate | 5.0 g | 9.0 g |
| Hydroxylamine Sulfate | 3.0 g | 4.5 g |
| Fluorescent Brightener (Whitex 4B, made by Sumitomo Chemicals) | 1.0 g | 2.0 g |
| Water to make | 1,000 ml | 1,000 ml |
| pH (25° C.) | 10.20 | 10.80 |
| Bleach-Fixing Bath: | | |
| Water | 400 ml | 400 ml |
| Ammonium Thiosulfate (70 wt %) | 150 ml | 300 ml |
| Sodium Sulfite | 13 g | 26 g |
| Ethylenediaminetetraacetic Acid Fe(III) Ammonium Salt | 55 g | 110 g |
| Ethylenediaminetetraacetic Acid Disodium Salt | 5 g | 10 g |
| Water to make | 1,000 ml | 1,000 ml |
| pH (25° C.) | 6.70 | 6.30 |
| Washing Water: | | |
| Ion exchanged water (calcium and magnesium content: 3 ppm or less) | | |

TABLE 6

| Color Developing Bath No. | Constitution of the Color Developing Bath: Chelating Agent A (mol) | Chelating Agent B (mol) |
|---|---|---|
| VIII | Diethylenetriamine-pentaacetic Acid (0.016) | — |
| IX | Cyclohexanediamine-tetraacetic Acid (0.16) | — |
| X | Diethylenetriamine-pentaacetic Acid (0.008) | I-1 (0.008) |
| XI | I-1 (0.016) | — |
| XII | II-3 (0.008) | IV-2 (0.008) |
| XIII | III-2 (0.008) | IV-3 (0.008) |
| XIV | II-5 (0.008) | I-1 (0.008) |
| XV | III-1 (0.008) | IV-2 (0.008) |

The results obtained are shown in Table 7.

Edge staining and processing variation tended to improve when the Color Developing Baths X to XV of the present invention were used. Peeling of the film from the edges was observed on Processing Sample 3 in Color Developing Baths VIII and IX.

TABLE 7

| Multilayer Color Printing Paper Sample (support used) | Edge Staining Color Developing Bath Used | | | | | | | | Processing Variation ($\Delta D_G$) | | | | | | | |
|---|---|---|---|---|---|---|---|---|---|---|---|---|---|---|---|---|
| | VIII | IX | X | XI | XII | XIII | XIV | XV | VIII | IX | X | XI | XII | XIII | XIV | XV |
| 3 (B) | D | D | C | B | B | B | C | C | +0.07 | +0.06 | +0.03 | +0.02 | +0.02 | +0.02 | +0.03 | +0.03 |
| 1 (resin coated paper) | B | B | B | B | B | B | B | B | −0.08 | −0.05 | −0.02 | −0.02 | ±0 | ±0 | −0.02 | −0.02 |
| 4 (C) | C | C | B | B | B | B | B | B | +0.05 | +0.05 | +0.02 | +0.01 | +0.01 | +0.01 | +0.02 | +0.02 |
| 1 (resin coated | B | B | B | B | B | B | B | B | −0.06 | −0.04 | −0.02 | −0.02 | ±0 | ±0 | −0.01 | ±0 |

TABLE 7-continued

| Multilayer Color Printing Paper Sample (support used) | Edge Staining Color Developing Bath Used | | | | | | | | Processing Variation ($\Delta D_G$) | | | | | | | |
|---|---|---|---|---|---|---|---|---|---|---|---|---|---|---|---|---|
| | VIII | IX | X | XI | XII | XIII | XIV | XV | VIII | IX | X | XI | XII | XIII | XIV | XV |
| paper) | | | | | | | | | | | | | | | | |

EXAMPLE 3

A multilayer color printing paper (Sample 101) of which the layer structure is described below was prepared on a paper support which had been laminated on both sides with polyethylene. Furthermore, Multilayer Color Printing Paper Samples 102 to 111 were prepared using the supports indicated in Table 8. The coating solutions were prepared in the way described below.

Preparation of the First Layer Coating Solution

Ethyl acetate (27.2 ml) and 8.2 g of the solvent (Solv-3) were added to 19.1 g of the yellow coupler (ExY), 4.4 g of the color image stabilizer (Cpd-1) and 0.7 g of the color image stabilizer (Cpd-7) to form a solution which was then emulsified and dispersed in 185 ml of a 10% aqueous gelatin solution which contained 8 ml of 10% sodium dodecylbenzenesulfonate. On the other hand, a silver chlorobromide emulsion (cubic, average grain size: 0.85 μm, variation coefficient of the grain size distribution: 0.08, with 1 mol % of the silver bromide, as a proportion of the whole grain, included in part of the grain surface) was sulfur sensitized after adding $2.0\times10^{-4}$ mol per mol of silver of the two types of blue-sensitive sensitizing dyes indicated below. The emulsion was then mixed with the emulsified dispersion and the first layer coating solution was prepared to provide the composition indicated below. The coating solutions for the second to the seventh layers were prepared using the same procedure as used to prepare the first layer coating solution. Moreover, 1-oxy-3,5-dichloro-s-triazine sodium salt was used as a gelatin hardening agent in each layer.

The spectral sensitizing dyes used in each layer were as indicated below.

Blue-Sensitive Emulsion Layer

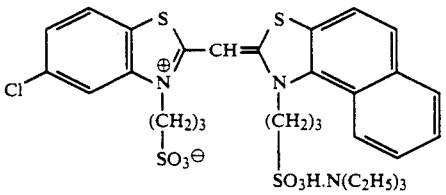

and

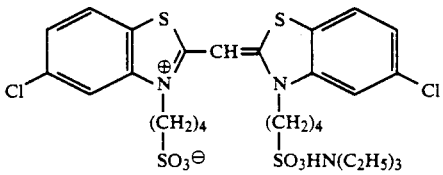

($2.0\times10^{-4}$ mol of each of these dyes per mol of silver halide)

Green-Sensitive Emulsion Layer

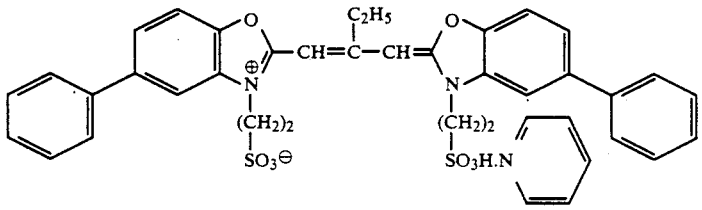

($4.0\times10^{-4}$ mol per mol of silver halide)
and

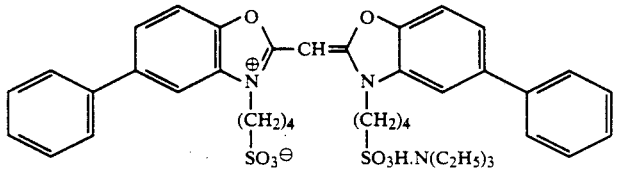

($7.0\times10^{-5}$ mol per mol of silver halide)

Red-Sensitive Emulsion Layer

-continued

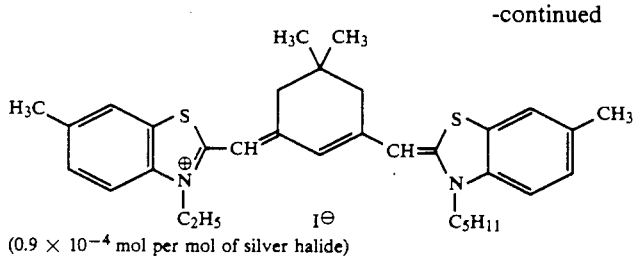

(0.9 × $10^{-4}$ mol per mol of silver halide)

The compound indicated below was added to the red-sensitive emulsion layer at a rate of $2.6\times10^{-3}$ mol per mol of silver halide.

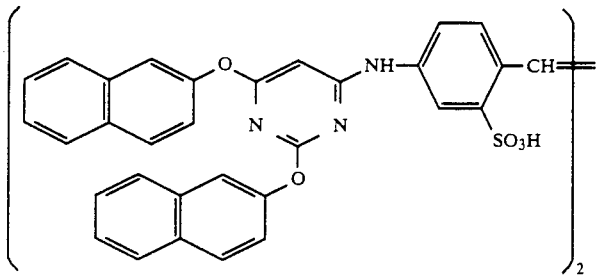

Furthermore, 1-(5-methylureidophenyl)-5-mercaptotetrazole was added at rates, per mol of silver halide, of $8.5\times10^{-5}$ mol, $7.7\times10^{-4}$ mol and $2.5\times10^{-4}$ mol, respectively, to the blue-sensitive, green-sensitive and red-sensitive emulsion layers.

The dyes indicated below were added to the emulsion layers for antiirradiation purposes.

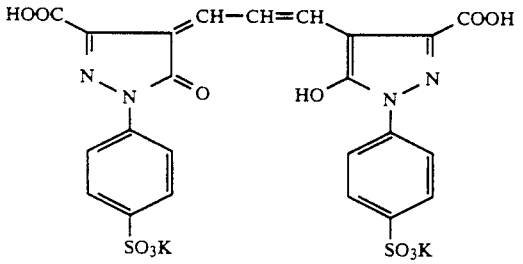

5.3 mg/m$^2$ and

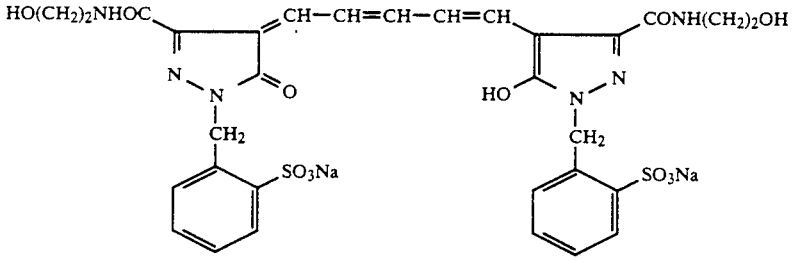

14.0 mg/m$^2$

Layer Structure

The composition of each layer was as indicated below. The numerical values indicate the coated weights (g/m$^2$). The coated weight of silver halide emulsions is indicated as the coated weight calculated as silver.

Support

Polyethylene Laminated Paper or a Support as Indicated in Table 3 (a white pigment ($TiO_2$) and a bluish dye (ultramarine) were included in the polyethylene of the first layer side)

| | |
|---|---|
| First Layer: Blue-Sensitive Layer | |
| The Above Silver Chlorobromide Emulsion | 0.30 |
| Gelatin | 1.86 |
| Yellow Coupler (ExY) | 0.82 |
| Color Image Stabilizer (Cpd-1) | 0.19 |
| Color Image Stabilizer (Cpd-7) | 0.03 |
| Solvent (Solv-3) | 0.35 |
| Second Layer: Anti-Color-Mixing Layer | |
| Gelatin | 0.99 |
| Anti-Color-Mixing Agent (Cpd-5) | 0.08 |
| Solvent (Solv-1) | 0.16 |

-continued

| | |
|---|---|
| Solvent (Solv-4) | 0.08 |
| Third Layer: Green-Sensitive Layer | |
| Silver Chlorobromide Emulsion (cubic emulsion of average grain size: 0.55 μm, variation coefficient: 0.09, with 1 mol % of the AgBr as a proportion of the whole grain present in part of the grain surface) | 0.36 |
| Gelatin | 1.24 |
| Magenta Coupler (ExM) | 0.31 |
| Color Image Stabilizer (Cpd-3) | 0.12 |
| Color Image Stabilizer (Cpd-4) | 0.06 |
| Color Image Stabilizer (Cpd-8) | 0.09 |
| Solvent (Solv-2) | 0.42 |
| Fourth Layer: Ultraviolet Absorbing Layer | |
| Gelatin | 1.58 |
| Ultraviolet Absorber (UV-1) | 0.47 |
| Anti-Color-Mixing Agent (Cpd-5) | 0.05 |
| Solvent (Solv-5) | 0.24 |
| Fifth Layer: | |
| Silver Chlorobromide Emulsion (cubic emulsion of average grain size: 0.36 μm, variation coefficient: 0.11, with 1.6 mol % of the AgBr as a proportion of the whole grain present in part of the grain surface) | 0.21 |
| Gelatin | 1.34 |
| Cyan Coupler (ExC) | 0.34 |
| Color Image Stabilizer (Cpd-6) | 0.17 |
| Color Image Stabilizer (Cpd-7) | 0.34 |
| Color Image Stabilizer (Cpd-9) | 0.04 |
| Solvent (Solv-4) | 0.37 |
| Sixth Layer: Ultraviolet Absorbing Layer | |
| Gelatin | 0.53 |
| Ultraviolet Absorber (UV-1) | 0.16 |
| Anti-Color-Mixing Agent (Cpd-5) | 0.02 |
| Solvent (Solv-5) | 0.08 |
| Seventh Layer: Protective Layer | |
| Gelatin | 1.33 |
| Acrylic Modified Poly(vinyl Alcohol) Copolymer (modification: 17%) | 0.17 |
| Liquid Paraffin | 0.03 |

(ExY) Yellow Coupler
Same as (ExY) in Example 1

(ExM) Magenta Coupler

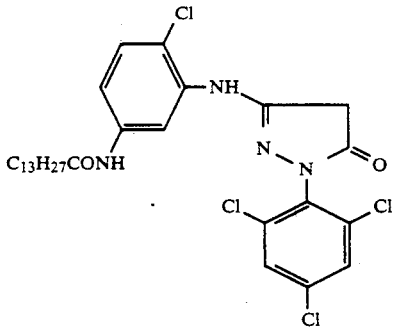

(ExC) Cyan Coupler
1/3/6 (by weight) mixture of:

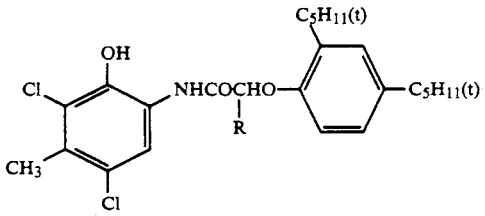

R = H, $C_2H_5$ and $C_4H_9$

-continued (Cpd-1) Color Image Stabilizer
Same as (Cpd-1) in Example 1

(Cpd-3) Color Image Stabilizer
Same as (Cpd-3) in Example 1

(Cpd-4) Color Image Stabilizer

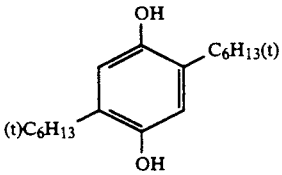

(Cpd-5) Anti-Color-Mixing Agent
Same as (Cpd-5) in Example 1

(Cpd-6) Color Image Stabilizer
Same as (Cpd-6) in Example 1

(Cpd-7) Color Image Stabilizer

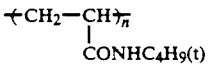

Average molecular weight: 60,000

(Cpd-8) Color Image Stabilizer

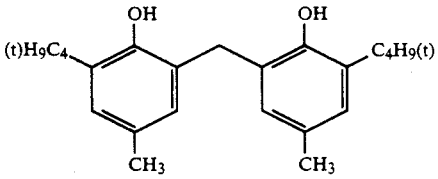

(Cpd-9) Color Image Stabilizer

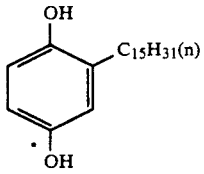

(UV-1) Ultraviolet Absorber
Same as (UV-1) in Example 1

(Solv-1) Solvent
Same as (Solv-1) in Example 1

(Solv-2) Solvent
1/1 (by volume) mixture of:

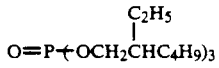

and

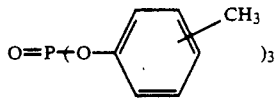

(Solv-3) Solvent
Same as (Solv-3) in Example 1

(Solv-4) Solvent
Same as (Solv-4) in Example 1

(Solv-5) Solvent

-continued

Same as (Solv-5) in Example 1

TABLE 8

| Multilayer Color Printing Paper Sample | Support Used | Remarks |
|---|---|---|
| 101 | Resin coated paper | Comparison |
| 102 | A | Invention |
| 103 | B | " |
| 104 | C | " |
| 105 | D | " |
| 106 | D | " |
| 107 | F | " |
| 108 | G | " |
| 109 | H | " |
| 110 | C-1 | Invention (antistatic layer attached) |
| 111 | C-2 | Invention (antistatic layer attached) |

The Color Printing Paper Samples 101 to 111 were color developed and processed in the way indicated below, after which CTF measurements (using Color Developing Baths XVI in Table 9), edge staining tests, processing variation tests and colored image spectral reflection density measurements (Samples 101 and 104) were carried out based on the methods described in Examples 1 and 2.

The photosensitive samples were processed in an automatic processor in accordance with the processing method indicated below using color developing baths in which the chelating agents were changed.

The color developing baths in which the chelating agents had been changed were used for continuous running tests of the photosensitive materials until the color developing bath had been replenished by a volume equal to the tank capacity.

| Processing | Temperature (°C.) | Time (sec) | Replenishment Rate (ml) | Tank Capacity (liter) |
|---|---|---|---|---|
| Color Development | 35 | 45 | 161 | 10 |
| Bleach-Fixing | 35 | 45 | 218 | 10 |
| Water Washing (1) | 35 | 30 | | 5 |
| Water Washing (2) | 35 | 30 | | 5 |
| Water Washing (3) | 35 | 30 | 360 | 5 |
| Drying | 75 | 60 | | |

Tank

-continued

| Color Developing Bath: | Solution | Replenisher |
|---|---|---|
| Water | 800 ml | 800 ml |
| Chelating Agent | 0.005 mol | 0.007 mol |
| Hydrazino-N,N-diacetic Acid | 4.5 g | 6.0 g |
| Triethanolamine | 8.0 g | 11.5 g |
| Sodium Chloride | 1.3 g | -- |
| Potassium Carbonate | 25.0 g | 25.0 g |
| N-Ethyl-N-(β-methanesulfonamidoethyl)-3-methyl-4-aminoaniline Sulfate | 4.2 g | 7.0 g |
| Fluorescent Brightener (Whitex 4B, made by Sumitomo Chemicals) | 1.4 g | 2.0 g |
| Potassium Hydroxide | 5.0 g | 7.0 g |
| Water to make | 1,000 ml | 1,000 ml |
| pH (25° C.) | 10.05 | 10.45 |

| Bleach-Fixing Bath: (tank solution = replenisher) | |
|---|---|
| Water | 400 ml |
| Ammonium Thiosulfate (700 g/liter) | 100 ml |
| Sodium Sulfite | 17 g |
| Ethylenediaminetetraacetic Acid Ferric Ammonium Salt Dihydrate | 55 g |
| Ethylenediaminetetraacetic Acid Disodium Salt | 5 g |
| Ammonium Bromide | 40 g |
| Glacial Acetic Acid | 9 g |
| Water to make | 1,000 ml |
| pH (25° C.) | 5.4 |

*1: Water washing (1), (2) and (3) controlled in a three stage countercurrent system, the water replenished to tank (3) flowing into the preceding tank.
*2: Per square meter of photosensitive materials.

Rinsing Bath: (tank solution=replenisher)

Town water was subjected to a deionizing treatment with ion exchange resins to provide calcium and magnesium contents of less than 3 ppm, after which 20 ppm of sodium isocyanurate dichloride was added prior to use. The pH of the water was 6.6.

The edge staining and staining in the unexposed parts of the photosensitive materials processed with each of the processes described above were compared at the end of the run.

TABLE 9

| Color Developing Bath | Chelating Agent |
|---|---|
| XVI | Diethylenetriamine-pentaacetic acid |
| XVII | II-2 |
| XVIII | II-3 |
| XIX | II-5 |
| XX | III-1 |
| XXI | III-2 |
| XXII | IV-2 |

TABLE 10

| Multilayer Printing Paper Sample (support used) | Resolving Power-Lines/mm at CTF of 0.5 | | | Edge Staining Color Developing Bath Used | | | | | | |
|---|---|---|---|---|---|---|---|---|---|---|
| | Cyan | Magenta | Yellow | XVI | XVII | XVIII | XIX | XX | XXI | XXII |
| 101 (resin coated paper) | 11 | 14 | 13 | B | B | B | B | B | B | B |
| 102 (A) | 25< | 30< | 30< | C | B | B | B | B | A | B |
| 101 (resin coated paper) | — | — | — | B | B | B | B | B | B | B |
| 103 (B) | 25< | 25< | 30< | D | B | B | C | C | A | B |
| 101 (resin coated paper) | — | — | — | B | B | B | B | B | B | B |
| 104 (C) | 25< | 25< | 30< | C | B | B | B | B | A | B |
| 101 (resin coated paper) | — | — | — | B | B | B | B | B | B | B |
| 105 (D) | 25< | 25< | 30< | C | B | B | B | B | A | B |
| 101 (resin coated paper) | — | — | — | B | B | B | B | B | B | B |
| 106 (E) | 25< | 25< | 30< | C | B | B | B | B | A | B |
| 101 (resin coated paper) | — | — | — | B | B | B | B | B | B | B |
| 107 (F) | 25< | 25< | 30< | C | B | B | B | B | A | B |
| 101 (resin coated paper) | — | — | — | B | B | B | B | B | B | B |
| 108 (G) | 25< | 25< | 30< | C | B | B | B | B | A | B |

TABLE 10-continued

| | | | | | | | | | | |
|---|---|---|---|---|---|---|---|---|---|---|
| 101 (resin coated paper) | — | — | — | B | B | B | B | B | B | B |
| 109 (H) | 25< | 25< | 30< | C | B | B | B | B | A | B |
| 101 (resin coated paper) | — | — | — | B | B | B | B | B | B | B |
| 110 (C-1) | 25< | 25< | 30< | C | B | B | B | B | B | B |
| 101 (resin coated paper) | — | — | — | B | B | B | B | B | B | B |
| 111 (C-2) | 25< | 25< | 30< | C | B | B | B | B | B | B |
| 101 (resin coated paper) | — | — | — | B | B | B | B | B | B | B |

| Multilayer Printing Paper Sample (support used) | Processing Variation ($\Delta D_G$) | | | | | | | No. of Sheets with Static Marks- |
|---|---|---|---|---|---|---|---|---|
| | XVI | XVII | XVIII | XIX | XX | XXI | XXII | |
| 101 (resin coated paper) | −0.03 | ±0 | −0.01 | −0.02 | −0.02 | ±0 | ±0 | 1 |
| 102 (A) | +0.04 | +0.02 | +0.01 | +0.02 | +0.03 | ±0 | +0.02 | 2 |
| 101 (resin coated paper) | −0.04 | −0.03 | −0.01 | −0.01 | −0.02 | ±0 | ±0 | 0 |
| 103 (B) | +0.05 | +0.01 | +0.02 | +0.02 | +0.03 | +0.01 | +0.03 | 4 |
| 101 (resin coated paper) | −0.06 | −0.04 | −0.01 | −0.01 | −0.03 | ±0 | −0.02 | 0 |
| 104 (C) | +0.04 | +0.01 | +0.01 | +0.01 | +0.02 | ±0 | +0.02 | 3 |
| 101 (resin coated paper) | −0.04 | −0.02 | −0.01 | ±0 | −0.01 | ±0 | ±0 | 0 |
| 105 (D) | +0.04 | +0.01 | +0.01 | +0.01 | +0.02 | ±0 | +0.02 | 2 |
| 101 (resin coated paper) | −0.04 | −0.02 | −0.01 | ±0 | −0.01 | ±0 | ±0 | 0 |
| 106 (E) | +0.04 | +0.01 | +0.01 | +0.01 | +0.02 | ±0 | +0.02 | 1 |
| 101 (resin coated paper) | −0.04 | −0.02 | −0.01 | ±0 | −0.01 | ±0 | ±0 | 0 |
| 107 (F) | +0.04 | +0.01 | +0.01 | +0.01 | +0.02 | ±0 | +0.02 | 3 |
| 101 (resin coated paper) | −0.04 | −0.02 | −0.01 | ±0 | −0.01 | ±0 | ±0 | 0 |
| 108 (G) | +0.04 | +0.01 | +0.01 | +0.01 | +0.02 | ±0 | +0.02 | 2 |
| 101 (resin coated paper) | −0.04 | −0.02 | −0.01 | ±0 | −0.01 | ±0 | ±0 | 0 |
| 109 (H) | +0.04 | +0.01 | +0.01 | +0.01 | +0.02 | ±0 | +0.02 | 4 |
| 101 (resin coated paper) | −0.04 | −0.02 | −0.01 | ±0 | −0.01 | ±0 | ±0 | 0 |
| 110 (C-1) | +0.05 | +0.01 | +0.01 | +0,01 | +0.02 | +0.01 | +0.02 | 0 |
| 101 (resin coated paper) | −0.04 | −0.02 | −0.01 | ±0 | −0.01 | ±0 | ±0 | 0 |
| 111 (C-2) | +0.05 | +0.01 | +0.01 | +0.01 | +0.02 | ±0 | +0.02 | 0 |
| 101 (resin coated paper) | −0.04 | −0.02 | −0.01 | ±0 | −0.01 | ±0 | ±0 | 0 |

Figure 3:
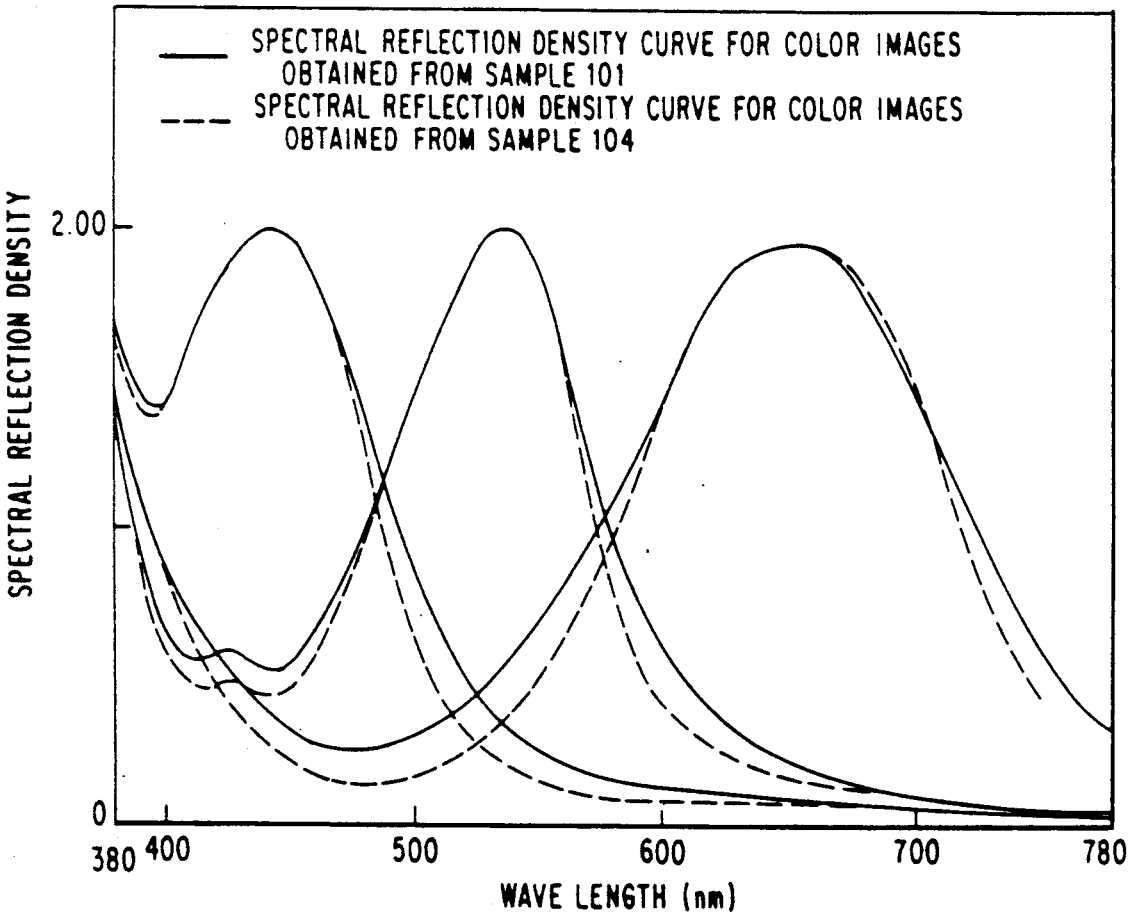
FIG. 3 shows a comparison of the spectral reflection density curves of colored images obtained by processing photosensitive materials of the present invention.

The results obtained are shown in Table 10. Furthermore, the spectral reflection density curves of the images obtained with Color Printing Paper Samples 101 and 104 are shown in FIG. 3.

In comparison to Sample 101, Samples 102 to 111 of the present invention exhibited high saturation and brightness and provided very sharp images. However, in the conventional Color Developing Bath XVI, there was a marked deterioration in respect of the occurrence of edge staining, processing variation and static mark formation. These defects were improved upon by using a color developing bath of the present invention. No static marks were seen at all with Samples 110 and 111.

EXAMPLE 4

Multilayer Color Printing Paper Sample 120 of which the layer structure is described below was prepared on a paper support which had been laminated on both sides with polyethylene. Furthermore, Multilayer Color Printing Paper Samples 121 to 127 were prepared using the supports indicated in Table 11. The coating solutions were prepared in the way described below.

Preparation of the First Layer Coating Solution

Ethyl acetate (27.2 ml) and 8.2 g of the solvent (Solv-3) were added to 19.1 g of the yellow coupler (ExY), 4.4 g of the color image stabilizer (Cpd-1) and 0.7 g of the color image stabilizer (Cpd-7) to form a solution which was then emulsified and dispersed in 185 ml of a 10% aqueous gelatin solution which contained 8 ml of 10% sodium dodecylbenzenesulfonate. On the other hand, a silver chlorobromide emulsion (cubic, average grain size: 0.88 μm, variation coefficient of the grain size distribution: 0.08, with 0.2 mol % of the silver bromide, as a proportion of the whole grain, included in the grain surface) was sulfur sensitized after adding $2.0\times10^{-4}$ mol per mol of silver of the blue-sensitive sensitizing dyes indicated below. The emulsion was then mixed with the emulsified dispersion and the first layer coating solution was prepared to provide the composition indicated below. The coating solutions for the second to the seventh layers were prepared using the same procedure as used to prepare the first layer coating solution. Moreover, 1-oxy-3,5-dichloro-s-triazine sodium salt was used as a gelatin hardening agent in each layer.

The spectral sensitizing dyes used in each layer were the same as in Example 3 except for the blue-sensitive emulsion in which the following dyes were used.

Blue-Sensitive Emulsion Layer

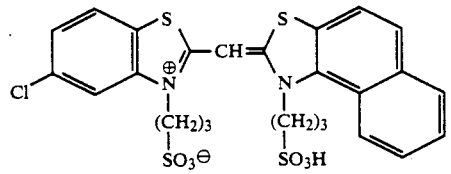

and

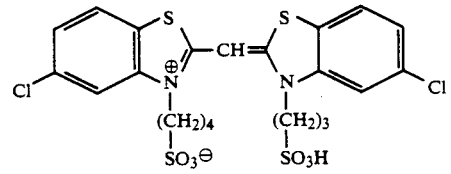

($2.0\times10^{-4}$ mol of each per mol of silver halide)

Furthermore, 1-(5-methylureidophenyl)-5-mercaptotetrazole was added at rates, per mol of silver halide, of $8.5\times10^{-5}$ mol, $7.7\times10^{-4}$ mol and $2.5\times10^{-4}$ mol, respectively, to the blue-sensitive, green-sensitive and red-sensitive emulsion layers.

The dyes indicated below were added to the emulsion layers for antiirradiation purposes.

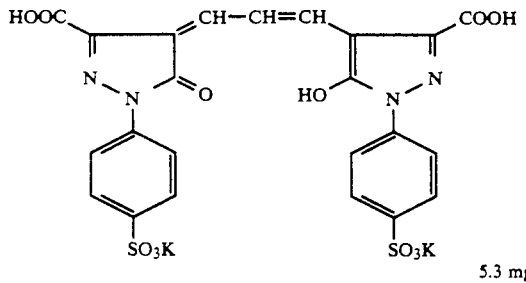

5.3 mg/m² and

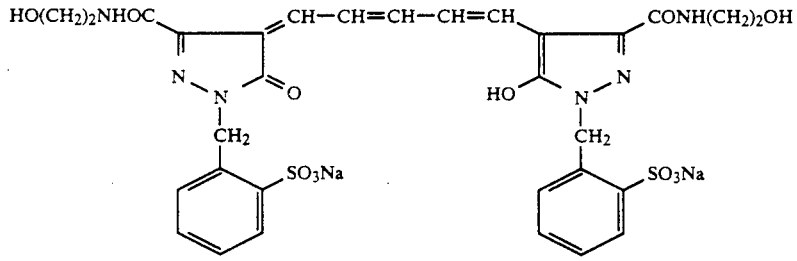

15 mg/m²

Layer Structure

The composition of each layer was as indicated below. The numerical values indicate the coated weights (g/m²). The coated weights of silver halide emulsions are indicated as coated weights calculated as silver.

Support

Polyethylene laminated paper, or the support indicated in Table 11 (a white pigment ($TiO_2$) and a bluish dye (ultramarine) were included in the polyethylene on the first layer side)

| | |
|---|---|
| First Layer: Blue-Sensitive Layer | |
| The Above Silver Chlorobromide Emulsion | 0.30 |
| Gelatin | 1.86 |
| Yellow Coupler (ExY) | 0.82 |
| Color Image Stabilizer (Cpd-1) | 0.19 |
| Solvent (Solv-3) | 0.35 |
| Color Image Stabilizer (Cpd-7) | 0.06 |
| Second Layer: Anti-Color-Mixing Layer | |
| Gelatin | 0.99 |
| Anti-Color-Mixing Agent (Cpd-5) | 0.08 |
| Solvent (Solv-1) | 0.16 |
| Solvent (Solv-4) | 0.08 |
| Third Layer: Green-Sensitive Layer | |
| Silver Chlorobromide Emulsion (⅓ (mol ratio, as silver) mixture of cubic emulsions of average grain size: 0.55 μm and 0.39 μm, variation coefficients of the grain size distributions: 0.10 and 0.08, respectively, with 0.8 mol % of the AgBr as a proportion of the whole grain present in the grain surface) | 0.12 |
| Gelatin | 1.24 |
| Magenta Coupler (ExM-1) | 0.27 |
| Color Image Stabilizer (Cpd-3) | 0.15 |
| Color Image Stabilizer (Cpd-8) | 0.02 |

-continued

| | |
|---|---|
| Color Image Stabilizer (Cpd-9) | 0.03 |
| Solvent (Solv-2) | 0.54 |
| Fourth Layer: Ultraviolet Absorbing Layer | |
| Gelatin | 1.58 |
| Ultraviolet Absorber (UV-1) | 0.47 |
| Anti-Color-Mixing Agent (Cpd-5) | 0.05 |
| Solvent (Solv-5) | 0.24 |
| Fifth Layer: Red-Sensitive Layer | |
| Silver Chlorobromide Emulsion (¼ (mol ratio, as silver) mixture of cubic emulsions of average grain size: 0.58 μm and 0.45 μm, variation coefficients of the grain size distributions: 0.09 and 0.11, respectively, with 0.6 mol % of the AgBr as a proportion of the whole grain present in part of the grain surface) | 0.23 |
| Gelatin | 1.34 |
| Cyan Coupler (ExC) | 0.32 |
| Color Image Stabilizer (Cpd-6) | 0.17 |
| Color Image Stabilizer (Cpd-10) | 0.04 |
| Color Image Stabilizer (Cpd-7) | 0.40 |
| Solvent (Solv-6) | 0.15 |
| Sixth Layer: Ultraviolet Absorbing Layer | |
| Gelatin | 0.53 |
| Ultraviolet Absorber (UV-1) | 0.16 |
| Anti-Color-Mixing Agent (Cpd-5) | 0.02 |
| Solvent (Solv-5) | 0.08 |
| Seventh Layer: Protective Layer | |
| Gelatin | 1.33 |
| Acrylic Modified Poly(vinyl Alcohol) Copolymer (modification: 17%) | 0.17 |
| Liquid Paraffin | 0.03 |

Furthermore, Color Printing Paper Sample 128 was obtained in the same way except that Support C-1 was used instead of Support Sample C-2, and the coupler (ExM-2) was used in place of the magenta coupler (ExM-1).

(ExY) Yellow Coupler
Same as (ExY) in Example 1.

(ExM-1) Magenta Coupler

-continued

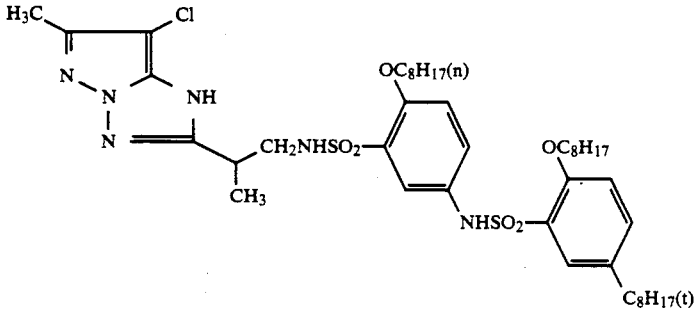

(ExM-2) Magenta Coupler

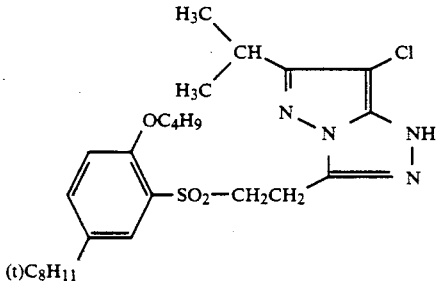

(ExC) Cyan Coupler
2/4/4 (by weight) mixture of:

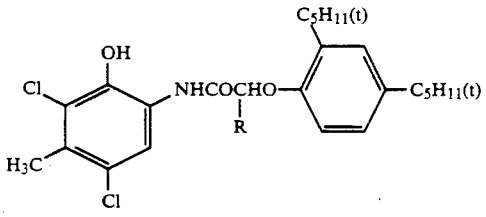

R = $C_2H_5$, $C_4H_9$ and

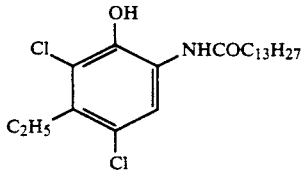

(Cpd-1) Color Image Stabilizer
Same as (Cpd-1) in Example 1

(Cpd-3) Color Image Stabilizer
Same as (Cpd-3) in Example 1

(Cpd-5) Anti-Color-Mixing Agent
Same as (Cpd-5) in Example 1

(Cpd-6) Color Image Stabilizer
Same as (Cpd-6) in Example 1

(Cpd-7) Color Image Stabilizer
Same as (Cpd-7) in Example 1

(Cpd-8) Color Image Stabilizer
Same as (Cpd-8) in Example 1

(Cpd-9) Color Image Stabilizer
Same as (Cpd-9) in Example 1

(Cpd-10) Color Image Stabilizer
Same as (Cpd-9) in Example 3

(UV-1) Ultraviolet Absorber

-continued

Same as (UV-1) in Example 1

(Solv-1) Solvent
Same as (Solv-1) in Example 1

(Solv-2) Solvent
Same as (Solv-2) in Example 1

(Solv-3) Solvent
Same as (Solv-3) in Example 1

(Solv-4) Solvent
Same as (Solv-4) in Example 1

(Solv-5) Solvent
Same as (Solv-5) in Example 1

(Solv-6) Solvent

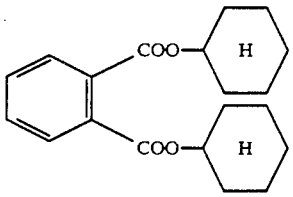

TABLE 11

| Multilayer Color Printing Paper Sample | Support Used | Remarks |
|---|---|---|
| 120 | Resin coated paper | Comparison |
| 121 | A | Invention |
| 122 | C | " |
| 123 | E | " |
| 124 | F | " |
| 125 | G | " |
| 126 | H | " |
| 127 | C-2 | Invention (antistatic layer attached) |
| 128 | C-1 | Invention (antistatic) layer attached) |

Color Printing Paper Samples 120 to 128 were color developed and processed in the way indicated below and tested in respect of edge staining and processing variation using the same methods as used in Example 1, and with Color Printing Paper Samples 120 and 128, a visual comparison was made of the images obtained as prints.

Figure 4:
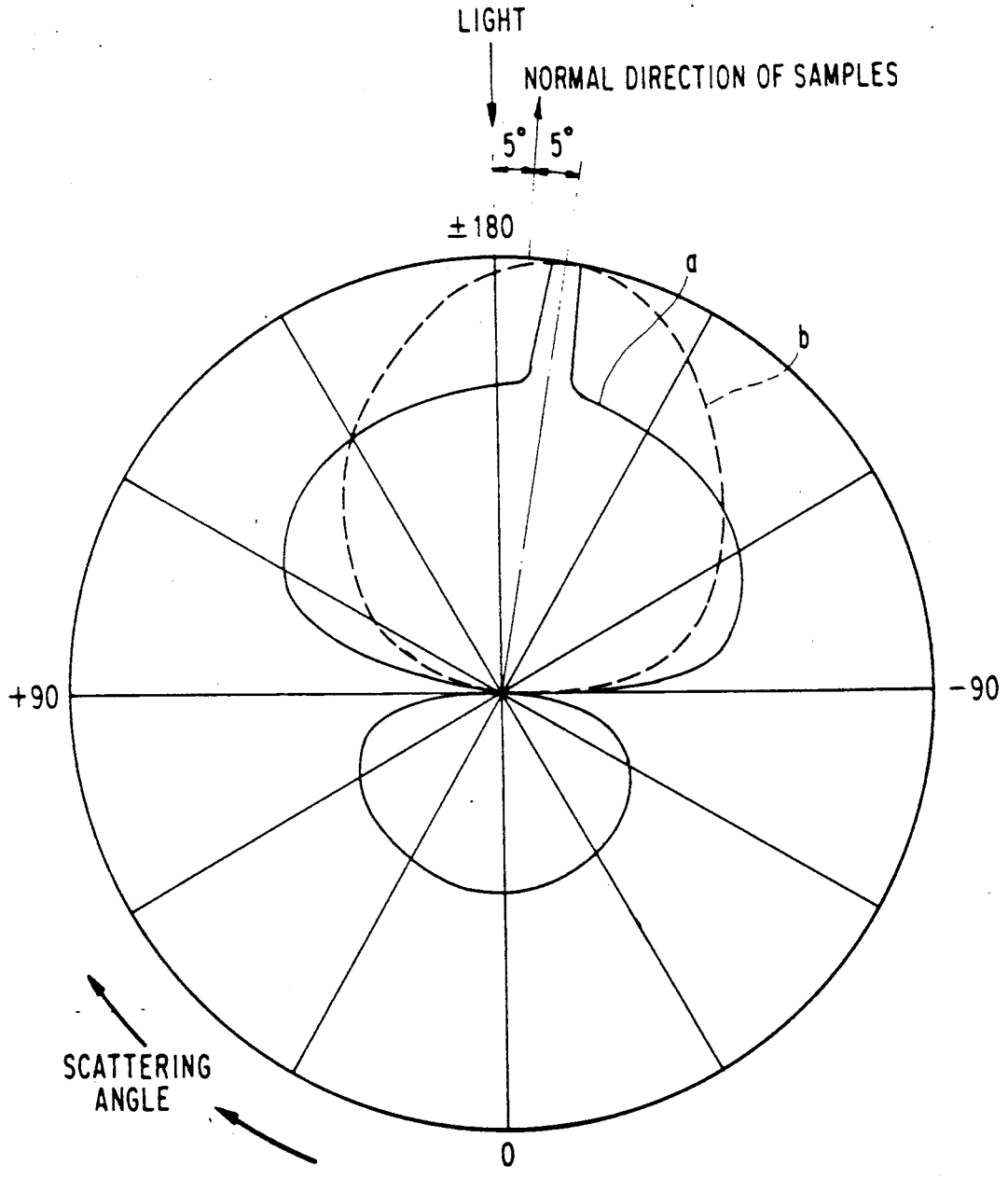
FIG. 4 is a diagram which shows a comparison of the angular dependence of the diffuse reflected light with white irradiation light in the nonimage parts of photosensitive materials of the present invention.

Simply fixed Samples 120 and 128 (samples which had been fixed without exposure or color development) were washed and the angular distribution of the scattered light (on irradiation with white light of incident angle 5°) was measured in each case using a goniophotometer (model GP-IR) made by the Murakami Color Technology Laboratories. The results obtained are shown in FIG. 4 (where "a" indicates the angular distribution for Sample 120 and "b" indicates the angular distribution for Sample 128).

The photosensitive samples were processed using the processing method indicated below in an automatic processor using color developing baths which contained various chelating agents and preservatives.

Moreover, the color developing baths which contained various chelating agents and preservatives were used in continuous running tests with the photosensitive materials until the amount of replenishment was equal to the color developing tank capacity.

| Processing | Temperature (°C.) | Time (sec) | Replenishment Rate (ml) | Tank Capacity (liter) |
|---|---|---|---|---|
| Color Development | 38 | 45 | 100 | 10 |
| Bleach-Fixing | 35 | 45 | 60 | 10 |
| Water Washing (1) | 35 | 30 | — | 5 |
| Water Washing (2) | 35 | 30 | — | 5 |
| Water Washing (3) | 35 | 30 | 360 | 5 |
| Drying | 75 | 60 | | |

| | Tank Solution | Replenisher |
|---|---|---|
| Color Developing Bath: | | |
| Water | 800 ml | 800 ml |
| Chelating Agent (see Table 12) | 0.005 mol | 0.007 mol |
| Preservative | 0.011 mol | 0.016 mol |
| Triethanolamine | 6.0 g | 11.5 g |
| Potassium Chloride | 3.0 g | — |
| Potassium Carbonate | 17.0 g | 25.0 g |
| Sodium Bicarbonate | 5.6 g | — |
| Potassium Bromide | 0.015 g | — |
| N-Ethyl-N-(β-methanesulfonamidoethyl)-3-methyl-4-aminoaniline Sulfate | 4.8 g | 9.5 g |
| Fluorescent Brightener (Whitex 4B, made by Sumitomo Chemicals) | 1.8 g | 2.5 g |
| Potassium Hydroxide | 5.0 g | 10.0 g |
| Water to make | 1,000 ml | 1,000 ml |
| pH (25° C.) | 10.05 | 10.06 |
| Bleach-Fixing Bath: | | |
| Water | 400 ml | 400 ml |
| Ammonium Thiosulfate (700 g/liter) | 100 ml | 150 ml |
| Sodium Sulfate | 17.0 g | 26.0 g |
| Ethylenediaminetetraacetic Acid Ferric Ammonium Salt Dihydrate | 55 g | 83.0 g |
| Ethylenediaminetetraacetic Acid Disodium Salt | 5 g | 8.0 g |
| Ammonium Bromide | 40 g | 60.0 g |
| Glacial Acetic Acid | 9 g | 14.0 g |
| Water to make | 1,000 ml | 1,000 ml |
| pH (25° C.) | 5.4 | 5.0 |

*1: Water washings (1), (2) and (3) controlled in a three stage countercurrent system, the water replenished to tank (3) flowing into the preceding tank.
*2: Per square meter of photosensitive materials.

Washing Water: (tank solution=replenisher)

Town water was subjected to a deionizing treatment with ion exchange resins to provide calcium and magnesium contents of less than 3 ppm, after which 20 ppm of sodium isocyanurate dichloride was added prior to use. The pH of the water was 6.6.

TABLE 12

| Color Developing Bath No. | Chelating Agent | Preservative |
|---|---|---|
| XXIII | Diethylenetriamine-pentaacetic acid | V-1 |
| XXIV | Cyclohexanediamine-tetraacetic acid | V-1 |
| XXV | II-3 | V-1 |
| XXVI | III-1 | V-1 |
| XXVII | III-2 | V-1 |
| XXVIII | IV-2 | V-1 |
| XXIX | IV-3 | V-1 |

TABLE 12-continued

| Color Developing Bath No. | Chelating Agent | Preservative |
|---|---|---|
| XXX | II-3 | VI-7 |
| XXXI | III-1 | VI-7 |
| XXXII | III-2 | VI-7 |
| XXXIII | II-3 | V-2 |
| XXXIV | III-1 | V-2 |
| XXXV | III-2 | V-2 |
| XXXVI | III-2 | VII-1 |

The results obtained are shown in Table 13.

In comparison with Color Printing Paper Sample 120, there was a marked improvement in respect of edge staining in Developing Baths XXX to XXXII, and there was a pronounced reduction in the extent of the processing variation in Color Developing Baths XXX to XXXV. Similar trends were observed when Preservative VII-1 was used in place of Preservative V-2.

TABLE 13

| Multilayer Color Printing Paper Sample (support used) | Edge Staining Color Developing Bath Used | | | | | | | |
|---|---|---|---|---|---|---|---|---|
| | XXIII | XXIV | XXV | XXVI | XXVII | XXVIII | XXIX | XXX |
| 120 (resin coated paper) | C | C | B | B | B | B | B | B |
| 121 (A) | C | C | B | B | B | B | B | A |
| 122 (C) | D | D | B | B | B | B | B | B |
| 123 (E) | C | C | B | B | B | B | B | A |
| 124 (F) | C | C | B | B | B | B | B | A |
| 125 (G) | C | C | B | B | B | B | B | A |
| 126 (H) | C | C | B | B | B | B | B | A |
| 127 (C-2) | C | C | B | B | B | B | B | A |
| 128 (C-1) | C | C | B | B | B | B | B | A |

| Multilayer Color Printing Paper Sample (support used) | Edge Staining Color Developing Bath Used | | | | | |
|---|---|---|---|---|---|---|
| | XXXI | XXXII | XXXIII | XXXIV | XXXV | XXXVI |
| 120 (resin coated paper) | B | B | B | B | B | B |
| 121 (A) | A | A | B | B | B | B |
| 122 (C) | B | B | B | B | B | B |
| 123 (E) | A | A | B | B | B | B |
| 124 (F) | A | A | B | B | B | B |
| 125 (G) | A | A | B | B | B | B |
| 126 (H) | A | A | B | B | B | B |
| 127 (C-2) | A | A | B | B | B | B |
| 128 (C-1) | A | A | B | B | B | B |

| Multilayer Color Printing Paper Sample (support used) | Processing Variation ($\Delta D_G$) | | | | | | | |
|---|---|---|---|---|---|---|---|---|
| | XXIII | XXIV | XXV | XXVI | XXVII | XXVIII | XXIX | XXX |
| 120 (resin coated paper) | −0.04 | −0.04 | −0.02 | −0.03 | −0.02 | −0.03 | −0.03 | ±0 |
| 121 (A) | +0.04 | +0.05 | +0.02 | +0.03 | +0.02 | +0.03 | +0.04 | +0.01 |
| 120 (resin coated paper) | −0.08 | −0.06 | −0.02 | −0.02 | −0.02 | −0.03 | −0.03 | −0.01 |
| 122 (C) | +0.05 | +0.04 | +0.02 | +0.03 | +0.02 | +0.03 | +0.03 | +0.01 |
| 120 (resin coated paper) | −0.10 | −0.08 | −0.02 | −0.03 | −0.02 | −0.03 | −0.03 | −0.01 |
| 123 (E) | +0.04 | +0.03 | +0.02 | +0.03 | +0.02 | +0.03 | +0.03 | +0.01 |
| 101 (resin coated paper) | −0.10 | −0.08 | −0.02 | −0.03 | −0.02 | −0.03 | −0.03 | −0.01 |
| 124 (F) | +0.03 | +0.04 | +0.02 | +0.03 | +0.02 | +0.03 | +0.03 | +0.01 |
| 120 (resin coated paper) | −0.10 | −0.08 | −0.02 | −0.03 | −0.02 | −0.03 | −0.03 | −0.01 |
| 125 (G) | +0.03 | +0.04 | +0.02 | +0.03 | +0.02 | +0.03 | +0.03 | +0.01 |
| 120 (resin coated paper) | −0.10 | −0.08 | −0.02 | −0.03 | −0.02 | −0.03 | −0.03 | −0.01 |
| 126 (H) | +0.03 | +0.04 | +0.02 | +0.03 | +0.02 | +0.03 | +0.03 | +0.01 |
| 120 (resin coated paper) | −0.10 | −0.08 | −0.02 | −0.03 | −0.02 | −0.03 | −0.03 | −0.01 |
| 127 (C-2) | +0.04 | +0.04 | +0.02 | +0.03 | +0.02 | +0.03 | +0.03 | +0.01 |
| 120 (resin coated paper) | −0.09 | −0.08 | −0.02 | −0.03 | −0.02 | −0.03 | −0.03 | −0.01 |
| 128 (C-1) | +0.04 | +0.04 | +0.02 | +0.03 | +0.02 | +0.03 | +0.03 | +0.01 |
| 120 (resin coated paper) | −0.09 | −0.08 | −0.02 | −0.03 | −0.02 | −0.03 | −0.03 | −0.01 |

| Multilayer Color Printing Paper Sample (support used) | Processing Variation ($\Delta D_G$) | | | | | |
|---|---|---|---|---|---|---|
| | XXXI | XXXII | XXXIII | XXXIV | XXXV | XXXVI |
| 120 (resin coated paper) | ±0 | ±0 | −0.02 | −0.02 | −0.02 | −0.02 |
| 121 (A) | ±0 | +0.01 | +0.02 | +0.02 | +0.02 | +0.02 |
| 120 (resin coated paper) | ±0 | ±0 | −0.02 | −0.02 | −0.02 | −0.02 |
| 122 (C) | ±0 | +0.01 | +0.02 | +0.02 | +0.02 | +0.02 |
| 120 (resin coated paper) | ±0 | ±0 | −0.02 | −0.02 | −0.02 | −0.02 |
| 123 (E) | ±0 | +0.01 | +0.02 | +0.02 | +0.02 | +0.02 |
| 101 (resin coated paper) | ±0 | ±0 | −0.02 | −0.02 | −0.02 | −0.02 |

TABLE 13-continued

| | | | | | | |
|---|---|---|---|---|---|---|
| 124 (F) | ±0 | +0.01 | +0.02 | +0.02 | +0.02 | +0.02 |
| 120 (resin coated paper) | ±0 | ±0 | −0.02 | −0.02 | −0.02 | −0.02 |
| 125 (G) | ±0 | +0.01 | +0.02 | +0.02 | +0.02 | +0.02 |
| 120 (resin coated paper) | ±0 | ±0 | −0.02 | −0.02 | −0.02 | −0.02 |
| 126 (H) | ±0 | +0.01 | +0.02 | +0.02 | +0.02 | +0.02 |
| 120 (resin coated paper) | ±0 | ±0 | −0.02 | −0.02 | −0.02 | −0.02 |
| 127 (C-2) | +0.01 | +0.01 | +0.02 | +0.02 | +0.02 | +0.02 |
| 120 (resin coated paper) | ±0 | ±0 | −0.02 | −0.02 | −0.02 | −0.02 |
| 128 (C-1) | +0.01 | +0.01 | +0.02 | +0.02 | +0.02 | +0.02 |
| 120 (resin coated paper) | ±0 | ±0 | −0.02 | −0.02 | −0.02 | −0.02 |

In comparison to the photographs obtained as prints with Sample 120, those obtained with Sample 128 had a sharp image at a viewing angle of 0° to 45° in ordinary white light irradiation, the yellow brightness was especially high, and the photographs had a solid appearance. Excellent images which could not be obtained in photographs obtained by including print sensitive materials in which ordinary supports had been used, for example, direct positive color printing papers, reversal color printing papers and slides, etc., could be obtained according to the present invention.

In comparison to Sample 120, Sample 128 had a greater light intensity at viewing angles of from 0° to 45°, and especially at viewing angles of from 20° to 30°, according to the angular dependence of the diffuse reflected light shown in FIG. 4. The supports of the present invention made effective use of the preferred directionality (angular distribution dependence) of the reflected light.

EXAMPLE 5

Reversal Color Printing Paper Sample 130 was prepared by the lamination coating of the first to the twelfth layers indicated below on a paper support which had been laminated on both sides with polyethylene. Titanium white as a white pigment and a trace of ultramarine as a bluish dye were included in the polyethylene on the first layer side of the support. Furthermore, Multilayer Reversal Color Printing Paper Samples 130 to 132 were prepared using the supports indicated in Table 14.

Photosensitive Layer Composition

The components and coated weights in units of g/m$^2$ are indicated below. In the case of the silver halides, the coated weights are indicated after calculation as silver.

| | |
|---|---|
| First Layer: Gelatin Layer | |
| Gelatin | 1.30 |
| Second Layer: Antihalation Layer | |
| Black Colloidal Silver | 0.10 |
| Gelatin | 0.70 |
| Third Layer: Low Speed Red-Sensitive Layer | |
| A Silver Chloroiodobromide EM1 (AgCl content: 1 mol %, AgI content: 4 mol %, average grain size: 0.3 μm, size distribution: 10%, cubic grains, core iodide type emulsion) Spectrally Sensitized with the Red-Sensitizing Dyes (ExS-1, ExS-2, ExS-3) | 0.06 |
| A Silver Iodobromide EM2 (AgI content: 5 mol %, average grain size: 0.45 μm, size distribution: 20%, tabular grains (aspect ratio: 5)) Spectrally Sensitized with the Red-Sensitizing Dyes (ExS-1, ExS-2, ExS-3) | 0.10 |
| Gelatin | 1.00 |
| Cyan Coupler (ExC-1) | 0.14 |
| Cyan Coupler (ExC-2) | 0.07 |
| Anti-Color-Mixing Agent (equal amounts of Cpd-2, Cpd-3, Cpd-4, Cpd-9) | 0.12 |

-continued

| | |
|---|---|
| Coupler Dispersion Medium (Cpd-5) | 0.03 |
| Coupler Solvent (Solv-1, Solv-2, Solv-3) | 0.06 |
| Fourth Layer: High Speed Red-Sensitive Layer | |
| A Silver Iodobromide EM3 (AgI content: 6 mol %, average grain size: 0.75 μm, size distribution: 25%, tabular grains (aspect ratio: 8, core iodide)) Spectrally Sensitized with the Red-Sensitizing Dyes (ExS-1, ExS-2, ExS-3) | 0.15 |
| Gelatin | 1.00 |
| Cyan Coupler (ExC-1) | 0.20 |
| Cyan Coupler (ExC-2) | 0.10 |
| Anti-Color-Mixing Agent (equal amounts of Cpd-2, Cpd-3, Cpd-4, Cpd-9) | 0.15 |
| Coupler Dispersion Medium (Cpd-5) | 0.03 |
| Coupler Solvent (Solv-1, Solv-2, Solv-3) | 0.10 |
| Fifth Layer: Interlayer | |
| Magenta Colloidal Silver | 0.02 |
| Gelatin | 1.00 |
| Anti-Color-Mixing Agent (Cpd-6, Cpd-7) | 0.08 |
| Anti-Color-Mixing Agent Solvent (Solv-4, Solv-5) | 0.16 |
| Polymer Latex (Cpd-8) | 0.10 |
| Sixth Layer: Low Speed Green-Sensitive Layer | |
| A Silver Chloroiodobromide EM4 (AgCl content: 1 mol %, AgI content: 2.5 mol %, average grain size: 0.28 μm, grain size distribution: 12%, cubic grains, core iodide type core/shell) Spectrally Sensitized with the Green-Sensitizing Dye (ExS-4) | 0.04 |
| A Silver Iodobromide EM5 (AgI content: 2.8 mol %, average grain size: 0.45 μm, grain size distribution: 12%, tabular grains (aspect ratio: 5)) Spectrally Sensitized with the Green-Sensitizing Dye (ExS-3) | 0.06 |
| Gelatin | 0.80 |
| Magenta Coupler (ExM-1) | 0.10 |
| Anti-Color-Mixing Agent (Cpd-9) | 0.10 |
| Anti-Staining Agent (Cpd-10) | 0.01 |
| Anti-Staining Agent (Cpd-11) | 0.001 |
| Anti-Staining Agent (Cpd-12) | 0.01 |
| Coupler Dispersion Medium (Cpd-5) | 0.05 |
| Coupler Solvent (Solv-4, Solv-6) | 0.15 |
| Seventh Layer: High Speed Green-Sensitive Layer | |
| A Silver Iodobromide EM6 (AgI content: 3.5 mol %, average grain size: 0.9 μm, grain size distribution: 23%, tabular grains (aspect ratio: 9, uniform iodide) Spectrally Sensitized with the Green-Sensitizing Dye (ExS-4) | 0.10 |
| Gelatin | 0.80 |
| Magenta Coupler (ExM-1) | 0.10 |
| Anti-Color-Mixing Agent (Cpd-9) | 0.10 |
| Anti-Staining Agent (Cpd-10) | 0.01 |
| Anti-Staining Agent (Cpd-11) | 0.001 |
| Anti-Staining Agent (Cpd-12) | 0.01 |
| Coupler Dispersion Medium (Cpd-5) | 0.05 |
| Coupler Solvent (Solv-4, Solv-6) | 0.15 |
| Eighth Layer: Yellow Filter Layer | |
| Yellow Colloidal Silver | 0.20 |
| Gelatin | 1.00 |
| Anti-Color-Mixing Agent (Cpd-7) | 0.06 |
| Anti-Color-Mixing Agent Solvent (Solv-4, Solv-5) | 0.15 |
| Polymer Latex (Cpd-8) | 0.10 |
| Ninth Layer: Low Speed Blue-Sensitive Layer | |
| A Silver Chloroiodobromide EM7 (AgCl content: 2 mol %, AgI content: 2.5 mol % average grain size: 0.35 μm, grain size | 0.07 |

-continued

| | |
|---|---|
| distribution: 8%, cubic grains, core iodide type core/shell) Spectrally Sensitized with the Blue-Sensitizing Dye (ExS-5) | |
| A Silver Iodobromide EM8 (AgI content: 2.5 mol %, average grain size: 0.45 μm, grain size distribution: 16%, tabular grains (aspect ratio: 6)) Spectrally Sensitized with the Blue-Sensitizing Dye (ExS-5) | 0.10 |
| Gelatin | 0.50 |
| Yellow Coupler (ExY-1) | 0.20 |
| Anti-Staining Agent (Cpd-11) | 0.001 |
| Anti-Color-Mixing Agent (Cpd-6) | 0.10 |
| Coupler Dispersion Medium (Cpd-5) | 0.05 |
| Coupler Solvent (Solv-2) | 0.05 |
| Tenth Layer: High Speed Blue-Sensitive Layer | |
| A Silver Iodobromide EM8 (AgI content: 2.5 mol %, average grain size: 1.2 μm, grain size distribution: 21%, tabular grains (aspect ratio: 14)) Spectrally Sensitized with the Blue-Sensitizing Dye (ExS-5) | 0.25 |
| Gelatin | 1.00 |
| Yellow Coupler (ExY-1) | 0.40 |
| Anti-Staining Agent (Cpd-11) | 0.002 |
| Anti-Color-Mixing Agent (Cpd-6) | 0.10 |
| Coupler Dispersion Medium (Cpd-5) | 0.15 |
| Coupler Solvent (Solv-2) | 0.10 |
| Eleventh Layer: Ultraviolet Absorbing Layer | |
| Gelatin | 1.50 |
| Ultraviolet Absorber (Cpd-1, Cpd-3, Cpd-13) | 1.00 |
| Anti-Color-Mixing Agent (Cpd-6, Cpd-14) | 0.06 |
| Dispersion Medium (Cpd-5) | 0.20 |

-continued

| | |
|---|---|
| Ultraviolet Absorber Solvent (Solv-1, Solv-2) | 0.15 |
| Antiirradiation Dye (Cpd-15, Cpd-16) | 0.02 |
| Antiirradiation Dye (Cpd-17, Cpd-18) | 0.02 |
| Twelfth Layer: Protective Layer | |
| Fine Grained Silver Chlorobromide (AgCl content: 97 mol %, average grain size: 0.2 μm) | 0.07 |
| Modified "Poval" | 0.02 |
| Gelatin | 1.50 |
| Gelatin Hardening Agent (H-1) | 0.17 |

Moreover, "Alcanol XC" (Du Pont Co.) and sodium alkylbenzenesulfonate were used as emulsification and dispersion aids, and succinic acid ester and "Magefac 120" (Dainippon Ink Co.) were used as coating aids in each layer. The compounds (Cpd-19, Cpd-20, Cpd-21) were used as stabilizers in the layers which contained silver halides or colloidal silver. The compounds used in the Examples are listed below.

TABLE 14

| Multilayer Color Printing Paper Sample | Support Used | Remarks |
|---|---|---|
| 130 | Resin coated paper | Comparison |
| 131 | C-1 | Invention |
| 132 | C-2 | Invention |

(ExS-1)

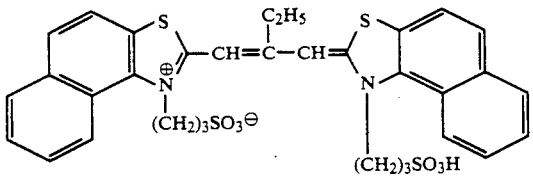

(ExS-2)

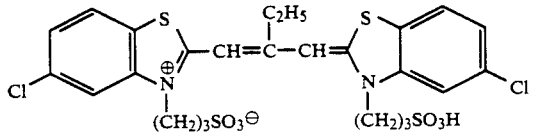

(ExS-3)

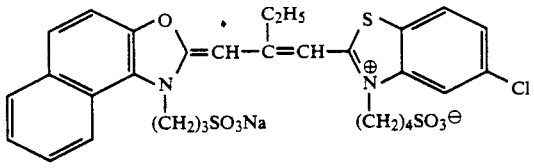

(ExS-4)

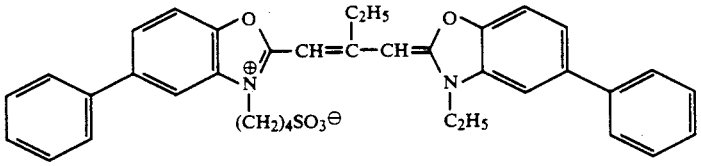

(ExS-5)

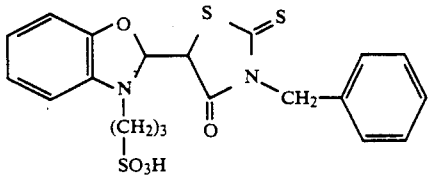

-continued
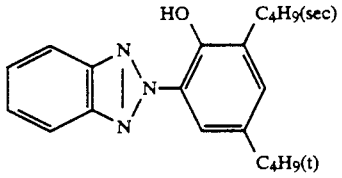
(Cpd-1)
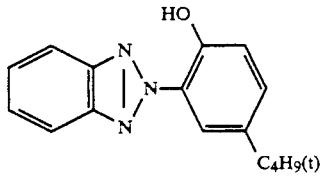
(Cpd-2)
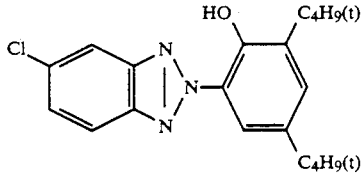
(Cpd-3)
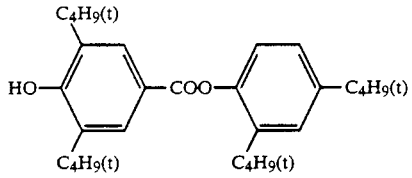
(Cpd-4)
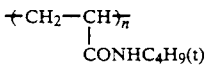
(n: 100 to 1,000)
(Cpd-5)
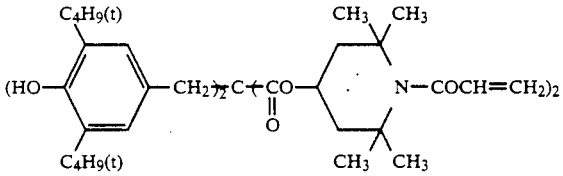
(Cpd-6)
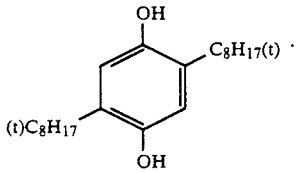
(Cpd-7)
Poly(ethyl acrylate) (Cpd-8)
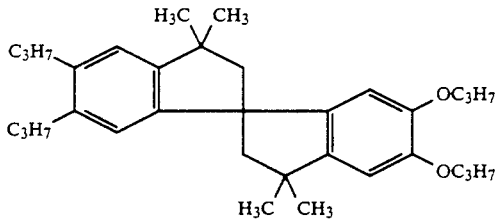
(Cpd-9)

-continued
(Cpd-10)
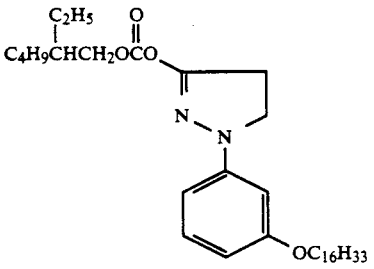
(Cpd-11)
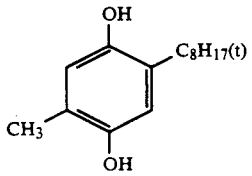
(Cpd-12)
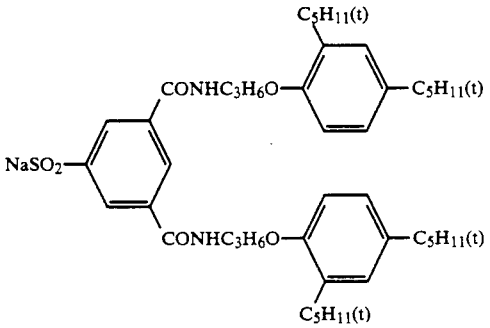
(Cpd-13)
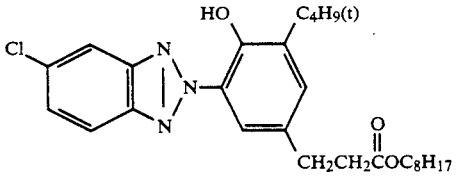
(Cpd-14)
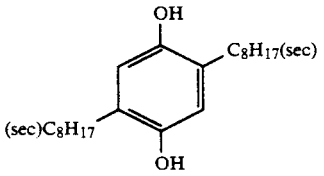
(Cpd-15)
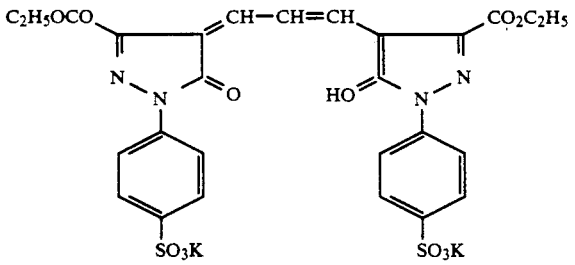
(Cpd-16)
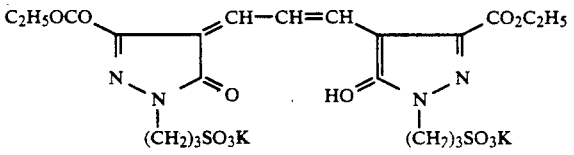

-continued
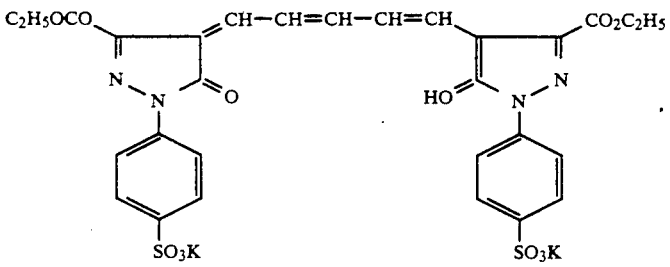
(Cpd-17)
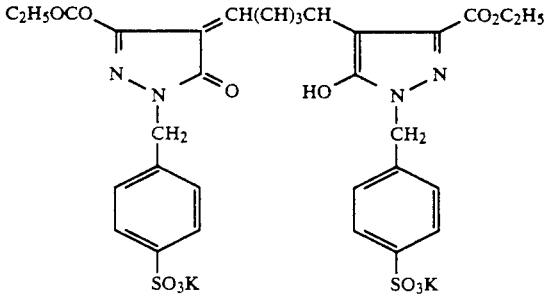
(Cpd-18)
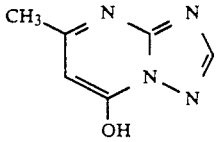
(Cpd-19)
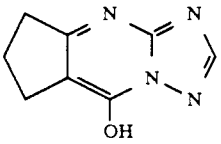
(Cpd-20)
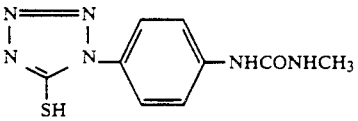
(Cpd-21)
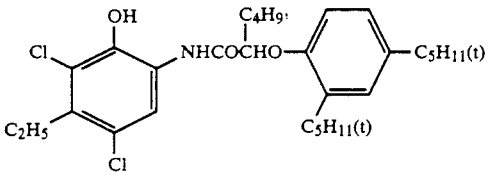
(ExC-1)
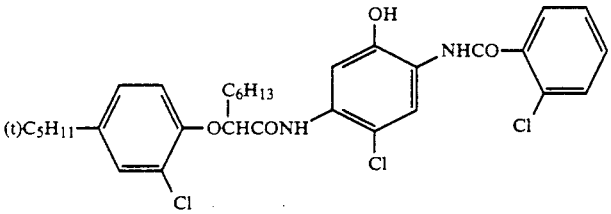
(ExC-2)

-continued

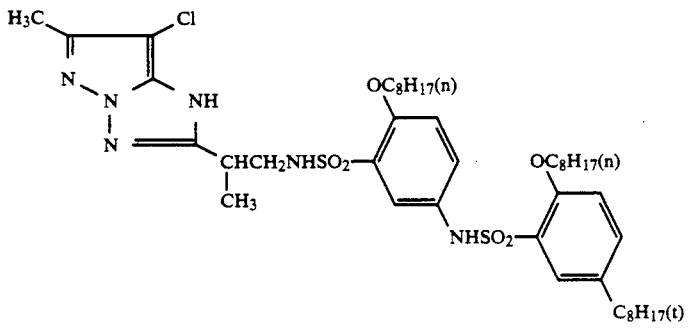

(ExM-1)

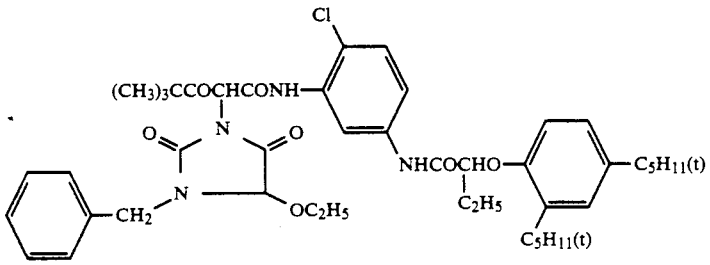

(ExY-1)

| | |
|---|---|
| Di(2-ethylhexyl)phthalate | (Solv-1) |
| Trinonyl phosphate | (Solv-2) |
| Di(3-methylhexyl) phthalate | (Solv-3) |
| Tricresyl phosphate | (Solv-4) |
| Dibutyl phthalate | (Solv-5) |
| Trioctyl phosphate | (Solv-6) |
| 1,2-Bis(vinylsulfonylacetamido)ethane | (H-1) |

Multilayer Color Printing Paper Samples 130 to 132 were processed using the processing operations and processing baths indicated below and the processed samples were stored for 2 weeks under conditions of 60° C., 70% relative humidity, and the difference in the yellow reflection densities of the white base parts before and after storage (the yellow stain variation) was measured and compared using an "Elite 310" model photographic densitometer.

| Processing | Time (sec) | Temperature (°C.) |
|---|---|---|
| First Development | 75 | 38 |
| First Water Washing | 90 | 33 |
| Reversal Exposure | 15 | 100 lux |
| Color Development | 135 | 38 |
| Second Water Washing | 45 | 33 |
| Bleach-Fixing | 120 | 38 |
| Third Water Washing | 135 | 33 |
| Drying | 45 | 75 |

The composition of each of the processing baths was as indicated below.

| | |
|---|---|
| First Developing Bath: | |
| Nitrilo-N,N,N-trimethylenephosphonic Acid Pentasodium Salt | 1.0 g |
| Diethylenetriaminepentaacetic Acid Pentasodium Salt | 3.0 g |
| Potassium Sulfite | 30.0 g |
| Potassium Thiocyanate | 1.2 g |
| Potassium Carbonate | 35.0 g |
| Hydroquinone Monosulfonic Acid Sodium Salt | 25.0 g |
| 1-Phenyl-4-hydroxymethyl-4-methyl-3-pyrazolidone | 2.0 g |
| Potassium Bromide | 0.5 g |

-continued

| | |
|---|---|
| Potassium Iodide | 5.0 mg |
| Water to make | 1,000 ml |
| pH | 9.60 |
| The pH was adjusted with hydrochloric acid or potassium hydroxide. | |
| Color Developing Bath: | |
| Benzyl Alcohol | 15.0 ml |
| Diethylene Glycol | 12.0 ml |
| 3,6-Dithia-1,8-octanediol | 0.20 g |
| Chelating Agent A | See Table 15 |
| Chelating Agent B | See Table 15 |
| Sodium Sulfite | 2.0 g |
| Hydroxylamine Sulfate | 3.0 g |
| N-Ethyl-N-(β-methanesulfonamidoethyl)-3-methylaminoaniline Sulfate | 5.0 g |
| Fluorescent Brightener (diaminostilbene based) | 1.0 g |
| Potassium Bromide | 0.5 g |
| Potassium Iodide | 1.0 mg |
| Water to make | 1,000 ml |
| pH | 10.25 |
| The pH was adjusted with hydrochloric acid or potassium hydroxide. | |
| Bleach-Fixing Bath: | |
| Ethylenediaminetetraacetic Acid Disodium Salt Dihydrate | 5.0 g |
| Ethylenediaminetetraacetic Acid Fe(III) Ammonium Salt Monohydrate | 80.0 g |
| Sodium Sulfite | 15.0 g |
| Ammonium Thiosulfate (700 g/liter) | 160 ml |
| 2-Mercapto-1,3,4-triazole | 0.5 g |
| Water to make | 1,000 ml |
| pH | 6.50 |
| The pH was adjusted with acetic acid or aqueous ammonia. | |

The samples processed using the color developing baths which contained chelating agents of the present invention exhibited little occurrence of yellow staining.

TABLE 15

| | Sample | Chelating Agent A and Concentration | Chelating Agent B and Concentration | Yellow Stain |
|---|---|---|---|---|
| Comparison | 130 | DETAPA 0.008 mol/l | — | 0.07 |
| " | 131 | " | — | 0.07 |
| " | 132 | " | — | 0.07 |
| Comparison | 130 | DETAPA 0.005 mol/l | II-4 0.003 mol/l | 0.05 |
| Invention | 131 | " | " | 0.02 |
| " | 132 | " | " | 0.02 |
| Comparison | 130 | III-2 0.008 mol/l | — | 0.05 |
| Invention | 131 | " | — | 0.02 |
| " | 132 | " | — | 0.03 |
| Comparison | 130 | DETAPA 0.005 mol/l | I-1 0.003 mol/l | 0.05 |
| Invention | 131 | " | " | 0.01 |
| " | 132 | " | " | 0.01 |
| Comparison | 130 | III-1 0.004 mol/l | I-1 0.004 mol/l | 0.06 |
| Invention | 131 | " | " | 0.03 |
| " | 132 | " | " | 0.03 |

Note: DETAPA: Diethylenetriaminepentaacetic acid

When reflective color photosensitive materials which have a multiple silver halide photosensitive layers established on a support having a metal surface which has mirror reflection properties or secondary diffuse reflection properties of the present invention with a waterproof adhesive layer established over the top are processed in processing baths, and more precisely color developing baths, which contain individual compounds (chelating agents) represented by formulae (I) to (IV), or a combination of these compounds, it is possible to obtain images which have excellent image sharpness and color saturation. Although thin metal films are used, it is possible to carry out color development processing with no edge staining or film peeling, and with excellent processing stability. Moreover, excellent processing bath and processing stability can be achieved by the combined use of compounds represented by formulae (V) and (VI), and it is also possible in this way to prevent the occurrence of discoloration and tarring of the color developing bath and to prevent the occurrence of contamination or staining. It is possible to process color photosensitive materials in which ordinary resin coated paper supports are used and color photosensitive materials of the present invention together when these processing baths are used.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material comprising a support having a thin film of metal or metal oxide on a substrate; said thin film having mirror surface reflection properties or secondary diffuse reflection properties and having a surface reflectance of at least 0.5; said photographic material having thereon, in order outwardly from the support, an adhesive layer and at least one light-sensitive silver halide emulsion layer, by the steps which comprise developing the silver halide color photographic material with a developing bath containing a color developing agent and at least two compounds selected from the group consisting of compounds represented by formulae (I), (II), (III), and (IV):

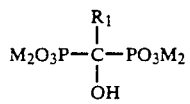

(I)

wherein M each represents hydrogen, an alkali metal or an ammonium group; and $R_1$ represents a lower alkyl group;

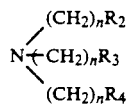

(II)

wherein $R_2$, $R_3$ and $R_4$ each represents —COOM, —$PO_3M_2$ or a hydroxyl group, wherein M represents hydrogen, an alkali metal atom or an ammonium group, provided that at most one group represented by $R_2$, $R_3$, and $R_4$ represents a hydroxyl group; and n is an integer of 1 to 3;

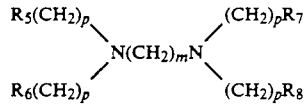

(III)

wherein $R_5$, $R_6$, $R_7$ and $R_8$ each represents —COOM, —$PO_3M_2$ or a hydroxyl group, wherein M represents hydrogen, an alkali metal atom or an ammonium group, provided that at most two of $R_5$, $R_6$, $R_7$ and $R_8$ represent a hydroxyl group; m is an integer of 1 to 4; and p is 1 or 2;

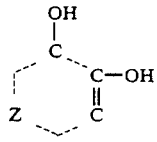

(IV)

wherein Z represents an atomic group necessary for forming a substituted or unsubstituted aromatic nucleus.

2. The method for processing a silver halide color photographic material as claimed in claim 1, wherein said thin film is at least one substance selected from the group consisting of aluminum, an aluminum alloy, an aluminum oxide or an aluminum alloy oxide, having secondary diffuse reflection properties; the surface of said thin film has a surface roughness of at least 0.1 μm, a frequency of from 0.1 to 2,000 protrusions/mm for roughness of greater than 0.1 μm; and said thin film has a spectral diffuse reflectance of from 0.6 to 1.0 in a wavelength range from 420 to 700 nm.

3. The method for processing a silver halide color photographic material as claimed in claim 1, wherein said adhesive layer contains at least a copolymer comprising vinylidene chloride, vinyl chloride and maleic anhydride.

4. The method for processing a silver halide color photographic material as claimed in claim 1, wherein said color developing bath further comprises at least one compound represented by formulae (V) or (VI):

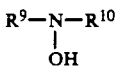

(V)

wherein $R^9$ and $R^{10}$ each represents hydrogen, an alkyl group, an alkenyl group or an aryl group;

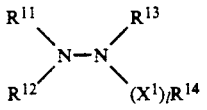

(VI)

wherein $R^{11}$, $R^{12}$ and $R^{13}$ each represents hydrogen, an alkyl group, an aryl group or a heterocyclic group; $R^{14}$ represents hydrogen, a hydroxyl group, a hydrazino group, an alkyl group, an aryl group, a heterocyclic group, an alkoxy group, an aryloxy group, a carbamoyl group or an amino group; $X^1$ represents a divalent group and l is 0 or 1, provided that when l is 0, $R^{14}$ represents an alkyl group, an aryl group or a heterocyclic group, and $R^{13}$ and $R^{14}$ may be joined together to form a heterocyclic group.

5. The method for processing a silver halide color photographic material as claimed in claim 1, wherein said developing bath contains a color developing agent and at least two compounds selected from the group consisting of compounds represented by formulae (I), (III) and (IV).

6. The method for processing a silver halide color photographic material as claimed in claim 1, wherein said adhesive layer comprises mixtures of vinylidene chloride copolymers and polyurethane/urea resin.

7. The method for processing a silver halide color photographic material as claimed in claim 1, wherein said adhesive layer has a thickness of from 0.1 μm to 10 μm.

8. The method for processing a silver halide color photographic material as claimed in claim 3, wherein said vinylidene chloride is contained in an amount of from 5 to 80 wt %, said vinyl chloride is contained in an amount of from 20 to 80 wt % and said maleic anhydride is contained in an amount of from 0.1 to 5 wt %.

9. The method for processing a silver halide color photographic material as claimed in claim 1, wherein when a compound represented by formula (I), (II) or (III) is added to the color developing bath, the compound is used in an amount of from 0.001 to 0.1 mol/liter, and when a compound represented by formula (IV) is added to the color developing bath, the formula (IV) compound is used in an amount of from 0.00005 to 0.1 mol/liter.

* * * * *